US010590694B2

(12) United States Patent
Steigerwald et al.

(10) Patent No.: US 10,590,694 B2
(45) Date of Patent: Mar. 17, 2020

(54) GLASS DOOR APPARATUS

(71) Applicants: Teufelbeschlag GmbH, Türkenfeld (DE); Nana Wall Systems, Inc., Corte Madera, CA (US)

(72) Inventors: Christian Steigerwald, Greifenberg (DE); Alexandra Steigerwald, Greifenberg (DE)

(73) Assignees: Teufelbeschlag GmbH, Tuerkenfeld (DE); Nana Wall Systems, Inc., Corte Madera, CA (US)

( * ) Notice: Subject to any disclaimer, the term of this patent is extended or adjusted under 35 U.S.C. 154(b) by 155 days.

(21) Appl. No.: 15/680,645

(22) Filed: Aug. 18, 2017

(65) Prior Publication Data

US 2018/0051505 A1 Feb. 22, 2018

(30) Foreign Application Priority Data

Aug. 18, 2016 (DE) ..... 10 2016 115 362

(51) Int. Cl.
*E06B 3/02* (2006.01)
*E06B 7/215* (2006.01)
(Continued)

(52) U.S. Cl.
CPC ..... *E06B 3/02* (2013.01); *E06B 3/06* (2013.01); *E06B 3/365* (2013.01); *E06B 3/4681* (2013.01);
(Continued)

(58) Field of Classification Search
CPC ..... E06B 3/709; E06B 3/7088; E06B 3/7059; E06B 3/02; E06B 3/5885; E06B 2003/709; E06B 2003/7088; E06B 2003/7059
(Continued)

(56) References Cited

U.S. PATENT DOCUMENTS 3,121,261 A * 2/1964 Ritter, Jr. ..... E06B 3/02 24/459
3,731,430 A * 5/1973 Dallaire ..... E06B 3/42 49/419
(Continued)

FOREIGN PATENT DOCUMENTS

CA 3012570 A1 * 8/2017 ..... E06B 3/02
DE 35 26 288 A1 1/1987
(Continued)

OTHER PUBLICATIONS

Espacenet, English abstract of DE 3526288, printed on Aug. 18, 2017.
(Continued)

*Primary Examiner* — Marcus Menezes
(74) *Attorney, Agent, or Firm* — Cahn & Samuels, LLP

(57) ABSTRACT

The invention provides a glass door apparatus with a right and a left glass door leaf (10, 100) and functional end caps (40*a*, 40*b*, 240*a*, 240*b*), which respectively have a protrusion (52*a*, 52*b*, 252*a*, 252*b*), which, with respect to a lateral front face of the functional end cap protrudes laterally outwards in a manner at least substantially parallel to a pane face of a glass pane of one glass door leaf as well as away from said glass pane, and/or a cavity (54*a*, 54*b*, 254*a*, 254*b*) which, with respect to said lateral front face, protrudes laterally inwards in a manner is at least substantially parallel to said pane face and towards said glass pane and which, in the opposite direction, opens laterally outwardly, and wherein, in the closed state of glass door apparatus, the protrusion and/or the cavity is/are overlapped with a complementary counterpiece of the other glass door leaf.

18 Claims, 24 Drawing Sheets

(51) Int. Cl.

| | |
|---|---|
| ***E06B 3/50*** | (2006.01) |
| ***E06B 3/46*** | (2006.01) |
| ***E06B 3/58*** | (2006.01) |
| ***E06B 3/06*** | (2006.01) |
| ***E06B 3/36*** | (2006.01) |
| ***E06B 3/54*** | (2006.01) |
| ***E06B 5/20*** | (2006.01) |
| ***E06B 7/23*** | (2006.01) |
| *E06B 3/70* | (2006.01) |

(52) U.S. Cl.
CPC ..... *E06B 3/5081* (2013.01); *E06B 3/549* (2013.01); *E06B 3/5885* (2013.01); *E06B 5/20* (2013.01); *E06B 7/215* (2013.01); *E06B 7/2301* (2013.01); *E06B 2003/709* (2013.01); *E06B 2003/7059* (2013.01); *E06B 2003/7088* (2013.01)

(58) Field of Classification Search
USPC ..... 49/128, 129, 130, 413
See application file for complete search history.

(56) References Cited

U.S. PATENT DOCUMENTS 5,069,010 A * 12/1991 Trainor, Jr. ..... E04B 2/825 52/127.8
2017/0298669 A1* 10/2017 Boring ..... E05D 15/063

FOREIGN PATENT DOCUMENTS

DE 297 22 391 U1 5/1998
FR 2544009 A3 * 10/1984 ..... E06B 3/02
FR 2815666 A1 * 4/2002 ..... E06B 3/222
FR 3001755 A1 * 8/2014 ..... E06B 1/26
WO 2015/082897 A1 6/2015

OTHER PUBLICATIONS

Espacenet, English abstract of DE 29722391, printed on Aug. 18, 2017.

* cited by examiner

GLASS DOOR APPARATUS

This application claims priority under the Paris Convention to German Patent Application No. 10 2016 115 362.1 filed on Aug. 18, 2016, which application is incorporated by reference.

I. TECHNICAL FIELD

The present invention relates to a glass door apparatus for effectively preventing sound, wind and humidity to penetrate in an inner area, which is separated by the glass door apparatus from an outer area.

II. BACKGROUND OF THE INVENTION

Glass door apparatuses (also called "whole glass installations") are generally composed of glass door leaves with glass panes and floor-side and ceiling-side frame parts, which are connected to the glass panes and are used for hanging and/or guiding the glass panes on the ceiling and/or on the floor. Such glass door apparatuses are used, for example, for completely or partially delimiting a first area (for instance an inner area inside a building) from a second area (for instance an outer area outside the building).

It is desirable that the glass door apparatus in a state, in which it is closed (or at least partially closed) prevents penetration of noise from the second area into the first area in a possibly effective way. In particular, in cases where the glass door apparatus delimits an outer area from an inner area, it is also desirable that the glass door apparatus in above said closed state effectively prevents penetration of humidity (for instance hitting rain and similar) as well as wind or air currents (and therefore dust and smells, for example). There is also generally a continuous need for further improving the durability and reliability of glass door apparatuses.

III. SUMMARY OF THE INVENTION

According to the invention, in one aspect, a glass door apparatus is provided, in which the penetration of sound, humidity and wind through the glass door apparatus is prevented.

According to this aspect of the present invention, a glass door apparatus is provided with: a right glass door leaf, which comprises a first (for instance rectangular) glass pane (or first glass plate), which defines a pane face, and which has a left glass pane edge, which extends at least substantially in a vertical direction, an upper glass pane edge, which extends at least substantially in a horizontal direction, and a lower glass pane edge, which extends at least substantially in a horizontal direction, an upper first glass door leaf frame part, which is engaged with the upper glass pane edge of the first glass pane, and a lower first glass door leaf frame part, which engages the lower glass pane edge of the first glass pane, and a left glass door leaf, which has a second (for instance rectangular) glass pane (or second glass plate), which defines a pane face and which comprises a right glass pane edge, which extends at least substantially in a vertical direction and which, in a closed state of the glass door apparatus, is near the left glass pane edge of the first glass pane, wherein the second glass pane further has an upper glass pane edge, which extends at least substantially in a horizontal direction, and has a lower glass pane edge, which extends at least substantially in a horizontal direction, wherein at least one of the upper first glass door leaf frame part and the lower first glass door leaf frame part has an oblong first frame body, defining a longitudinal axis, extends with its longitudinal axis along the glass pane edge belonging to the respective glass door leaf frame part of the upper and lower glass pane edges of the first glass pane and which has a left frame body longitudinal end, and has a first functional end cap, which covers the left frame body longitudinal end of the first frame body and which is horizontally positioned at the height of the left glass pane edge of first glass pane, defines a lateral outwards exposed front face (or lateral outwards exposed end face), and has a first protrusion, which, with respect to the lateral front face of first functional end cap, protrudes laterally outwards in a manner at least substantially parallel to the pane face of first glass pane and in a direction away from the first glass pane, and/or has a first cavity, which, with respect to the lateral front face of first functional end cap, protrudes laterally inwardly in a manner at least substantially parallel to pane face and in a direction towards the first glass pane (i.e., towards the inside of the functional end cap) and which, in the opposite direction, opens laterally outwards, and wherein, in the closed state of the glass door apparatus, the first protrusion and/or the first cavity of first functional end cap is/are overlapping with a respective complementary counterpiece of the left glass door leaf.

When, in the present application, reference is made to "at least substantially horizontal/vertical/parallel", this includes, with reference to orientation and/or extension of parts of the glass door apparatus, small deviations, in particular small chamfers/inclined positions of these components.

Further, the upper first glass door leaf frame part may comprise an oblong upper first frame body, which defines a longitudinal axis, which extends with its longitudinal axis along the upper glass pane edge of first glass pane and has a left frame body longitudinal end, and a upper first functional end cap, which covers the left frame body longitudinal end of upper first frame body and which is horizontally positioned at level with the left glass pane edge of first glass pane, defines a lateral outwards exposed front face, and has a first protrusion which, with respect to lateral front face of upper first functional end cap, protrudes laterally outwards in a manner at least substantially in parallel to pane face of first glass pane as well as in a direction away from the first glass pane, and/or has a first cavity, which, with respect to the lateral front face of first upper functional end cap, protrudes laterally inwardly in a manner at least substantially in parallel to pane face as well as in a direction towards the first glass pane (i.e., towards the inside of the functional end cap) and which, in the opposite direction, opens laterally outwards.

Furthermore, the lower first glass door leaf frame part may also comprise an oblong lower first frame body, which defines a longitudinal axis, which extends with its longitudinal axis along the lower glass pane edge of first glass pane and has a left frame body longitudinal end, and a lower first functional end cap, which covers the left frame body longitudinal end of the lower first frame body and which is horizontally positioned at level with the left glass pane edge of first glass pane, defines a lateral outwards exposed front face, and has a first protrusion, which, with respect to the lateral front face of lower first functional end cap, protrudes laterally outwards in a manner at least substantially parallel to the pane face of first glass pane and in a direction away from the first glass pane, and/or has a first cavity, which, with respect to the lateral front face of first functional end cap, protrudes laterally inwardly in a manner at least substantially parallel to pane face and in a direction towards the first glass pane (i.e., towards the inside of the functional end cap) and which, in the opposite direction, opens laterally outwards, and wherein, in the closed state of the glass door apparatus, the first protrusion and/or the first cavity of first functional end cap (for instance the upper and lower first functional end caps) may overlap with a respective complementary counterpiece of the left glass door leaf.

The left glass door leaf may have an oblong weather strip (for instance of at least substantially transparent and UV-resistant material), which defines a weather strip longitudinal axis and which is positioned on the right glass pane edge of the second glass pane and extends with its weather strip longitudinal axis along the right glass pane edge of the second glass pane and which has a profiled cross section, wherein the profiled cross section has a first leg, which extends, at least substantially from the right glass pane edge of second glass pane in a manner at least substantially in parallel to the pane face of the second glass pane, laterally away from the second glass pane, so that, in the closed state of the glass door apparatus, the first leg overlaps the left glass pane edge of the first glass pane and by forming a corresponding complementary counterpiece of left glass door leaf, engages the first cavity of respective first functional end cap.

The weather strip may have an h-profile cross section, wherein the h-profile cross section has a central transverse web, which has a first and second transverse web end, wherein the first leg extends from the first transverse web end, a second leg, which extends from the first transverse web end of transverse web in opposite direction to the first leg, and overlaps the right glass pane edge of the second glass pane, and has a third leg, which extends from the second transverse web end in the same direction of the second leg, and overlaps the right glass pane edge of the second glass pane (therefore interacting in an overlapping and adjacent way with a inner wall of first cavity).

The respective (for instance the upper and/or lower) first functional end cap may also have a second cavity, which, with respect to the lateral front face of respective first functional end cap, protrudes laterally inwardly in a manner at least substantially in parallel to the pane face of first glass pane as well as in a direction towards the first glass pane (i.e., towards the inside of the functional end cap) and opens, in the opposite direction, laterally outwards and which, with respect to the pane face of first glass pane, is disposed opposite the first cavity of the respective first functional end cap, so that a first functional block may be formed between the first cavity and the second cavity of the respective first functional end cap, with which functional block, in the closed state of the glass door apparatus, the complementary counterpiece associated with the first cavity of respective first functional end cap may interact in an overlapping and adjacent way.

The first functional block may have a lateral outward exposed functional block front face, which may be aligned with a lateral front face of left glass pane edge of the first glass pane and may form an extension of the lateral front face of left glass pane edge (for instance forming a gap with the lateral front face of left the glass pane edge of glass pane or because the front face of functional block is aligned with the lateral front face of left glass pane edge).

The weather strip may optionally have an H-profile cross section, which (in addition to above said first to third legs) has a fourth leg, which extends from the second transverse web end in an opposed direction with respect to the third leg, and which, in the closed state of the glass door apparatus, overlaps the left glass pane edge of the first glass pane and which, by forming a further corresponding complementary counterpiece of the left glass door leaf, engages the second cavity of the respective first functional end cap (and therefore interacts, for example, with an inner wall of second cavity in an overlapping and adjacent way).

The weather strip may extend at least substantially along the major part of the longitudinal extension or along the entire longitudinal extension of the right glass pane edge of second glass pane. In the closed state of the glass door apparatus the weather strip may also extend at least substantially along the major part of the longitudinal extension or along the entire longitudinal extension of the left glass pane edge of the first glass pane. For instance, the second and third leg may extend at least substantially along the major part of the longitudinal extension or along the entire longitudinal extension of the right glass pane edge of the second glass pane. Moreover, the first and/or the fourth leg may at least substantially extend along the major part of the longitudinal extension or along the entire longitudinal extension of the left glass pane edge of the first glass pane. The first to fourth leg and the transverse web of the weather strip may also have the same length in the vertical direction.

The left glass door leaf may also comprise an upper second glass door leaf frame part, which engages the upper glass pane edge of the second glass pane, and a lower second glass door leaf frame part, which engages the lower glass pane edge of the second glass pane. The upper second glass door leaf frame part may comprise an oblong upper second frame body, which defines a longitudinal axis, which extends with its longitudinal axis along the upper glass pane edge of the second glass pane and a right frame body longitudinal end, and a upper second functional end cap, which covers the right frame body longitudinal end of the upper second frame body and which is horizontally positioned at level of right glass pane edge of second glass pane, defines a lateral front face, which is outwards exposed and which, in a closed state of the glass door apparatus, is near to the lateral front face of the upper first functional end cap, and has a functional end cap side face, which extends at least substantially in parallel to the pane face of the second glass pane (and for instance transversely to the upper glass pane edge of the second glass pane), wherein the complementary counterpiece associated with the first protrusion of the upper first functional end cap of the left glass door leaf may be formed by the side face of the functional end cap of the upper second functional end cap and, in the closed state of the glass door apparatus, the first protrusion of the upper first functional end cap may be overlapping with the functional end cap side face of the upper second functional end cap.

The lower second glass door leaf frame part may comprise an oblong lower second frame body, which defines a longitudinal axis, extends with its longitudinal axis along the lower glass pane edge of the second glass pane and has a right frame body longitudinal end, and have a lower second functional end cap, which cover the right frame body longitudinal end of the lower second frame body and which is horizontally at level of the right glass pane edge of the second glass pane, defines a lateral outwards exposed front face, which, in a closed state of the glass door apparatus, is near a lateral front face of the lower first functional end cap, and has a functional end cap side face, which extends at least substantially parallel to the face of the second glass pane (and for instance transversely to the lower glass pane edge of second glass pane), wherein the complementary counterpiece associated with the first protrusion of the lower first functional end cap of the left glass door leaf may be formed by the functional end cap side face of the lower second functional end cap, and, in the closed state of the glass door apparatus, the first protrusion of lower first functional end cap may be overlapping the functional end cap side face of the lower second functional end cap.

The upper second functional end cap may also have a second protrusion, which, with respect to the pane face of the second glass pane, is disposed opposite to the functional end cap side face and which, with respect to the lateral front face of the upper second functional end cap, protrudes laterally outwards in a manner at least substantially parallel to the pane face of the second glass pane and in a direction away from the second glass pane, and the upper first functional end cap may have a functional end cap side face (which for instance is outwardly exposed), which, with respect to the pane face of the first glass pane, is disposed opposite to the first protrusion of the upper first functional end cap and which extends at least substantially in parallel to the pane face of the first glass pane, and, in the closed state of the glass door apparatus, the second protrusion of the upper second functional end cap may be overlapping the functional end cap side face of the upper first functional end cap.

The lower second functional end cap may also have a second protrusion, which, with respect to the pane face of the second glass pane, is disposed opposite to the functional end cap side face and which, with respect to the lateral front face of the lower second functional end cap, protrudes laterally outwards in a manner at least substantially in parallel to the pane face of the second glass pane as well as in a direction away from the second glass pane, and the lower first functional end cap may also have a functional end cap side face (for example outwardly exposed), which, with respect to the pane face of the first glass pane, is opposite to the first protrusion of the lower first functional end cap and which extends at least substantially in parallel to the pane face of the first glass pane, and, in the closed state of the glass door apparatus, the second protrusion of the lower second functional end cap may overlap the functional end cap side face of the lower first functional end cap.

The complementary counterpiece or another complementary counterpiece associated with the first cavity of the upper first functional end cap of the left glass door leaf may also be formed by the second protrusion of the upper second functional end cap, and/or the complementary counterpiece or another complementary counterpiece associated with the respective first cavity of the lower first functional end cap of the left glass door leaf may also be formed by the second protrusion of the lower second functional end cap. The second protrusion of the respective second functional end cap may for example (for instance together with and at least substantially in parallel to the first leg of the weather strip or alternatively to the first leg of the weather strip) engage the first cavity and overlap the left glass pane edge of the first glass pane.

The respective (for example the upper and/or lower) second functional end cap may also comprise a first cavity, which, with respect to the lateral front face of the respective second functional end cap, protrudes laterally inwards in a manner at least substantially in parallel to the pane face of the second glass pane and in a direction towards the second glass pane (i.e., towards the inside of the functional end cap) and which, in an opposite direction, opens laterally outwardly, and may also comprise a second cavity, which, with respect to the lateral front face of the respective second functional end cap, protrudes laterally inwards in a manner at least substantially in parallel to the pane face of the second glass pane and in a direction towards the second glass pane (i.e., towards the inside of the functional end cap) and which opens, in an opposite direction, laterally outwardly and which, with respect to the pane face of the second glass pane, is disposed opposite the first cavity of the respective second functional end cap, so that a second functional block may be formed between the first and second cavity of the respective second functional end cap, wherein the second leg of the weather strip may engage the first cavity of the respective second functional end cap and the third leg of the weather strip may engage the second cavity of the respective second functional end cap.

The second functional block may have a lateral outwardly exposed functional end cap face, which may be aligned with a lateral front face of the right glass pane edge of the second glass pane and may form an extension of the lateral front face of the right glass pane edge (for instance for forming a gap with respect to the lateral front face of the right glass pane edge or due to the fact that the functional block front face is aligned with the lateral front face of the right glass pane edge).

In the closed state of the glass door apparatus, a gap formed between the respective first protrusion of the respective first functional end cap and the respective complementary counterpiece of the left glass door leaf in a direction transversal to the pane faces of the first and second glass panes may be smaller or equal to a fifth of an overlapping length of the respective first protrusion with the respective complementary counterpiece of the left glass door leaf and/or a gap formed between the first cavity of the respective first functional end cap and the respective complementary counterpiece of the left glass door leaf in a direction transversal to the pane faces of the first and second glass panes may be smaller or equal to a fifth of an overlapping length of the first cavity of the respective first functional end cap with the respective complementary counterpiece of the left glass door leaf.

In the closed state of the glass door apparatus, a gap between the second cavity of the respective first functional end cap and the further complementary counterpiece of the left glass door leaf transversal to the pane faces of the first and second glass panes may be smaller or equal to a fifth of the overlapping length of the second cavity of the respective first functional end cap with the further corresponding complementary counterpiece of the left glass door leaf.

In the respective first functional end cap at least one sealing element receiving vertical groove (for instance two sealing element receiving vertical grooves, for instance a first sealing element receiving vertical groove and a second sealing element receiving vertical groove), which extends at least substantially in parallel to the left glass pane edge of the first glass pane, protrudes laterally inwardly at the front face in a manner at least substantially in parallel to the pane face of the first glass pane as well as in a direction towards the first glass pane (i.e., towards the inside of the functional end cap) and which opens outwardly and laterally in the opposite direction and in which a sealing element (for instance a (Mohair) brush, a sealing lip, etc.) is received, which sealing element protrudes laterally outwardly from the sealing element of the respective first functional end cap in a manner at least substantially in parallel to the pane face of the first glass pane as well as in a direction away from the first glass pane, and which sealing element, in a closed state of the glass door apparatus, interacts in an abutting way with the left glass door leaf. The sealing element in the sealing element receiving vertical groove may for instance interact in an abutting way with the second functional end cap, which is opposite the respective first functional end cap (for instance facing the same).

In the respective second functional end cap, at least one sealing element receiving vertical groove (for instance two sealing element receiving vertical grooves, for instance a first sealing element receiving vertical groove and a second sealing element receiving vertical groove) is formed, which extends at least substantially in parallel to the right glass pane edge of the second glass pane, protrudes laterally inwardly at the front face in a manner at least substantially in parallel to the pane face of the second glass pane as well as in a direction towards the second glass pane (i.e., towards the inside of the functional end cap) and which opens outwardly laterally in the opposite direction and in which a sealing element (for instance a (Mohair) brush, a sealing lip, etc.) is received, which sealing element protrudes laterally outwardly from the sealing element receiving vertical groove of the respective second functional end cap in a manner at least substantially in parallel to the face of the second glass pane as well as from the second glass pane and which sealing element, in a closed state of the glass door apparatus, interacts in an abutting way with the first functional end cap, which is opposite the respective second functional end cap. The sealing element receiving vertical groove of the respective second functional end cap may for example be positioned in opposite to the sealing element receiving vertical groove of the respective first functional end cap with respect to the pane faces of the first and second glass panes.

The right glass door leaf may be a stationary leaf, a sliding leaf, a rotating leaf or a sliding-rotating leaf, and the left glass door leaf may be a stationary leaf, a sliding leaf, a rotating leaf or a sliding-rotating leaf The protrusions and/or cavities may extend in the vertical direction along a portion of the vertical extension or at least substantially along the entire vertical extension of the respective functional end cap, in particular between an upper face and a lower face of the respective functional end cap. The functional end caps may for example be manufactured in one piece (i.e., monolithically or with a material coupling) or be made of individual parts which are mutually connected (for instance by screwing, welding, gluing, etc.) and may be made of a plastic material and/or a metallic material, such as aluminum material.

According to another aspect, which may be connected to the previous aspect of the present invention or may be combined with the same, or may be separate from it, the invention provides a glass door apparatus, whose durability and reliability are improved, by the fact that an actuating pin of an extractable (or extendible) sealing does not abut against a housing front side of a sealing (which for instance is also extendible or extractable) which is opposite the extractable sealing, instead abutting against an stop portion formed by an functional end cap, which may be massive, in order to prevent damage to the housing of the sealing opposing the extractable sealing, as well as to reduce the wear of the sealing. The durability and reliability of a glass door apparatus may also be improved by the fact that a sealing is securely and fixedly held on a functional end cap by means of a hooking element, by engaging a housing wall of the sealing from below.

According to the other aspect of the present invention, a glass door apparatus is provided with: a right glass door leaf, which has a first glass pane, which defines a pane face and which comprises a left glass pane edge, which extends at least substantially in a vertical direction, an upper glass pane edge, which extends at least substantially in a horizontal direction, and a lower glass pane edge, which extends at least substantially in a horizontal direction, a upper first glass door leaf frame part, which engages the upper glass pane edge of first glass pane, and a lower first glass door leaf frame part, which engages the lower glass pane edge of the first glass pane, and a left glass door leaf, which has a second glass pane, which defines a pane face and which comprises a right glass pane edge, which extends at least substantially in a vertical direction and which, in a closed state of the glass door apparatus, is near (e.g., adjacent to) the left glass pane edge of the first glass pane, an upper glass pane edge, which extends at least substantially in a horizontal direction, and which has a lower glass pane edge, which extends at least substantially in a horizontal direction, a upper second glass door leaf frame part, which engages an upper glass pane edge of the second glass pane, and a lower second glass door leaf frame part, which engages the lower glass pane edge of the second glass pane, wherein at least one of the upper first glass door leaf frame part and the lower first glass door leaf frame part may have: an oblong first frame body, defining a longitudinal axis, which extends with its longitudinal axis along the pane edge corresponding to the respective glass door leaf frame part among the upper and lower glass pane edges of the first glass pane and has a left frame body longitudinal end, a first functional end cap, by which the left frame body longitudinal end of the first frame body is covered, and which is horizontally positioned at level of left glass pane edge of first glass pane, defines a lateral outwardly exposed front face, defines a lateral rear face, which is positioned at a distance from the lateral front face in the direction towards the left frame body longitudinal end of the first frame body and is near (e.g., adjacent to) the left frame body longitudinal end of the first frame body, and has a sealing receiving groove, which is at least substantially parallel to the pane face of the first glass pane from the lateral front face to the rear face of first functional end cap and which opens at least substantially vertically outwardly and opens outwardly in a direction away from the lateral front face and in a direction away from the rear face of the first functional end cap, a first hook element, which is attached to the rear face of the first functional end cap and has a hooking element, a first sealing, which is at least partially positioned in the first frame body and is at least partially received in the sealing receiving groove of the first functional end cap and which has a first sealing housing which has a housing front side (for instance at level of left glass pane edge of first glass pane and which is at least substantially parallel to left glass pane edge of first glass pane) and has a housing longitudinal wall, which extends from the housing front side towards the first glass pane in a manner at least substantially parallel to the glass pane edge associated with the respective glass door leaf frame part among the upper and lower glass pane edges of the first glass pane and which extends at least substantially transversally to the pane face of the first glass pane, wherein the housing longitudinal wall of the first sealing housing is provided, at a distance from the housing front side of the first sealing housing, with a hooking element housing cavity, in which the hooking element of the first hook element engages or may engage by engaging the housing longitudinal wall of the first sealing housing from below (e.g., by reaching under or gripping under the housing longitudinal wall), in order to hold, in this way, the first sealing on the first functional end cap.

The first functional end cap may optionally have a stop portion (or abutment portion) protruding into the sealing receiving groove, the housing front side of first sealing housing may at least partially be overlapped by the stop portion of the first functional end cap at least substantially in a vertical direction, and the second glass door leaf frame part, which is adjacent to the first glass door leaf frame part, which has the first functional end cap, of the upper second and lower glass door leaf frame part, has: a oblong second frame body, defining a longitudinal axis, extending with its longitudinal axis along the corresponding of the upper and lower glass pane edge of second glass pane and has a right frame body longitudinal end, and a second sealing, formed as an extractable sealing (or also called extendible or deployable sealing), which second sealing is at least partially received in the second frame body and which has a second sealing housing, which has a housing front side, an extractable sealing profile, which in a non-extracted state, is received in the second sealing housing and which is at least substantially vertically extractable from the second sealing housing against an elastic reaction force in an outward direction, and an actuating pin which protrudes with respect to the housing front side of second sealing housing in an outward direction (for instance towards the first glass pane of right glass door panel) and which is movable (e.g., slidable), in order to cause, during its displacement, an at least substantially vertically directed extraction of the extractable sealing profile of second sealing against the elastic reaction force, wherein the glass door apparatus is configured in a way that the respective actuating pin of second sealing, during the closing process of the glass door apparatus, abuts against the corresponding stop portion formed by respective first functional end cap, in order to cause its displacement.

For example, the upper first glass door frame part may comprise: an oblong upper first frame body defining a longitudinal axis extending along its upper longitudinal axis along the upper glass pane edge of the first glass pane and having a left frame body longitudinal end, a upper first functional end cap, by which the left frame body longitudinal end of the upper first frame body is covered and which is arranged horizontally at the level of the left glass pane edge of the first glass pane, defines a lateral, outwardly exposed front face and a lateral rear face, which is disposed at a distance from the lateral front face in a direction towards the left frame body longitudinal end of the first frame body and is disposed adjacent to the longitudinal end of the first frame body, and has a sealing receiving groove which extends at least substantially parallel to the pane face of the first glass pane from the lateral front face to the rear face of the upper first functional end cap and which opens outwardly at least substantially vertically upwards and also opens outwardly in a direction away from the lateral front face and in a direction away from the rear face of the upper first functional end cap, a upper first hook element which is attached to the rear face of the first functional end cap and comprises a hooking element, an upper first sealing, which is at least partially received in the first upper frame body and is at least partly received in the sealing receiving groove of the first upper first functional end cap, and which comprises an upper first sealing housing having a housing front side and a housing longitudinal wall, which extends from the housing front side in a direction toward the first glass pane in a manner at least substantially parallel to the upper glass pane edge of the first glass pane and extends at least substantially transversely to the pane face of the first glass pane, wherein the housing longitudinal wall of the upper first sealing housing comprises a hooking element receiving groove which is provided therein at a distance from the housing front side of the upper first sealing housing and into which the hooking element of the upper first hook element can engage or engages by engaging the housing longitudinal wall of the upper first sealing housing from below to thereby hold the upper first sealing on the upper first functional end cap.

Optionally, the upper first functional end cap may have a stop portion protruding into the sealing receiving groove of upper first functional end cap, the housing front side of upper first sealing housing may be at least partially overlapped by the stop portion of upper first functional end cap and the upper second glass door leaf frame part may have: an oblong upper second frame body defining a longitudinal axis extending with its longitudinal axis along the upper glass pane edge of the second glass pane and having a right frame body longitudinal end and an upper second sealing, formed as an extractable sealing, which upper second sealing is at least partially disposed in the upper second frame body and has an upper second sealing housing having a housing front side, an extractable sealing profile, which, in a non-extracted state, is received in the upper second sealing housing and which at least substantially vertically protrudes upwards from the upper second sealing housing, and an actuating pin which protrudes outwards with respect to the housing front side of the upper second sealing housing and which is movably arranged in such a way that, during its displacement, at least a substantially vertical extraction of the extractable sealing profile of the upper second sealing upwards against the elastic reaction force takes place, wherein the glass door apparatus is arranged in such a way that the actuating pin of the upper second sealing abuts against the associated stop portion formed by the upper first functional cap during the closing process of the glass door apparatus, in order to thereby cause its displacement.

For example, the lower first glass door frame part may also comprise an oblong lower first frame body defining a longitudinal axis extending along its longitudinal axis along the lower glass pane edge of the first glass pane and having a left frame body longitudinal end, a lower first functional end cap by which the left frame body longitudinal end of the lower first frame body is covered and which is arranged horizontally at the level of the left glass pane edge of the first glass pane, defines a lateral outwardly exposed front face, defines a lateral rear face, which is disposed at a distance from the lateral front face in a direction toward the left frame body longitudinal end of the lower first frame body and is adjacent to the left frame body longitudinal end of the lower first frame body, and has a sealing receiving groove which is at least substantially parallel to the pane face of the first glass pane from the lateral front face to the rear face of the lower first functional end cap and opens outwardly at least substantially vertically downwards and also opens outwardly in the direction away from the lateral front face and in the direction away from the rear face of the lower first functional end cap, a lower first hook element attached to the rear face of the lower first functional end cap and comprising a hooking element, a lower first sealing which is at least partially received in the lower first frame body and is at least partially received in the sealing receiving groove of the lower first functional end cap and which comprises a lower first sealing housing having a housing front side and a housing longitudinal wall, which housing longitudinal wall extends from the housing front side in a direction toward the first glass pane in a manner at least substantially parallel to the lower glass pane edge of the first glass pane and extends at least substantially transversely to the pane face of the first glass pane, wherein the housing longitudinal wall of the lower first sealing housing comprises a hooking element receiving cavity, which is provided therein at a distance from the housing front side of the lower first sealing housing and into which the hooking element of the lower first hook element can engage or engages by engaging the lower first housing longitudinal wall of the lower first housing from below to thereby hold the lower first sealing on the lower first functional end cap.

Optionally, the lower first functional end cap may have a stop portion protruding into the sealing receiving groove, the housing front side of the lower first sealing housing may be at least partly overlapped by the stop portion of the lower first functional end cap, and the lower second glass door leaf frame part may have: an oblong, lower second frame body having a longitudinal axis, extending along the upper glass pane edge of the second glass pane with its longitudinal axis and having a right frame body longitudinal end, and a lower second sealing provided as an extractable sealing, which lower second sealing is at least partially housed in the lower second frame body and has a lower second sealing housing, which has a housing front side, an extractable sealing profile, which, in a non-extracted state, is received in the lower second sealing housing and which can be extracted at least substantially vertically out of the lower sealing housing against an elastic reaction force, and an actuating pin, which protrudes with respect to the housing front side of the lower second sealing housing to the outside (for instance in the direction of the first glass pane of the right glass door panel) and which is moveably arranged to effect, in the course of its displacement, at least a substantially vertical extraction of the extractable sealing profile of the lower second sealing against the elastic reaction force, the glass door being arranged in such a way that the actuating pin of the lower second sealing abuts against the associated stop portion formed by the lower first functional cap during the closing process of the glass door apparatus, thereby effecting its displacement.

The stop portion of the respective first functional end cap can be formed by a wall portion of the respective first functional end cap which has a lateral, outwardly exposed abutment surface which is, for example, a part of the lateral front face of the respective first functional end cap and against which the associated actuating pin abuts.

The respective (for example, the upper and/or the lower) second glass door leaf frame part may further have: a second functional end cap which covers the right frame body longitudinal end of the respective second frame body and which is arranged horizontally at the level of the right glass pane edge of the second glass pane, defines a lateral outwardly exposed front face, which, in a closed state of the glass door apparatus, is positioned near the lateral front face of the respective opposite first functional end cap, defines a lateral rear face which is spaced apart from the lateral front face in the direction of the right frame body longitudinal end of the respective second frame body and is near (e.g., adjacent to) the right frame body longitudinal end of the respective second frame body, and has a sealing receiving groove which extends at least substantially parallel to the pane face of the second glass pane from the lateral front face of the respective second functional end cap to the rear face of the respective second functional end cap and which opens at least substantially vertically and outwardly as well as opens outwardly in a direction away from the lateral front face and in a direction away from the rear face of respective second functional end cap, a second hook element attached to the rear face of the second functional end cap and comprising a hooking element, wherein the respective second sealing is at least partially received in the second frame body and is at least partly received in the sealing receiving groove of the respective second functional end cap, and wherein the second sealing housing of the respective second sealing has a housing longitudinal wall, which extends from the housing front side of the second sealing housing in the direction towards the second glass pane in a manner at least substantially parallel to the respective glass pane edge associated with the respective glass door leaf frame part among the upper and lower glass pane edges of the second glass pane and at least substantially transversally to the pane face of the second glass pane, and wherein the housing longitudinal wall of the second sealing housing may be provided, at a distance from the housing front side of the second sealing housing, with a hooking element receiving cavity into which the hooking element of the second hook element may engage or engages by engaging the housing longitudinal wall of the second sealing housing from below so as to hold the respective second sealing on the respective second functional end cap.

The respective hook element (for instance at least one of the respective first and second hook elements, or each of the respective first and second hook elements) may have at least a substantially L-shaped shape (for instance, a rounded L-shape), wherein the respective hook element comprises a first hook element portion which extends at least substantially vertically with respect to the housing longitudinal wall of the respective sealing housing along the rear face of the respective functional end cap and which is connected to the rear face of the respective functional end cap (for instance by means of a screw connection), and a second hook element portion which extends from an end of the first hook element portion at least substantially perpendicularly to the first hook element portion (and for instance at least substantially parallel to the associated glass pane edge from the upper and lower glass pane edges of the respective glass pane) in a direction, wherein the hooking element is formed by the second hook element portion.

The respective hook element may be provided with a nut welded to the respective hook element, whose threads engage with threads of a threaded bolt extending through the respective functional end cap from the front face to the rear face of the respective functional end cap, in order to fasten the respective hook element by means of a screw connection to the respective functional end cap.

The respective first sealing may also be provided as an extractable sealing and have an extractable sealing profile, which, in a non-extracted state, is received in the respective first sealing housing and which is at least substantially vertically and outwardly extractable from the respective first sealing housing towards the outside against an elastic reaction force, and an actuating pin, which is moveably arranged in order to cause, during its displacement, at least a substantially vertical extraction of the extractable sealing profile of the respective first sealing against the elastic reaction force.

IV. BRIEF DESCRIPTION OF DRAWINGS

Figure 1:
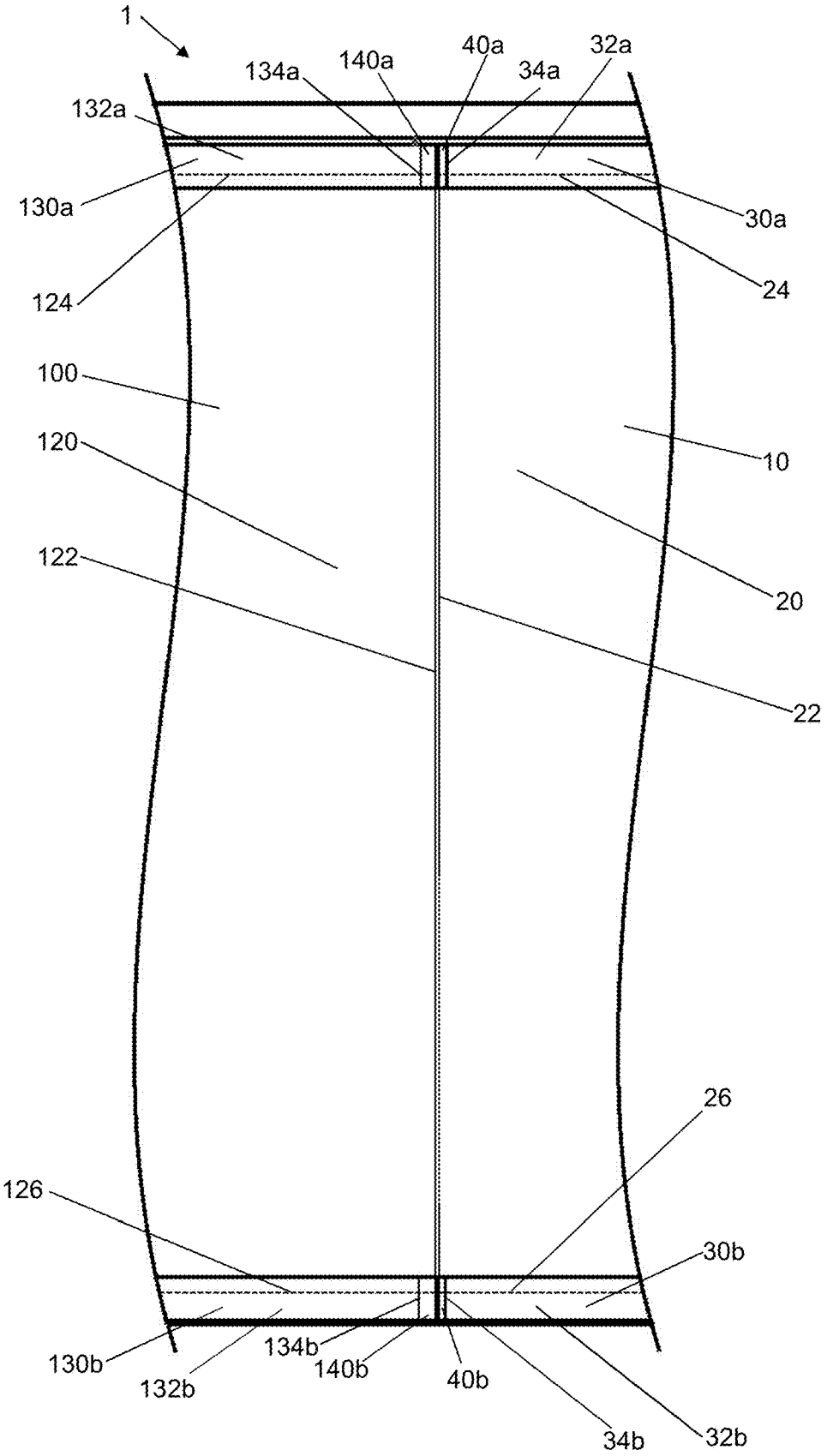
FIG. 1 is a view from an outer area of a glass door apparatus according to a first example embodiment of the present invention in a closed state of the glass door apparatus.

In the figures, the same references are used for the same or similar components.

V. DETAILED DESCRIPTION

The present invention is explained in the following by means of example embodiments with reference to drawings.

The following explanations of aspects of the invention are provided with reference to a "left glass door leaf" and a "right glass door leaf" and their mutual relationship, wherein these refer to a lateral observation of the glass door apparatus from the outer area indicated in figures. It is to be noted that terms like "left glass door leaf" and "right glass door leaf" have been chosen only for explanation purposes and the present invention is not limited to it. The left and right glass door leaf may for instance be also exchanged/mirrored in a glass door apparatus according to the present invention.

The glass door apparatus 1 according to the embodiments of the present invention and their alternatives includes a right glass door leaf 10 and left glass door leaf 100.

The right glass door leaf 10 has a first glass pane 20, which defines a pane face 21. The first glass pane 20 also has a left glass pane edge 22, which is at least substantially vertical, an upper glass pane edge 24, which is at least substantially horizontal, and a lower glass pane edge 26, which is at least substantially horizontal.

The right glass door leaf 10 also has a upper first glass door leaf frame part 30*a*, which engages the upper glass pane edge 24 of first glass pane 20 (for instance through a frame body, indicated in the following), and a lower first glass door leaf frame part 30*b*, which engages the lower glass pane edge 26 of first glass pane 20 (for instance through a frame body, indicated in the following).

The left glass door leaf 100 has a second glass pane 120, which defines a pane face 121. The second glass pane 120 also has a right glass pane edge 122, which extends at least substantially in a vertical direction, an upper glass pane edge 124, which is at least substantially horizontal, and a lower glass pane edge 126, which is at least substantially horizontal.

The left glass door leaf 100 has a upper second glass door leaf frame part 130*a*, which engages the upper glass pane edge 124 of second glass pane 120 (for instance through a frame body, indicated in the following) and a lower second glass door leaf frame part 130*b*, which engages the lower glass pane edge 126 of second glass pane 120 (for instance through a frame body, indicated in the following).

According to the embodiments of the present invention and its alternatives, the upper first glass door leaf frame part 30*a* may have a first oblong frame body 32*a*, which defines a longitudinal axis 33*a*, extends with its longitudinal axis 33*a* along the upper glass pane edge 24 of first glass pane 20 and has a left frame body longitudinal end 34*a*. The upper first frame body 32*a* has a central frame body glass pane receiving groove, in which the upper glass pane edge 24 of the first glass pane 20 is inserted and in which the upper glass pane edge 24 of first glass pane 20 is held, for instance by clamping, so that the upper first glass door leaf frame part 30*a* engages the upper glass pane edge 24 of first glass pane 20.

The upper second glass door leaf frame part 130*a* may also have a second oblong upper frame body 132*a*, which defines a longitudinal axis 133*a*, extends with its longitudinal axis 133*a* along the upper glass pane edge 124 of second glass pane 120 and has a right frame body longitudinal end 134*a*. The upper second frame body 132*a* has, for example, a central frame body glass pane receiving groove, in which the upper glass pane edge 124 of second glass pane 120 is inserted and in which the upper glass pane edge 124 of second glass pane 120 is held, for instance by clamping, so that the upper second glass door leaf frame part 130*a* engages the upper glass pane edge 124 of second glass pane 120.

Moreover, the lower first glass door leaf frame part 30*b* may have a lower first frame body 32*b*, which defines a longitudinal axis 33*b*, extends with its longitudinal axis 33*b* along the lower glass pane edge 26 of first glass pane 20 and has a left frame body longitudinal end 34*b*. The lower first frame body 32*b* has, for example, a central frame body glass pane receiving groove, in which the lower glass pane edge 26 of first glass pane 20 is inserted and in which the lower glass pane edge 26 of first glass pane 20 is held, for instance by clamping, so that the lower first glass door leaf frame part 30*b* engages the lower glass pane edge 26 of first glass pane 20.

The lower second glass door leaf frame part 130*b* may have a lower second frame body 132*b*, which defines a longitudinal axis 133*b*, extends with its longitudinal axis 133*b* along the lower glass pane edge 126 of second glass pane 120 and has a right frame body longitudinal end 134*b*. The lower first frame body 132*b* has, for example, a central frame body glass pane receiving groove, in which the lower glass pane edge 126 of second glass pane 120 is inserted and in which the lower glass pane edge 126 of second glass pane 120 is held, for instance by clamping, so that the lower second glass door leaf frame part 130*b* engages the lower glass pane edge 126 of second glass pane 120.

Further, with respect to the embodiments of the present invention and their alternatives, first functional end caps 40*a*, 40*b*, 240*a*, 240*b* and second functional end caps 140*a*, 140*b*, 340*a*, 340*b* will be described in detail. Each of these functional end caps defines a lateral, outwardly exposed front face 42*a*, 42*b*, 142*a*, 142*b*, 242*a*, 242*b*, 342*a*, 342*b* and defines a lateral rear face 43*a*, 43*b*, 143*a*, 143*b*, 243*a*, 243*b*, 343*a*, which is disposed at a distance, in the direction from the lateral front face towards the respectively corresponding one of the left and right frame body longitudinal ends of the respective frame body, and is adjacent to the respectively corresponding one of the left and right frame body longitudinal ends of the respective frame body (wherein, for instance, the rear face is the cover of the respectively corresponding one of the left and right frame body longitudinal ends of the respective frame body). Each of these functional end caps also defines, e.g., an outwardly exposed upper face 44*a*, 44*b*, 144*a*, 144*b*, 244*a*, 244*b*, 344*a*, 344*b*, an outwardly exposed lower face 46*a*, 46*b*, 146*a*, 146*b*, 246*a*, 346*a* which, with respect to the corresponding one of the upper and lower glass pane edges of the corresponding glass pane, is disposed opposite the upper face of the respective functional end cap, and has a first outwardly exposed functional end cap side face 48*a*, 48*b*, 148*a*, 148*b*, 248*a*, 248*b*, 348*a*, 348*b*, which extends at least substantially parallel to the pane face of the corresponding glass pane, and a second outwardly exposed functional end cap side face 50*a*, 50*b*, 150*a*, 150*b*, 250*a*, 250*b*, 350*a*, 350*b*, which extends at least substantially parallel to the pane face of the corresponding glass pane and which is arranged, with respect to the pane face of the associated glass pane, opposite the respective functional end cap side face 48*a*, 48*b*, 148*a*, 148*b*, 248*a*, 248*b*, 348*a*, 348*b* of the respective functional end cap. Moreover, the lateral, outwardly exposed front face of a respective second functional end cap, is, in a closed state of the glass door apparatus 1, adjacent to the lateral front face of the respectively associated first functional end cap (for example, the lateral, outwardly exposed front face of a upper second functional end cap is, in a closed state of the glass door apparatus 1, adjacent to the lateral front face of the upper first functional end cap, etc.).

FIGS. 1 to 15 represent a glass door apparatus 1 according to a first example embodiment of the present invention.

Figure 2:
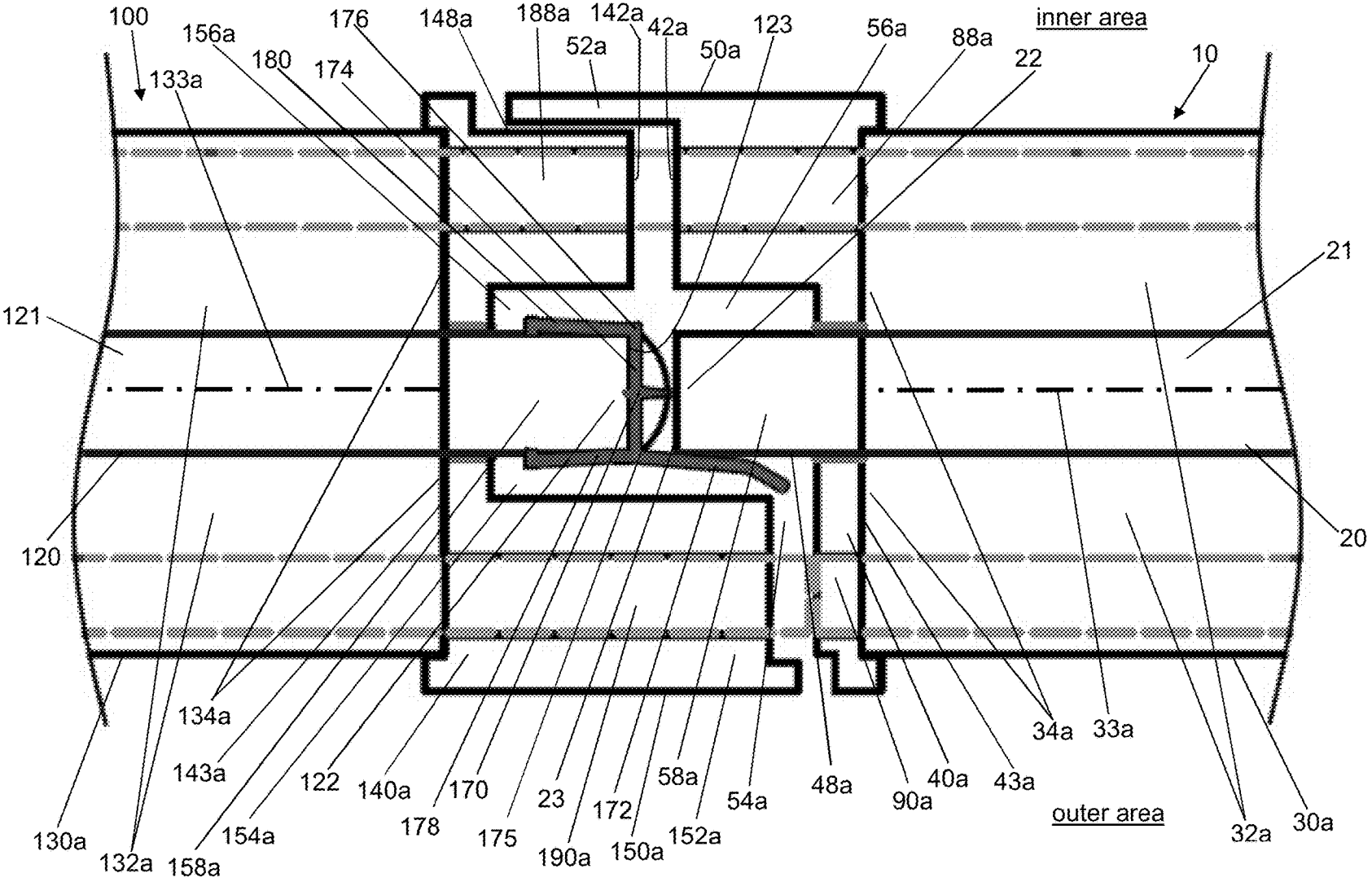
FIG. 2 is a plan view of a glass door apparatus according to a first alternative of the first example embodiment of the present invention in a closed state of the glass door apparatus.
Figure 9:
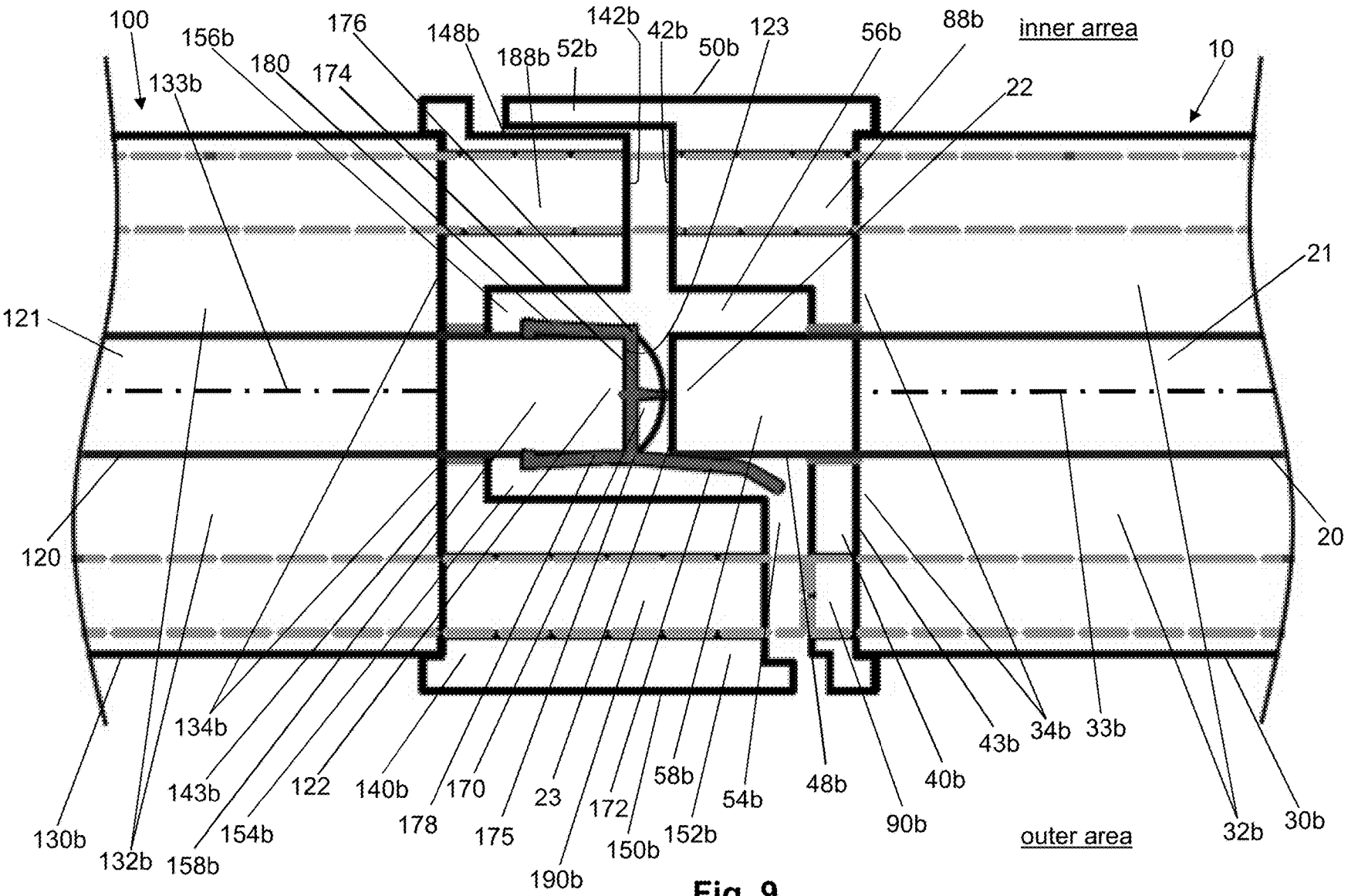
FIG. 9 is a plan view of a glass door apparatus according to a second alternative of the first example embodiment of the present invention in a closed state of the glass door apparatus.

In the first example embodiment of the present invention, the left glass door leaf 100, as shown in FIGS. 2 and 9 in cross section, has an oblong weather strip 170, which defines a weather strip longitudinal axis and which is positioned on the right glass pane edge 122 of second glass pane 120 and which extends, with its weather strip longitudinal axis, along the right glass pane edge 122 of second glass pane 120. The weather strip 170 is made, for example, of an at least substantially transparent and UV-resistant synthetic material, such as polyethylene terephthalate glycol or also called glycol-modified polyethylene terephthalate (short PETG or PET-G). In the first embodiment of present invention, the weather strip 170 has a profile cross section (in the plan view) with a first leg 172, extending from the right glass pane edge 122 of second glass pane 120 in a manner at least substantially parallel to pane face 121 of second glass pane 120 and laterally away from the second glass pane 120.

According to a first example embodiment the weather strip 170 has an h-shaped cross section profile with a central transverse web 174, which has a first transverse web end 175 and a second transverse web end 176, wherein the first leg 172 extends from the first transverse web end 175, a second leg 178, which extends from the first transverse web end 175 in an opposite direction with respect to first leg 172 and overlaps the right glass pane edge 122 of second glass pane 120, and a third leg 180, which extends from the second transverse web end 176 in the same direction of second leg 178 and overlaps the right glass pane edge 122 of second glass pane 120. The second leg 178 and the third leg 180 surround (e.g., engage in a gripping manner) for example at least partially the pane face 121 of second glass pane 120, wherein the weather strip 170 is disposed through the second leg 178 and third leg 180 for instance by clamping on the second glass pane 120. As an alternative to the h-shaped transverse section profile, the weather strip may also have only an L-shaped profile cross section with the first leg and the central transverse web and may for instance be glued to the right glass pane edge of second glass pane 120.

The weather strip 170 extends, for instance, at least substantially over the major part of longitudinal extension or the entire longitudinal extension of right glass pane edge 122 of second glass pane 120 and/or the left glass pane edge 22 of second glass pane 20. The weather strip 170 may also protrude beyond the upper glass pane edge and/or the lower glass pane edge of respective glass pane. In the closed state of the glass door apparatus 1, the first leg 172 overlaps the left glass pane edge 22 of first glass pane 20 and the first leg 172 contacts the pane face 21 of first glass pane, so that the weather strip 170 at least substantially seals a gap between the left glass pane edge 22 of first glass pane 20 and right glass pane edge 122 of second glass pane 120. Above mentioned legs may be resilient, so that the first leg 172 is biased against the pane face 21 of first glass pane 20 and/or so that the second leg 178 and third leg 180 are biased against the pane face 121 of second glass pane 120.

In the following, a first and second alternative of first example embodiment are described. In a glass door apparatus according to the present invention the first or second alternative of first embodiment may be provided. Both alternatives of the first embodiment may also be simultaneously provided (i.e., in combination) in a glass door apparatus of the invention.

In the following, the first alternative of first example embodiment is described with reference to FIGS. 1 and 2 to 8.

Figure 3:
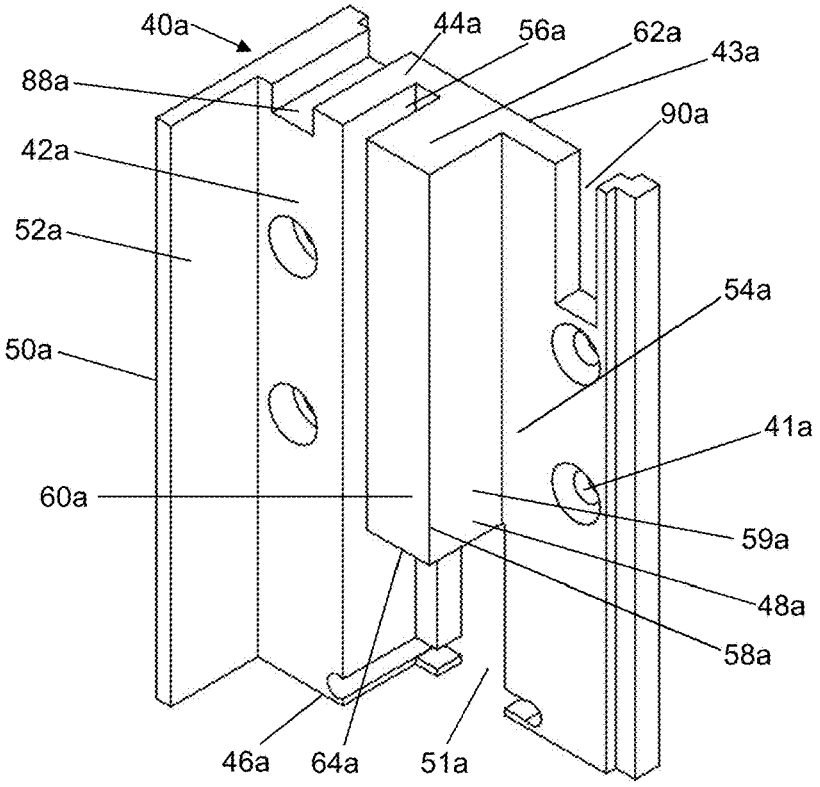
FIGS. 3 to 5 are respectively a perspective view, a front side view and a plan view of a upper first functional end cap according to the first alternative of the first example embodiment of the present invention.
Figure 4:
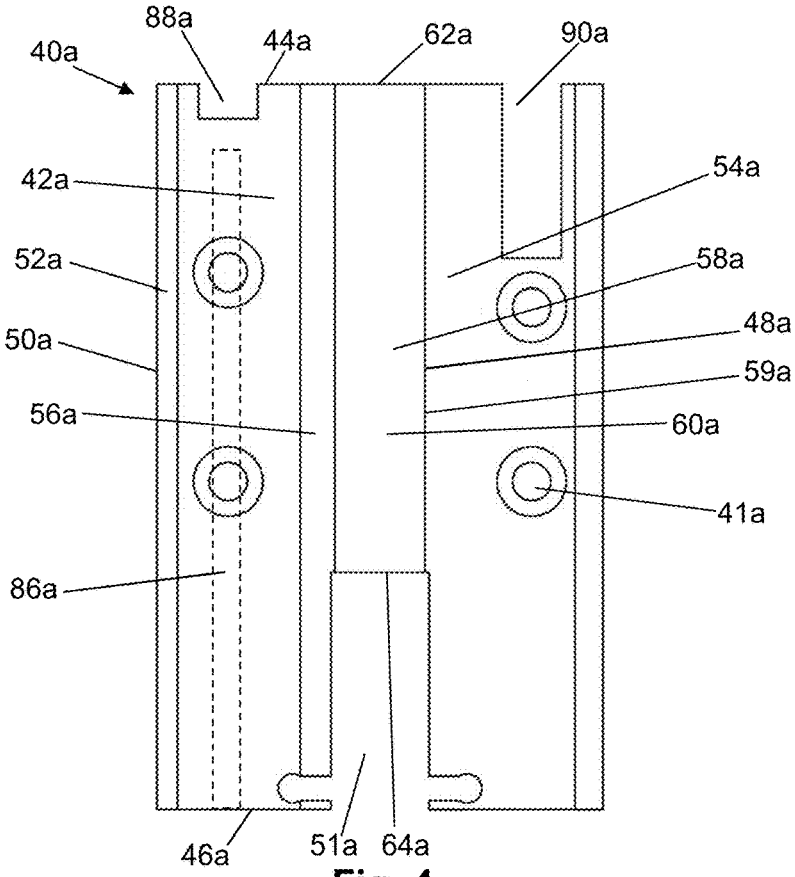
Figure 5:
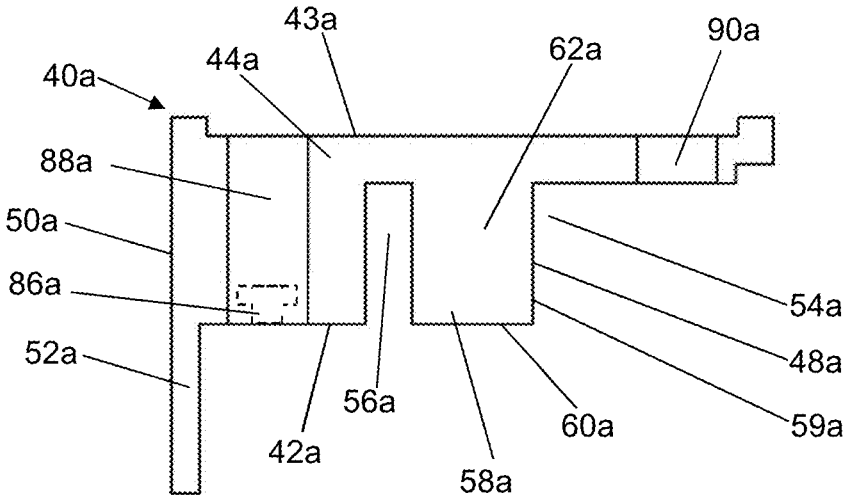

The upper first glass door leaf frame part 30*a* according to the first alternative has an upper first functional end cap 40*a* (detailed in FIGS. 3 to 5), by which the left frame body longitudinal end 34*a* of upper first frame body 32*a* is covered and which is horizontally positioned at level with left glass pane edge 22 of first glass pane 20. The upper first functional end cap 40*a* is connected to upper first frame body 32*a* for instance by screwing, wherein the upper first functional end cap 40*a* has at least one through-hole 41*a* (FIGS. 3 to 5 show four holes, as an example) for receiving a (respective) threaded pin, by which the upper first functional end cap 40*a* is connected to the upper first frame body 32*a*. The upper first functional end cap 40*a* may also be connected to upper first frame body 32*a* in another way, for instance by a clamping connection or a locking or latching connection (e.g., snap connection).

The upper first functional end cap 40*a* also has a central glass pane receiving groove 51*a*, which protrudes, with respect to lower face 46*a* of the upper first functional end cap 40*a*, inwards in a manner at least substantially in parallel to left glass pane edge 22 of first glass pane 20 as well as at least substantially vertical in a direction towards the upper face 44*a* of upper first functional end cap 40*a* and which, in the opposite direction, opens downwards and in which the first glass pane 20 is placed, wherein for instance buffer elements (for instance of elastic material) are introduced between the first glass pane 20 and the upper first functional end cap 40*a* in the glass pane receiving groove 51*a*.

The upper first functional end cap 40*a* also has a first protrusion 52*a*, which, with respect to lateral front face 42*a* of the upper first functional end cap 40*a*, protrudes laterally outwardly in a manner at least substantially in parallel to pane face 21 of first glass pane 20 and in a direction away from the first glass pane 20, wherein, in the closed state of glass door apparatus 1, the first protrusion 52*a* of the upper first functional end cap 40*a* overlaps with a complementary counterpiece of the left glass door leaf 100, said complementary counterpiece being associated with the first protrusion 52*a* of upper first functional end cap 40*a*. The first protrusion 52*a* may extend at least substantially in a vertical direction over a portion of the vertical extension or at least substantially the entire vertical extension of upper first functional end cap 40*a* between the upper face 44*a* and lower face 46*a* of upper first functional end cap 40*a*. The first protrusion 52*a* of upper first functional end cap 40*a* may also form, at least partially, the second functional end cap side face 50*a* of upper first functional end cap 40*a*. The upper first functional end cap side face 48*a* of upper first functional end cap 40*a* is also opposite to the first protrusion 52*a* of upper first functional end cap 40*a* with respect to pane face 21 of first glass pane 20.

The upper first functional end cap 40*a* also has a first cavity 54*a*, which, with respect to lateral front face 42*a* of upper first functional end cap 40*a*, protrudes laterally inwards in a manner at least substantially parallel to pane face 21 of first glass pane 20 and towards the first glass pane 20 and which, in the opposite direction, opens laterally and outwardly. In the first embodiment, the first cavity 54*a* of upper first functional end cap 40*a* also opens transversally with respect to pane face 21 of first glass pane 20 and away from pane face 21 of first glass pane 20, wherein a limiting contour which delimits the first cavity 54*a* of upper first functional end cap 40*a* has an at least substantially L-shaped section profile. The first cavity 54*a* of upper first functional end cap 40*a* may extend at least substantially in a vertical direction over a portion or at least entirely over the vertical extension of upper first functional end cap 40*a* between the upper face 44*a* and the lower face 46*a* of upper first functional end cap 40*a*. In the closed state of glass door apparatus, the first cavity 54*a* of upper first functional end cap 40*a* overlaps a complementary counterpiece of left glass door leaf 100, the complementary counterpiece being associated with first cavity 54*a* of upper first functional end cap 40*a*. In the first embodiment, the complementary counterpiece of left glass door leaf 100 associated with first cavity of upper first functional end cap 40*a* is formed by the first leg 172 of weather strip 170. As shown in FIG. 2, the first leg 172 overlaps, in the closed state of glass door apparatus 1, the left glass pane edge 22 of first glass pane 20 and engages, forming the corresponding complementary counterpiece of left glass door leaf 100 the first cavity 54*a* of upper first functional end cap 40*a*, wherein the first leg 172 overlaps a wall delimiting the first cavity 54*a* of upper first functional end cap 40*a*, which in the first embodiment is formed by the functional end cap side face 48*a* of upper first functional end cap 40*a*, and contacts the same, whereby the sealing may be improved. The first leg 172 of weather strip 170 extends, for example, over the upper glass pane edge 24 of first glass pane 20 at least substantially vertically (for instance upwards) and optionally extends at least substantially up to the upper face 44*a* of upper first functional end cap 40*a*.

The upper first functional end cap 40*a* also has a second cavity 56*a*, which, with respect to lateral front face 42*a* of upper first functional end cap 40*a*, protrudes laterally inwards in a manner at least substantially in parallel to pane face 21 of first glass pane 20 and towards the first glass pane 20 and which, in the opposite direction, opens laterally outwardly and which is positioned, with respect to pane face 21 of first glass pane 20, opposite to the first cavity 45*a* of upper first functional end cap 40*a*, so that a first functional block 58*a* is formed between the first cavity 54*a* and second cavity 56*a* of the upper first functional end cap 40*a*. The second cavity 56*a* of upper first functional end cap 40*a* has an at least substantially U-shaped profile cross-section. The second cavity 56*a* of upper first functional end cap 40*a* may also extend at least substantially vertically over a portion or the entirety of vertical extension of the upper first functional end cap 40*a* between the upper face 44*a* and lower face 46*a* of upper first functional end cap 40*a*.

The first functional block 58*a* of upper first functional end cap 40*a* has for instance a lateral outward exposed functional block front face 60*a*, which may be aligned with a lateral front face 23 of left glass pane edge 22 of first glass pane 20 and which may form an extension of lateral front face 23 of left glass pane edge 22. The functional block front face 60*a* of first functional block 58*a* of upper first functional end cap 40*a* may form the extension of the lateral front face 23 of left glass pane edge 22 while providing a gap or a distance to lateral front face 23 of left glass pane edge 22 or it may form the extension of a lateral front face 123 of left glass pane edge 22, by being flush with the lateral front face 23 of left glass pane edge 22. The functional block front face 60*a* also, for example, aligns with the lateral front face 42*a* of upper first functional end cap 40*a*. A lower functional block face 64*a* of first functional block 58*a* of upper first functional end cap 40*a* may also form the vertical termination of glass pane receiving groove 51*a*, and extends at least substantially in parallel to upper glass pane edge 24 of first glass pane 20 as well as transversally to functional block front face 60*a* of first functional block 58*a*.

As shown in FIGS. 3 and 4, the first functional block 58*a* and also functional block front face 60*a* of first functional block 58*a* may also extend at least substantially vertically from lower functional block face 64*a* of first functional block 58*a* to an upper functional block face 62*a*, which extends at least substantially in parallel to lower functional block face 64*a* of first functional block 58*a*, of first functional block 58*a*, the lower functional block face 64*a* being flush with the upper face 44*a* of upper first functional end cap 40*a*, and may thus form an extension of lateral front face 23 of left glass pane edge 22 up to the level of the upper face 44*a* of upper first functional end cap 40*a*. A wall 59*a* of first functional block 58*a* extending transversally to functional block front face 60*a* of first functional block 58*a* and to lower functional block face 64*a* (or at least substantially in parallel to pane face 21 of first glass pane 20) in first embodiment also forms the functional end cap side face 48*a* of upper first functional end cap 40*a*, which, in closed state of glass door apparatus 1 is overlapped by first leg 172 of weather strip 170 and is abutted by first leg 172 of weather strip 170. This means that the complementary counterpiece associated with first cavity of upper first functional end cap 40*a* interacts, in an overlapping and contacting manner, with the first functional block 58*a* of upper first functional end cap 40*a*. When the first glass pane 20 is inserted into the glass pane receiving groove 51*a* of upper first functional end cap 40*a*, pane face 21 of first glass pane 20 is flush with wall 59*a* of first functional block 58*a* and forms a portion, which is at least substantially parallel to pane face 21 of first glass pane 20, of the limiting contour of the first cavity 54*a* of the upper first functional end cap 40*a*.

The upper second glass door leaf frame part 130*a* has, for instance, a upper second functional end cap 140*a* (detailed in FIGS. 6 to 8), by which the right frame body longitudinal end 134*a* of upper second frame body 132*a* is covered and which is horizontally at level with right glass pane edge 122 of second glass pane 20. The connection between upper second functional end cap 140*a* and upper second frame body 132*a* is possible, as in the case of connection between upper first functional end cap 40*a* and upper first frame body 32*a* (for instance by means of through-holes 141*a* of upper second functional end cap 140*a*).

The upper second functional end cap 140*a* also has a central glass pane receiving groove 151*a*, which, with respect to lower face 146*a* of upper second functional end cap 140*a* protrudes, protrudes inwards in a manner at least substantially parallel to right glass pane edge 122 of second glass pane 120 and at least substantially vertical in a direction towards upper face 144*a* of upper second functional end cap 140*a* and which, in the opposite direction, opens downwards and in which the second glass pane 120 is introduced, wherein for instance buffer elements (e.g., of elastic material) are disposed between the second glass pane 120 and the upper second functional end cap 140*a* in the central glass pane receiving groove 151*a*.

The complementary counterpiece associated with the first protrusion 52*a* of upper first functional end cap 40*a* of left glass door leaf 100 is formed in this case by the first functional end cap side face 148*a* of upper second functional end cap 140*a*. As shown in FIG. 2, in closed state of glass door apparatus 1, the first protrusion 52*a* of upper first functional end cap 40*a* is overlapping with first functional end cap side face 148*a* of upper second functional end cap 140*a*, to improve sealing.

The upper second functional end cap 140*a* also has a second protrusion 152*a*, which, with respect to pane face 121 of second glass pane 120, is disposed opposite to the first functional end cap side face 148*a* of the upper second functional end cap 140*a* and which, with respect to lateral front face 142*a* of upper second functional end cap 140*a*, protrudes laterally outwardly in a manner at least substantially parallel to pane face 121 of the second glass pane 120 and in a direction away from the second glass pane 120. As shown in FIG. 2, in closed state of glass door apparatus 1, the second protrusion 152*a* of upper second functional end cap 140*a* overlaps with functional end cap side face 48*a* of upper first functional end cap 40*a* and also with left glass pane edge 22 of first glass pane 20. In the first embodiment, the second protrusion 152*a* of upper second functional end cap 140*a* engages first cavity 54*a* of upper first functional end cap 40*a* and forms a further complementary counterpiece of left glass door leaf 100 associated with first cavity 54*a* of upper first functional end cap 40*a*, thereby improving the sealing.

The second protrusion 152*a* of upper second functional end cap 140*a* may extend at least substantially in a vertical direction over a part of vertical extension or at least substantially over the entire vertical extension of upper second functional end cap 140*a* between the upper face 144*a* and lower face 146*a* of upper second functional end cap 140*a*. The second protrusion 152*a* of upper second functional end cap 140*a* may also at least partially form the second functional end cap side face 150*a* of upper second functional end cap 140*a*.

The upper second functional end cap 140*a* has, for instance, a first cavity 154*a*, which, with respect to front face 142*a* of upper second functional end cap 140*a*, protrudes laterally inwardly in a manner at least substantially parallel to pane face 121 of second glass pane 120 and towards second glass pane 120 and which, in the opposite direction, opens laterally outwardly. The upper second functional end cap 140*a* also has, for example, a second cavity 156*a*, which, with respect to front face 142*a* of upper second functional end cap 140*a*, protrudes laterally inwardly in a manner at least substantially in parallel to pane face 121 of second glass pane 120 and towards second glass pane 120 and which, in the opposite direction, opens laterally outwardly and which, with respect to pane face 121 of second glass pane 120, is disposed opposite to the first cavity 154*a* of the upper second functional end cap 140*a*, so that between cavity 154*a* and second cavity 156*a* of upper second functional end cap 140*a* a second functional block 158*a* is formed. The first cavity 154*a* and the second cavity 156*a* of upper second functional end cap 140*a* have for example at least substantially a U-shaped profile section, respectively. The first cavity 154*a* of upper second functional end cap 140*a* may also extend at least substantially vertically over a portion or at least substantially over the entire vertical extension of the upper second functional end cap 140*a* between the upper face 144*a* and lower face 146*a* of upper second functional end cap 140*a*. The second cavity 156*a* of upper second functional end cap 140*a* may extend at least substantially vertically over a portion or at least substantially the entire vertical extension of the upper second functional end cap 140*a* between the upper face 144*a* and lower face 146*a* of upper second functional end cap 140*a*.

The second leg 178 of the weather strip 170 engages the first cavity 154*a* of the upper second functional end cap 140*a* and the third leg 180 of the weather strip 170 engages the second cavity 156*a* of the upper second functional end cap 140*a* so that the second leg 178 and the third leg 180 of the weather strip 170 surround, for example the pane face 121 of the second glass pane 120 and the second functional block 158*a*. As a result, the weather strip 170 may be connected, e.g. by means of a clamping of the second leg 178 and of the third leg 180 of the weather strip 170 against the pane face 121 of the second glass pane 120 and against the second functional block 158*a*, with the pane face 121 of the second glass pane 120 and with the second functional block 158*a*.

Figure 6:
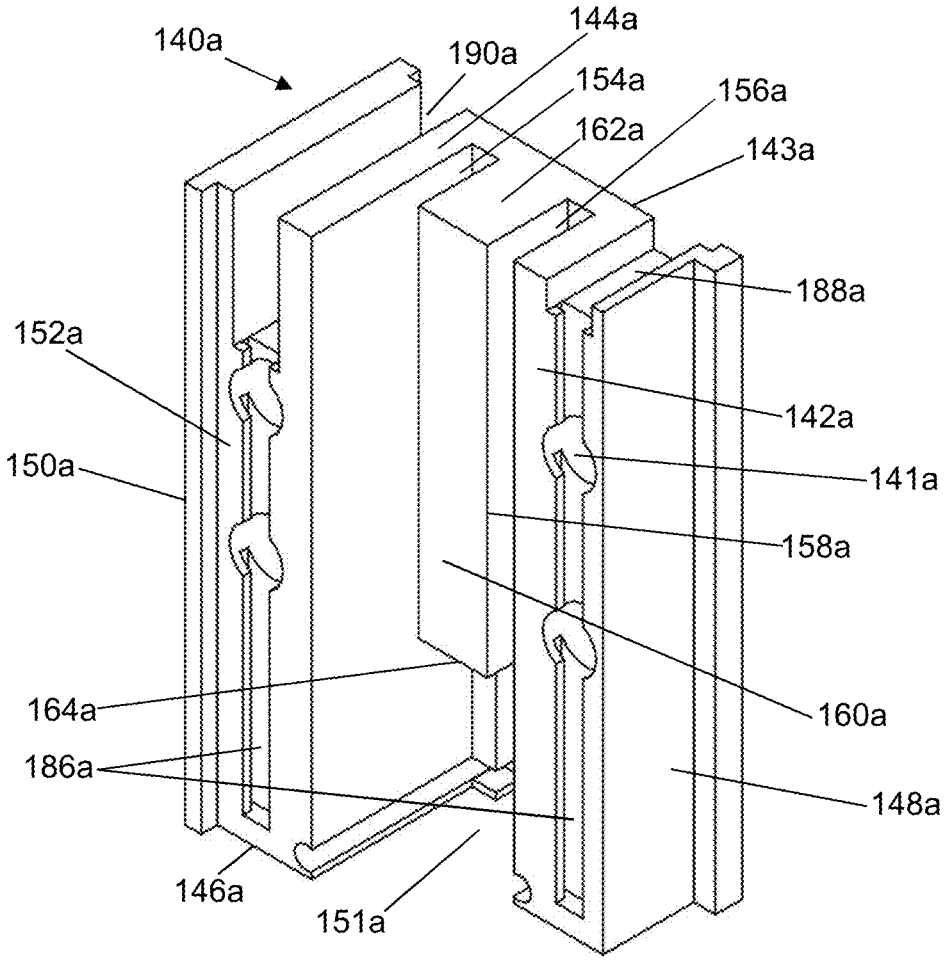
FIGS. 6 to 8 are respectively a perspective view, a front side view and a plan view of a upper second functional end cap according to the first alternative of the first example embodiment of the present invention.
Figure 7:
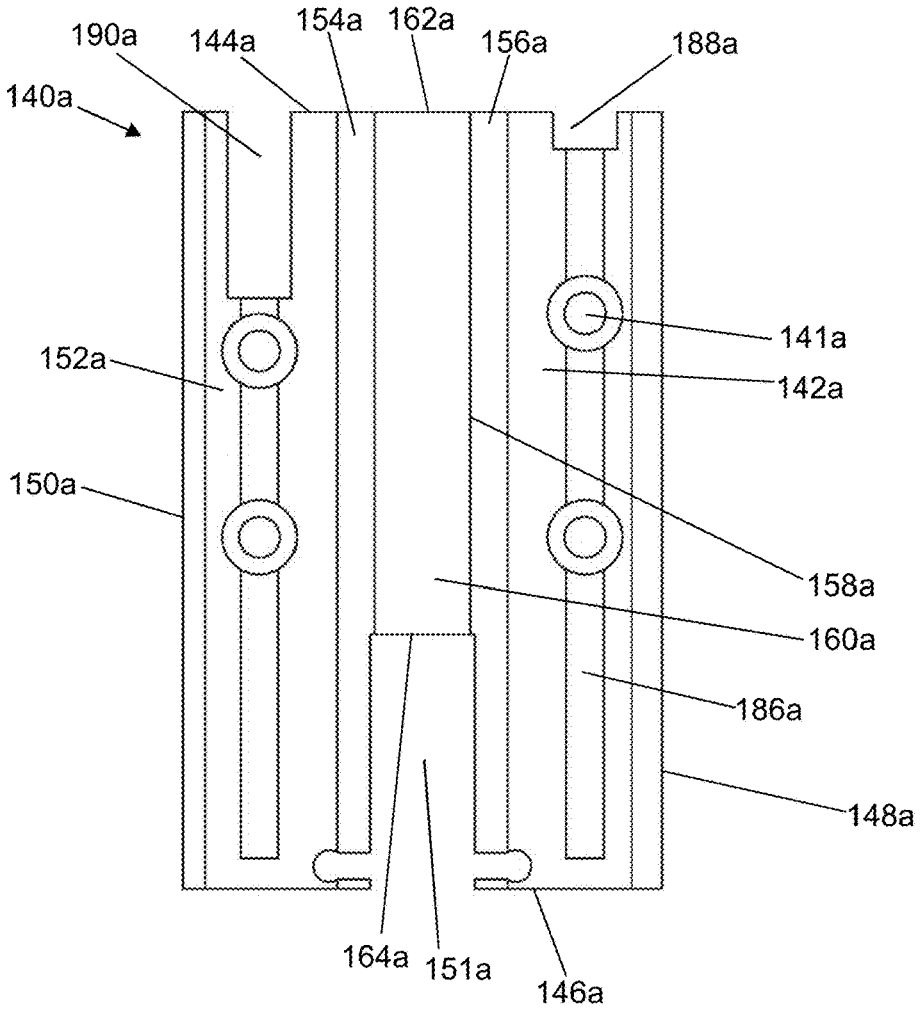
Figure 8:
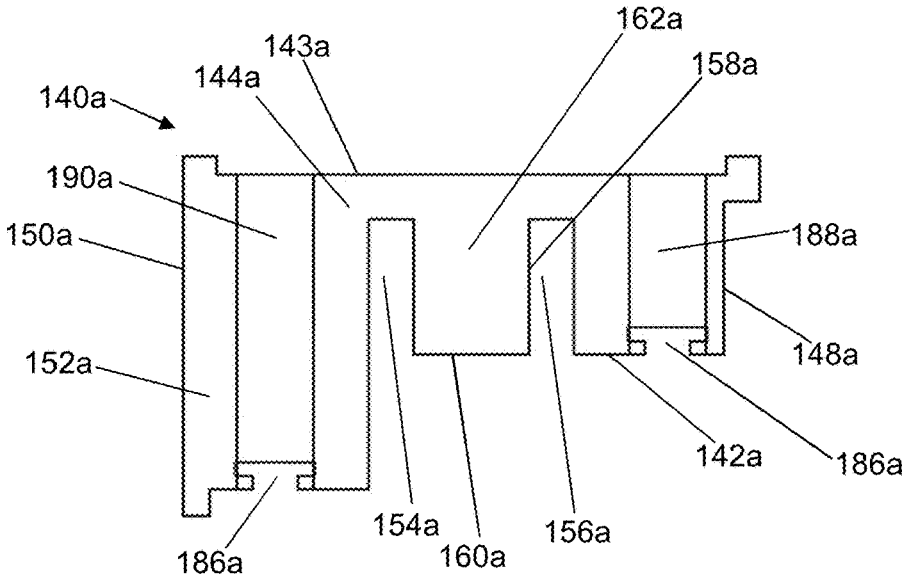

The second functional block 158*a*, for example, has a lateral, outwardly exposed functional block face 160*a* which can be aligned with a lateral front face 123 of the right glass pane edge 122 of the second glass pane 120 and which can form an extension of the lateral front face 123 of the right glass pane edge 122. The functional block front face 160*a* of the second functional block 158*a* may form the extension of the lateral front face 123 of the right glass pane edge 122, while having a gap or distance to the lateral front face 123 of the right glass pane edge 122, or may form the extension of the lateral front face 123 of the right glass pane edge 122, while being flush with the lateral front face 123 of the right glass pane edge 122. Further, the functional block face 160*a* is aligned with the lateral front face 142*a* of the upper second functional end cap 140*a*. A lower functional block face 164*a* of the second functional block 158*a* of the upper second functional end cap 140*a* can also form the vertical termination of the glass pane receiving groove 151*a* and extend at least substantially parallel to the upper glass pane edge 124 of the second glass pane 120 as well as transversely to the functional block face 160*a* of the second functional block 158*a*. As shown in FIGS. 6 to 8, the second functional block 158*a* and also the functional block face 160*a* of the second functional block 158*a* can also extend at least substantially vertically from the lower functional block face 164*a* of the second functional block 158*a* to an upper functional block face 162*a*, which is at least substantially parallel to the lower functional block face 164*a* of second functional block 158*a* and which is aligned with the upper face 144*a* of the upper second functional end cap 140*a*, of the second functional block 158*a* and may thus form an extension of the lateral front face 123 of the right glass pane edge 122 to the level of the upper face 144*a* of the upper second functional end cap 140*a*.

In the following, the second alternative of first example embodiment is described with reference to FIGS. 1 and 9 to 15.

The lower first glass leaf frame part 30*b* according to the second alternative has a lower first functional end cap 40*b* (shown in more detail in FIGS. 10 to 12), by which the left frame body longitudinal end 34*b* of the lower first frame body 32*b* is covered, and which is positioned at level of left glass pane edge 22 of the first glass pane 20. The lower first functional end cap 40*b* is connected to the lower first frame body 32*b*, e.g. by means of a screwed connection, the lower first functional end cap 40*b* has, for example, at least one through-hole 41*b* (e.g., four through-holes shown in FIGS. 10-12) for receiving a threaded pin, by which the lower first functional end cap 40*b* is connected to the lower first frame body 32*b*. However, the lower first functional end cap 40*b* may also be otherwise connected to the lower first frame body 32*a*, e.g. by means of a clamping connection or by means of a locking or latching connection (e.g., snap connection).

The lower first functional end cap 40*b* also has a central glass pane receiving groove 51*b*, which, with respect to the upper face 44*b* of the lower first functional end cap 40*b*, protrudes inwards in a manner at least substantially parallel to the left glass pane edge 22 of the first glass pane 20 as well as at least substantially vertical in a direction towards the lower face 46*b* of the lower first functional end cap 40*b* and which, in the opposite direction, opens upwards and into which the first glass pane 20 is introduced, wherein, for example, buffer elements (for example, of elastic material) are arranged between the first glass pane 20 and the lower first functional end cap 40*b* in the glass pane receiving groove 51*b*.

The lower first functional end cap 40*b* also has a first protrusion 52*b*, which, with respect to the lateral front face 42*b* of the lower first functional end cap 40*b*, protrudes laterally outwards in a manner at least substantially parallel to the pane face 21 of the first glass pane 20 and in the direction away from the first glass pane 20, wherein, in the closed state of the glass door apparatus 1, the first protrusion 52*b* of the lower first functional end cap 40*b* is overlapped with a complementary counterpiece of the left glass door leaf 100, which is associated with the first protrusion 52*b* of the lower first functional end cap 40*b*. The first protrusion 52*b* may extend at least substantially in a vertical direction over a portion of the vertical extension or at least substantially over the entire vertical extension of the lower first functional end cap 40*b* between the upper face 44*b* and the lower face 46*b* of the lower first functional end cap 40*b*. Further, the first protrusion 52*b* of the lower first functional end cap 40*b* can at least partially form the second functional end cap side face 50*b* of the lower first functional end cap 40*b*. Further, the first functional end cap side face 48*b* of the lower first functional end cap 40*b* is disposed opposite to the first protrusion 52*b* of the lower first functional cap 40*b* with respect to the pane face 21 of the first glass pane 20.

Furthermore, the lower first functional end cap 40*b* has a first cavity 54*b*, which, with respect to the lateral front face 42*b* of the lower first functional end cap 40*b*, protrudes laterally inwards in a manner at least substantially parallel to the pane face 21 of the first glass pane 20 as well as in the direction towards the first glass pane 20 and which, in the opposite direction, opens laterally outwards. In the first embodiment, the first cavity 54*b* of the lower first functional end cap 40*b* also opens outwardly in a direction transversely to the pane face 21 of the first glass pane 20 and away from the pane face 21 of the first glass pane 20, wherein a limiting contour which delimits the first cavity 54*b* of the lower first functional end cap 40*b* of the lower first functional end cap 40*b* has an at least substantially L-shaped profile cross-section. The first cavity 54*b* of the lower first functional end cap 40*b* can extend at least substantially in a vertical direction over a part of the vertical extension or at least substantially over the entire vertical extension of the lower first functional end cap 40*b* between the upper face 44*b* and the lower face 46*b* of lower first functional end cap 40*b*. In the closed state of the glass door apparatus, the first cavity 54*b* of the lower first functional end cap 40*b* is overlapped with a complementary counterpiece of the left glass door leaf 100 which is associated with the first cavity 54*b* of the lower first functional end cap 40*b*. In the first example embodiment, the complementary counterpiece of the left glass door leaf 100, which is associated with the first cavity 54*b* of the lower first functional end cap 40*b*, is formed by the first leg 172 of the weather strip 170. As shown in FIG. 9, the first leg 172 overlaps the left glass pane edge 22 of the first glass pane 20 in the closed state of the glass door apparatus 1 and engages with the first complementary cavity 54*b* of the lower first functional end cap 40*b*, having the corresponding complementary counterpiece of the left glass door leaf 100, wherein the first leg 172 overlaps and abuts a first wall, which defines the first cavity 54*b* of the lower first functional end cap 40*b* and which, in the first embodiment, is formed by the functional end cap side face 48*b* of the upper first functional end cap 40*b*, thereby improving the sealing. The first leg 172 of the weather strip 170, for example, extends at least substantially vertically (for example, downwards) beyond the lower glass pane edge 26 of the first glass pane 20, and optionally extends at least substantially up to the lower face 46*b* of the lower first functional end cap 40*b*.

Moreover, the lower first functional end cap 40*b* has a second cavity 56*b*, which, with respect to the lateral front face 42*b* of the lower first functional end cap 40*b*, protrudes laterally inward in a manner at least substantially parallel to the pane face 21 of the first glass pane 20 as well as in the direction towards the first glass pane 20 and which, with respect to the pane face 21 of the first glass pane 20, is disposed opposite to the first cavity 54*b* of the lower first functional end cap 40*b* so that a first functional block 58*b* is formed between the first cavity 54*b* and the second cavity 56*b* of the lower first functional end cap 40*b*. The second cavity 56*b* of the lower first functional end cap 40*b* has, for example, an at least substantially U-shaped profile cross-section. The second cavity 56*b* of the lower first functional end cap 40*b* may extend at least substantially in a vertical direction over a portion of the vertical extension or at least substantially over the entire vertical extension of the lower first functional end cap 40*b* between the upper face 44*b* and the lower face 46*b* of the lower first functional end cap 40*b*.

Figure 10:
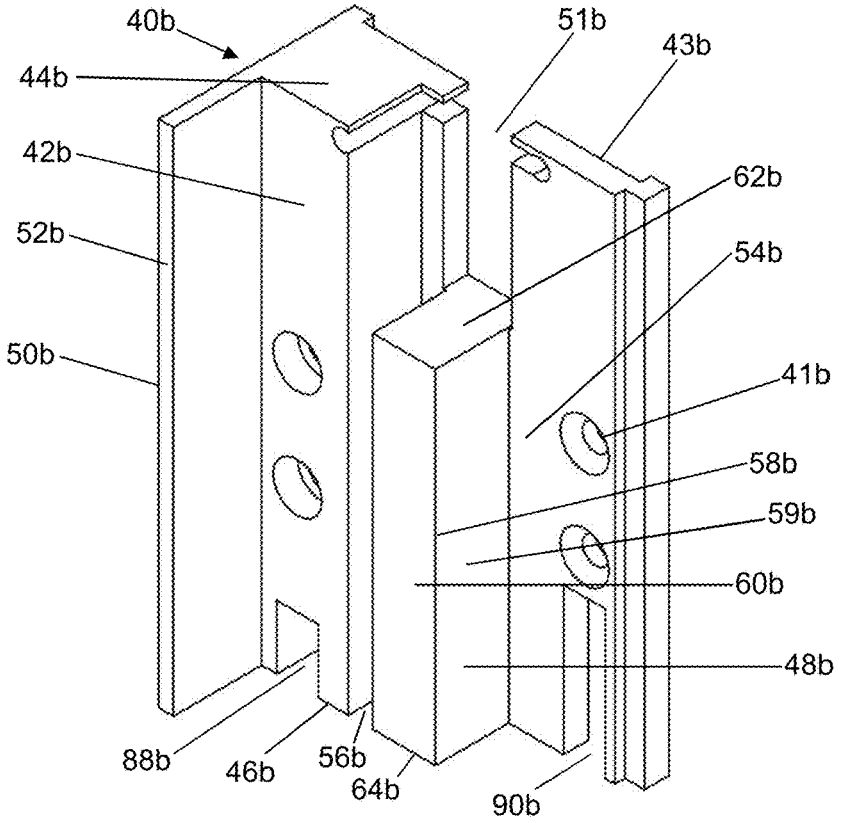
FIGS. 10 to 12 are respectively a perspective view, a front side view and a plan view of a lower first functional end cap according to the second alternative of the first example embodiment of the present invention.
Figure 11:
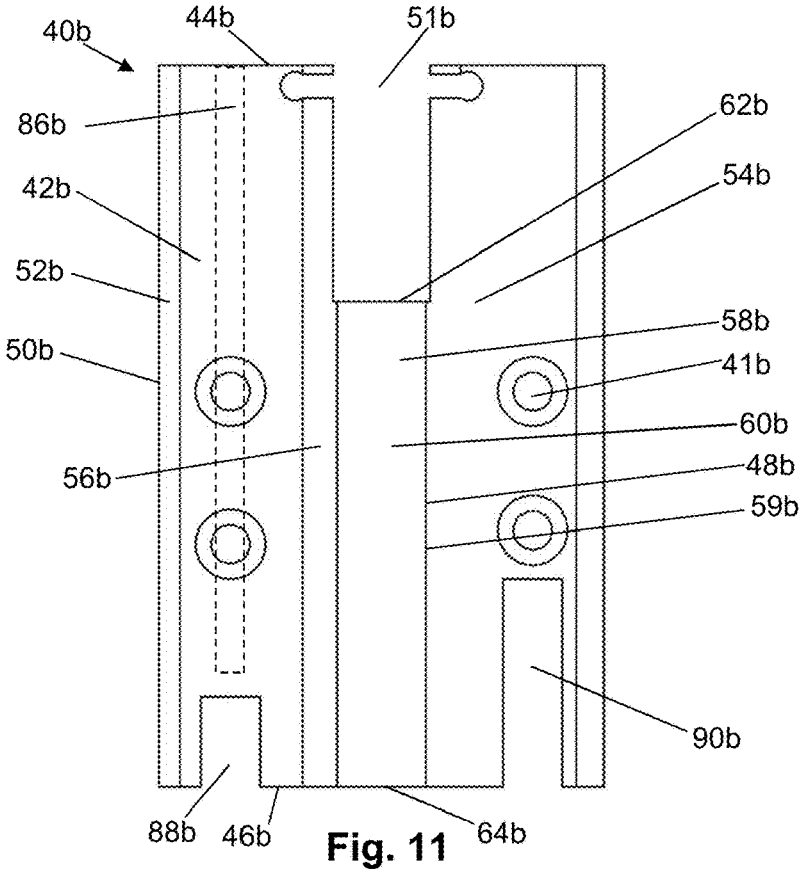

The first functional block 58*b* has, for example, a lateral outwardly exposed functional block front face 60*b* which can be aligned with a lateral front face 23 of the left glass pane edge 22 of the first glass pane and which can form an extension of the lateral front face 23 of the left glass pane edge 22. The functional block front face 60*b* of the first functional block 58*b* may form the extension of the lateral front face 23 of the left glass pane edge 22, while having a gap or a distance from the lateral front face 23 of the left glass pane edge 22, or may form the extension of the lateral front face 23 of the left glass pane edge 22, while being flush with the lateral front face 23 of the left glass pane edge 22. Further, the functional block front face 260*b* is aligned with the lateral front face 242*b* of the lower first functional end cap 240*b*. An upper functional block face 62*b* of the first functional block 58*b* of the lower first functional end cap 40*b* can also form the vertical termination of the glass pane receiving groove 51*b*, and extend at least substantially parallel to the lower glass pane edge 24 of the first glass pane 20 as well as transversely to the functional block front face 60*b* of the first functional block 58*b*. As shown in FIGS. 10 and 11, the first functional block 58*b* and also the functional block front face 60*b* of the first functional block 58*b* can also extend at least substantially vertically from the upper functional block face 62*b* up to a lower functional block face 64*b* of the first functional block 58*b*, which lower functional block face 64*b* is at least substantially parallel to the upper functional block face 62*b* of first functional block 62*b* and is aligned with the lower face 46*b* of the lower first functional end cap 40*b*, and may thus form an extension of the lateral front face 23 of the left glass pane edge 22 to the level of the lower face 46*b* of lower first functional end cap 40*b*.

A wall 59*b* extending transversally to the functional block front face 60*b* of first functional block 58*b* and transversally to lower functional block face 64*a* (at least substantially parallel to pane face 21 of first glass pane 20) of first functional block 58*b* forms in the first embodiment also the functional end cap side face 48*b* of lower first functional end cap 40*b*, which in the closed state of glass door apparatus 1 is overlapped by first leg 172 of weather strip 170 and against which the first leg of weather strip 170 abuts. This means that the complementary counterpiece associated with the first cavity of lower first functional end cap 40*b* interacts with the first functional block 58*b* of lower first functional end cap 40*b* in overlapping and abutting fashion. When the first glass pane 20 is inserted into the glass pane receiving groove 51*b* of lower first functional end cap 40*b*, the pane face 21 of first glass pane 20 aligns with wall 59*b* of first functional block 58*b* and forms a portion, which is at least substantially parallel to pane face 21 of first glass pane 20, of the limiting contour of first cavity 54*b* of lower first functional end cap 40*b*.

Further, the lower second glass door leaf frame portion 130*b* has a lower second functional end cap 140*b* (shown in more detail in FIGS. 13 to 15) by which the right frame body longitudinal end portion 134*b* of the lower second frame body 132*b* is covered and which is horizontally aligned with the right glass pane edge portion 122 of second glass pane 20. The connection between the lower second functional end cap 140*b* and the lower second frame body 132*b* is analogous to the connection between the lower first functional end cap 40*b* and the lower first frame body 32*b* (for example, by means of the through holes 141*b* of the lower second functional end cap 140*b*).

The lower second functional end cap 140*b* also has a central glass pane receiving groove 151*b*, which protrudes, with respect to the upper face 144*b* of the lower second functional end cap 140*b*, inwards in a manner at least substantially parallel to the right glass pane edge 122 of the second glass pane 120 and at least substantially vertical in the direction toward the lower face 146*b* of the lower second functional end cap 140*b* and which, in the opposite direction, opens upwards and into which the second glass pane 120 is introduced, wherein, for example buffer elements (of an elastic material, for example) are arranged between the second glass pane 120 and the lower second functional end cap 140*b* in the glass pane receiving groove 151*b*.

The complementary counterpiece of the left glass door leaf 100 associated with the first projection 52*b* of the lower first functional end cap 40*b* is formed in this case by the first functional end cap side face 148*b* of the lower second functional end cap 140*b*. As shown in FIG. 9, in the closed state of the glass door apparatus 1, the first protrusion 52*b* of the lower first functional end cap 40*b* is overlapped with the functional end cap side face 148*b* of the lower second functional end cap 140*b*, whereby the sealing can be improved.

The lower second functional end cap 140*b* also has a second protrusion 152*b* which, with respect to the pane face 121 of the second glass pane 120, is disposed opposite the first functional end cap side face 148*b* of the lower second functional end cap 140*b* and which, with respect to the lateral front face 142*b* of the lower second functional end cap 140*b*, protrudes laterally outwards in a manner at least substantially parallel to the pane face 121 of the second glass pane 120 and in the direction away from the second glass pane 120. As shown in FIG. 9, in the closed state of the glass door apparatus 1, the second protrusion 152*b* of the lower second functional end cap 140*b* is overlapped with the first functional end cap side face 48*b* of the lower first functional cap 40*b* and also with the left glass leaf edge 22 of the first glass pane 20. In the first embodiment, the second protrusion 152*b* of the lower second functional end cap 140*b* engages the first cavity 54*b* of the lower first functional end cap 40*b* and forms a complementary counterpiece of the left glass door leaf 100 associated with the first cavity 54*b* of the lower first functional end cap 40*b*, whereby sealing can be further improved. Although it is shown in FIG. 9 that both the first leg 172 of the weather strip 170 and the second protrusion 152*b* of the lower second functional end cap 140*b* engage the first cavity 54*b* of the lower first functional end cap 40*b*, it is also possible that, in the first example embodiment, the weather strip 170 is absent, and that the complementary counterpiece of the left glass door leaf 100, which is associated with the first cavity 54*b* of the lower first functional end cap 40*b*, is formed only by the second protrusion 152*b* which engages the first cavity 54*b* of the lower first functional end cap 40*b*.

The second protrusion 152*b* of the lower second functional end cap 140*b* may extend, at least substantially, in a vertical direction along a portion of the vertical extension or at least substantially over the entire vertical extension of the lower second functional end cap 140*b* between the upper face 144*b* and the lower face 146*b* of the lower second end cap 140*b*. Furthermore, the second protrusion 152*b* of the lower second functional end cap 140*b* can at least partially form the second functional end cap side face 150*b* of the lower second functional end cap 140*b*.

The lower second functional end cap 140*b* comprises, for example a first cavity 154*b*, which, with respect to the lateral front face 142*b* of the lower second functional end cap 140*b*, protrudes laterally inwards in a manner at least substantially parallel to the pane face 121 of the second glass pane 122 as well as in the direction of the second glass pane 122 and which, in the opposite direction, opens laterally outwards. Further, the lower second functional end cap 140*b* includes, for example, a second cavity 156*b*, which, with respect to the lateral front face 142*b* of the lower second functional end cap 140*b*, protrudes laterally inwards in a manner at least substantially parallel to the pane face 121 of the second glass pane 122 as well as in the direction of the second glass pane 122 and which, in the opposite direction, opens laterally outwards and which, with respect to the pane face 121 of the second glass pane 122, is disposed opposite to the first cavity 154*b* of the lower second functional end cap 140*b* so that a second functional block 158*b* is formed between the first cavity 154*b* and the second cavity 156*b* of the lower second functional end cap 140*b*. The first cavity 154*b* and the second cavity 156*b* of the lower second functional end cap 140*b* include, for example, an at least a substantially U-shaped profile cross-section. The first cavity 154*b* of the lower second functional end cap 140*b* may extend in at least substantially vertical direction over a portion of the vertical extension or at least substantially over the entire vertical extension of the lower second functional end cap 140*b* between the upper face 144*b* and the lower face 146*b* of the lower second functional end cap 140*b*. The second cavity 156*b* of the lower second functional end cap 140*b* may extend at least substantially in vertical direction over a portion of the vertical extension or at least substantially over the entire vertical extension of the lower second functional end cap 140*b* between the upper face 144*b* and the lower face 146*b* of the lower second functional end cap 140*b*.

The second leg 178 of the weather strip 170 engages the first cavity 154*b* of the lower second functional end cap 140*b* and the third leg 180 of the weather strip 170 engages the second cavity 156*b* of the lower second functional end cap 140*b* so that the second leg 178 and the third leg 180 of the weather strip 170 surround (e.g., engage in a gripping manner) the pane face 121 of the second glass pane 120 and the second functional block 158*b*. As a result, the weather strip 170, may for example be connected to the pane face 121 of the second glass pane 120 and to the second functional block 158*b* by means of clamping of the second limb 178 and of the third limb 180 of the sealing cable 170 against the pane face 121 of the second glass pane 120 and against the second functional block 158*b*.

Figure 13:
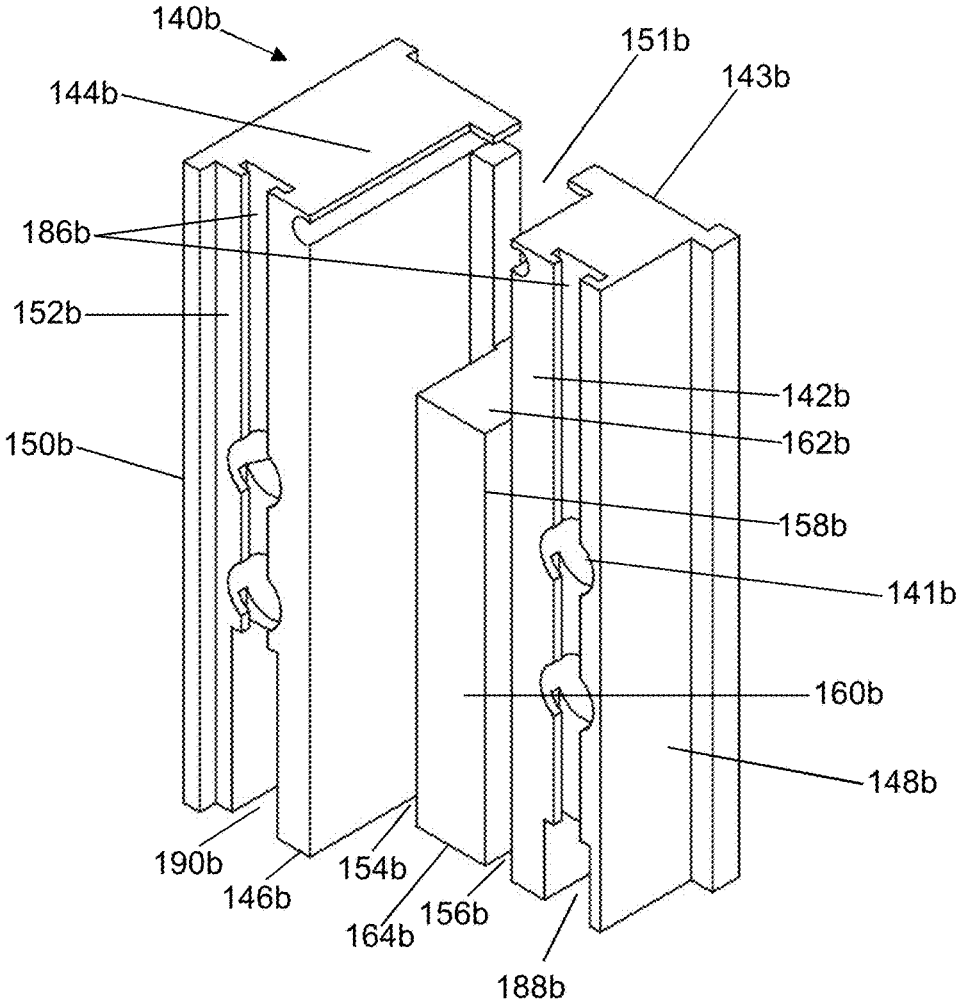
FIGS. 13 to 15 are respectively a perspective view, a front side view and a plan view of a lower second functional end cap according to the second alternative of the first example embodiment of the present invention.
Figure 14:
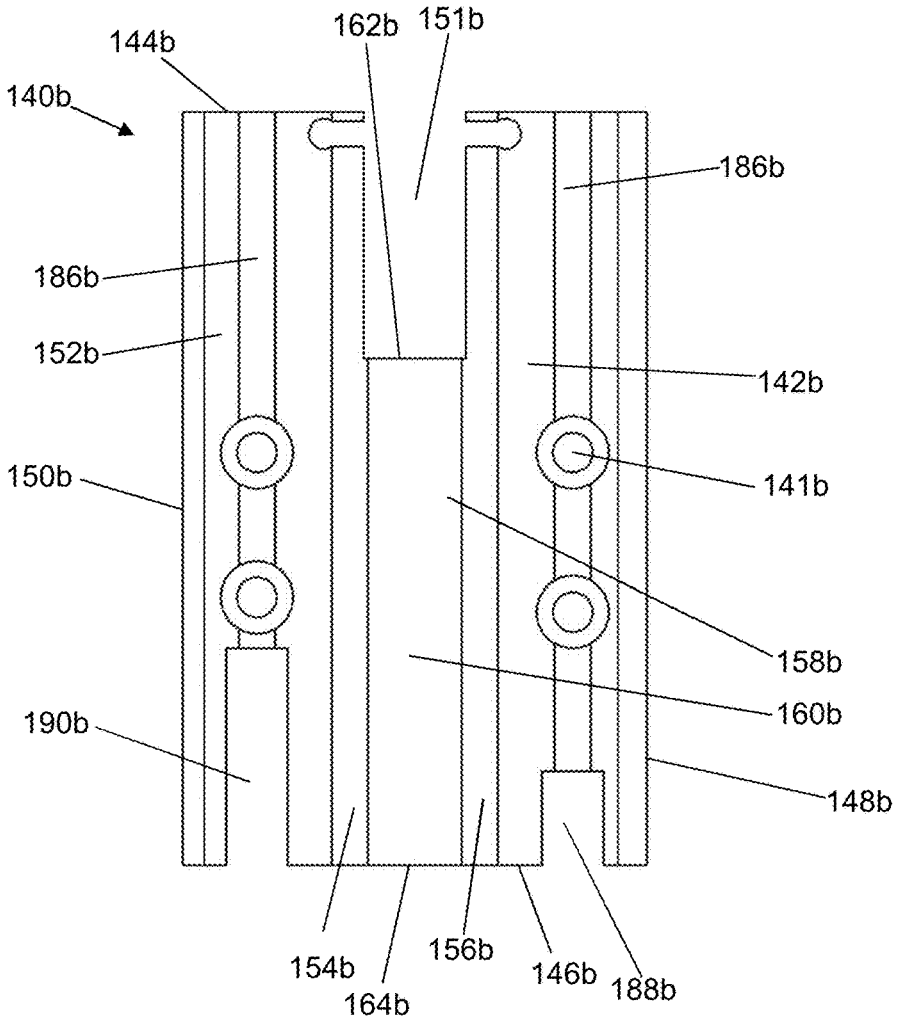
Figure 15:
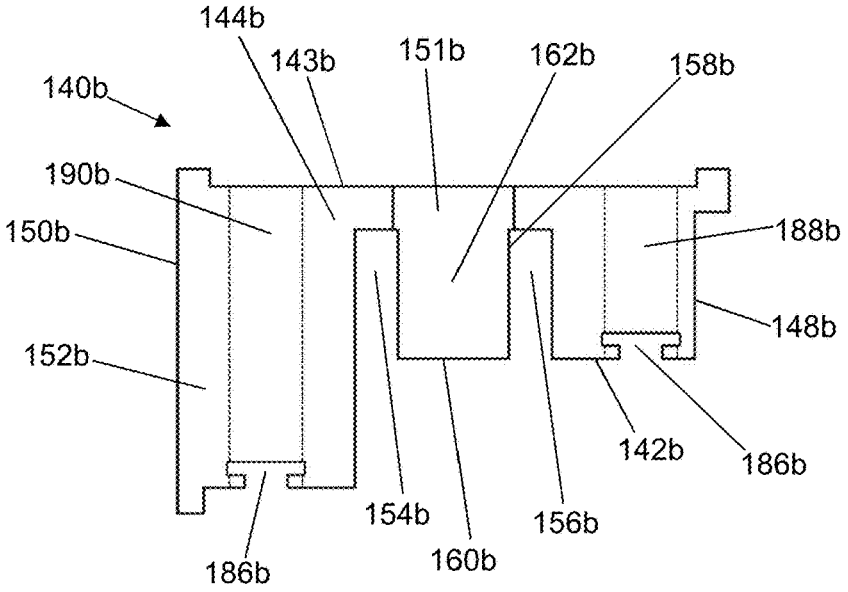

The second functional block 158*b* has, for example, a lateral, outwardly exposed functional block face 160*b* which is aligned with a lateral front face 123 of the right glass pane edge 122 of the second glass pane 120 and which can form an extension of the lateral front face 123 of the right glass pane edge 122. The functional block face 160*b* of the second functional block 158*b* may form the extension of the lateral front face 123 of the right glass pane edge 122, while having a gap with respect to the lateral front face 123 of the right glass pane edge 122, or may form the extension of the lateral front face 123 of the right glass pane edge 122, while being flush with the lateral front face 123 of the right glass pane edge 122. Further, the functional block face 160*b* is aligned with the lateral front face 142*b* of the lower second functional end cap 40*b*. An upper functional block face 162*b* of the second functional block 158*b* of the lower second functional end cap 140*b* can also form the vertical termination of the glass pane receiving groove 151*b* and extend at least substantially parallel to the lower glass pane edge 126 of the second glass pane 120 as well as transversely to the functional block face 160*b* of the second functional block 158*b*. In FIGS. 13 and 14, the second functional block 158*b* and also the functional block face 160*b* of the second functional block 58*b* can extend at least substantially vertically from the upper functional block face 162*b* of the second functional block 162*b* to a lower functional block face 164*b* of second functional block 58*b*, which lower functional block face 164*b* extends at least substantially parallel to the upper functional block face 162*b* of the second functional block 158*b* and is aligned with the lower face 146*b* of the lower second functional end cap 140*b*, and may thus form an extension of the lateral front face 123 of the right glass pane edge 122 to the level of the lower face 146*b* of the lower second functional end cap 140*b*.

The first embodiment described above is suitable for example for use on a rotating or tilting glass door leaf, since one (for example a single) leg of the weather strip engages in only one (for example the only) cavity of the respective first functional cap and since, due to the opening of the first cavity in a direction transversely with respect to the pane face of the first glass pane, the second protrusion of the respective second functional end cap can engage the first cavity during a pivoting movement of the right glass door leaf into the first cavity in a direction which is at least substantially transversal to the pane face of the first glass pane. By means of above said first embodiment of the present invention, sound/noise, moisture, and wind can be effectively prevented from penetrating through the glass door apparatus 1. Thus, the noise protection, moisture protection and wind protection properties of the glass device can be improved.

Next, a second embodiment of the present invention will be described with reference to FIGS. 16 to 23.

FIGS. 16 to 23 illustrate a glass door apparatus 1 according to a second example embodiment of the present invention.

The glass door apparatus 1 according to the second example embodiment generally has a right glass door leaf 10 and a left glass door leaf 100.

The right glass door 10 has the first glass pane 20, the upper first glass door leaf frame part 30*a*, and the lower first glass door leaf part 30*b* which are at least substantially the same as those of the first embodiment, and a detailed description thereof will be omitted.

Figure 17:
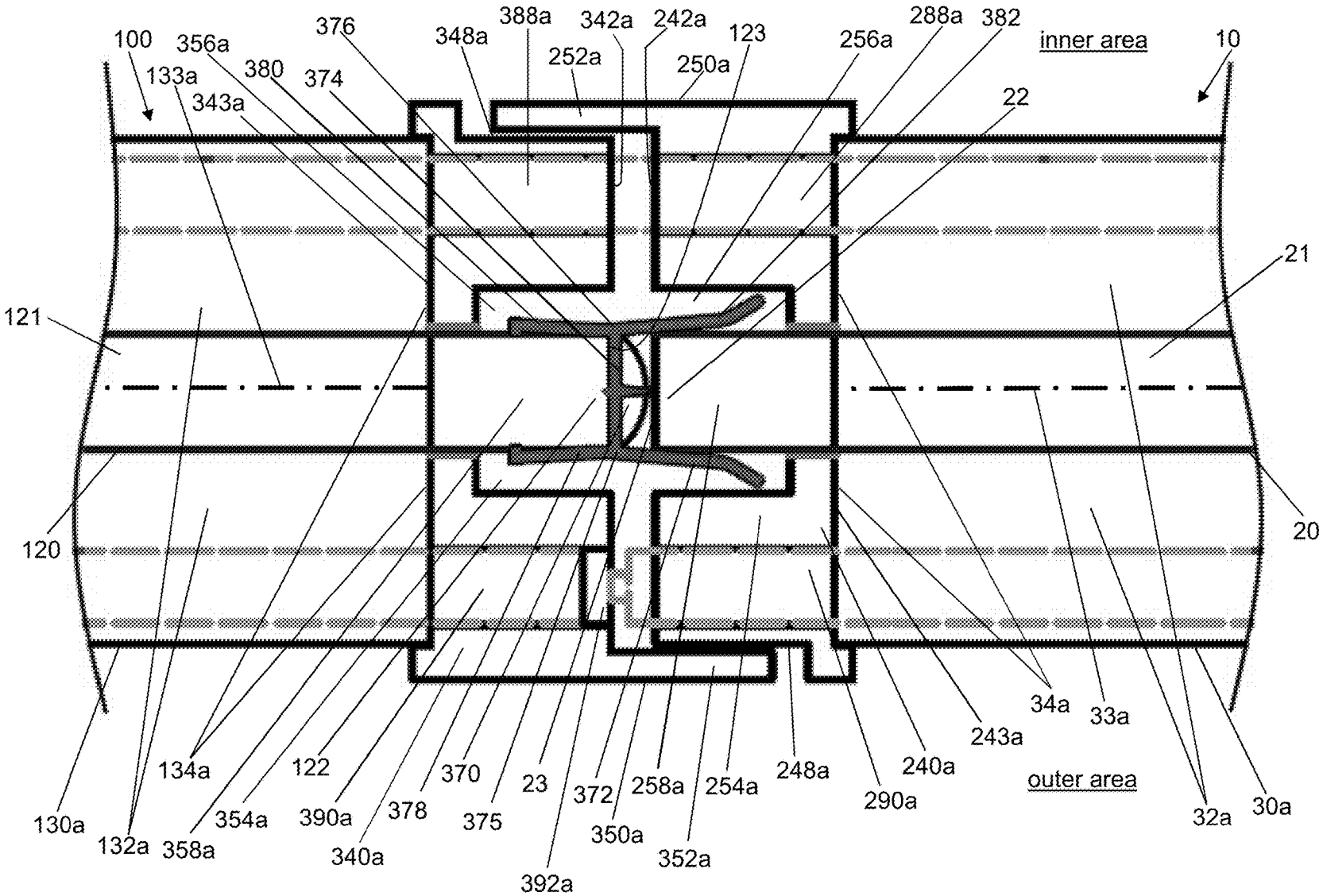
FIG. 17 is a plan view of a glass door apparatus according to a first alternative of the second example embodiment of the present invention in a closed state of the glass door apparatus.
Figure 24:
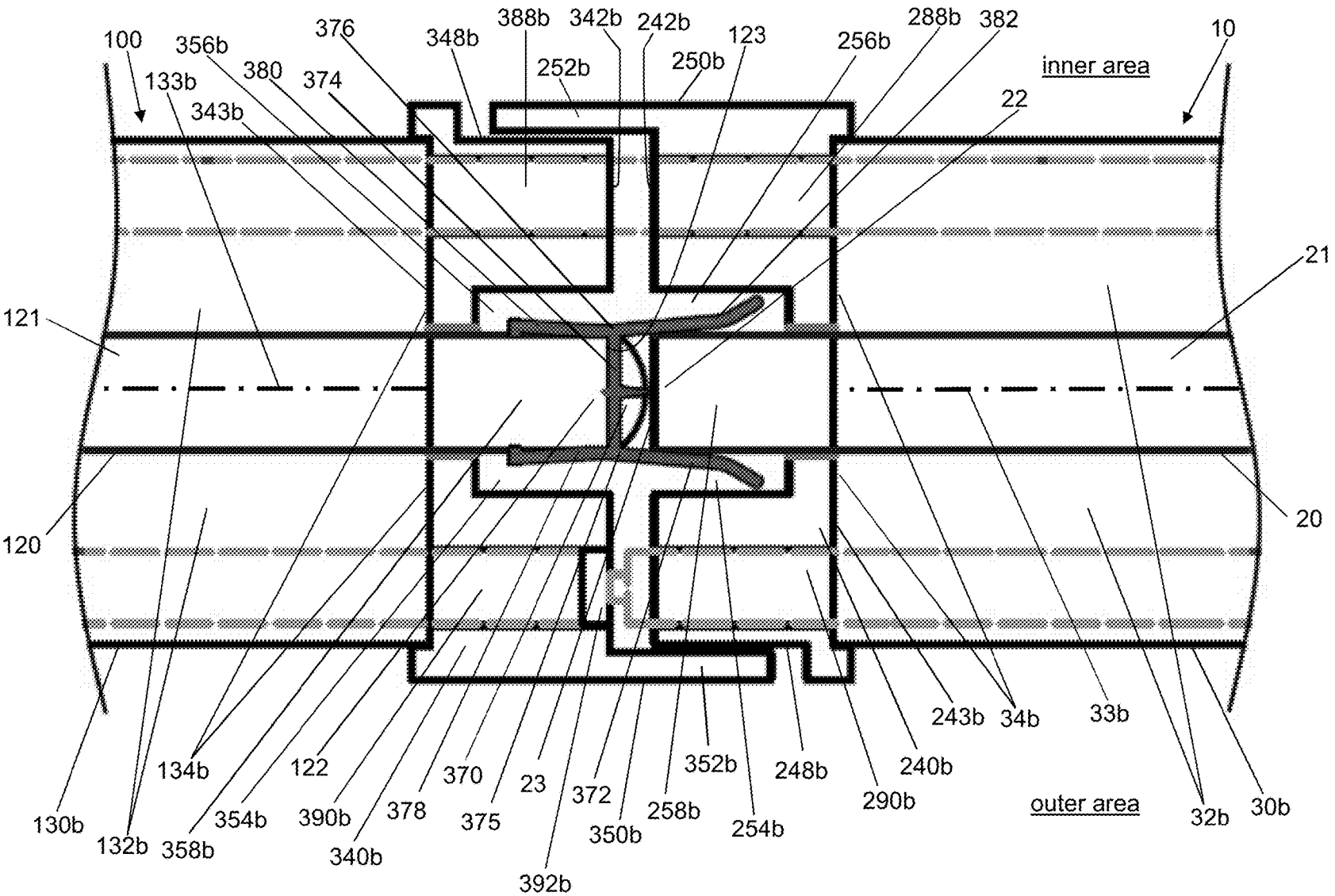
FIG. 24 is a plan view of a glass door apparatus according to a second alternative of the second example embodiment of the present invention in a closed state of the glass door apparatus.

As shown in FIGS. 17 and 24 in a cross-section, the elongated weather strip 370, which defines a weather strip longitudinal axis and which is attached to the right glass pane edge 122 of the second glass pane 120 and extends with its longitudinal axis of the weather strip along the right glass pane edge 122 of the second glass pane 320. The weather strip 370 is for example made of a substantially transparent and UV-resistant plastic material, such as polyethylene terephthalate glycol or also called glycol-modified polyethylene terephthalate (short PETG or PET-G).

In the second embodiment of the present invention, the weather strip 370 has an H-shaped cross-section profile with, for example, a central transverse web 374 having a first transverse web end 375 and a second transverse web end 376, a first leg 372 extending from the right glass pane edge 122 of the second glass pane 120 (in particular from the first transverse web end 375), at least substantially parallel to the pane face 121 of the second glass pane 120, and laterally away from the second glass pane 120, a second leg 378 which extends from the first transverse web end 375 in a direction opposite to the first leg 372 and overlaps the right glass pane edge 122 of second glass pane 120, a third leg 380 which extends from the second transverse web end 376 in the same direction as the second leg 378 and overlaps the right glass pane edge 122 of the second glass pane 120, and a fourth leg 382, which extends from the second transverse web end 376 in a direction opposite the third leg 380. The second leg 378 and the third leg 380 at least partially surround the pane face 121 of the second glass pane 120, the weather strip 370 being supported by the second leg 378 and the third leg 180, for example, being provided by means of clamping to the second glass pane 120.

The weather strip 370 extends for example at least substantially over most of the longitudinal extension or over the entire longitudinal extension of the right glass pane edge 122 of the second glass pane 120 and/or of the left glass pane edge 22 of the second glass pane 20. Furthermore, the weather strip 370 can extend beyond the upper glass pane edge and/or respective glass pane. In the closed state of glass door apparatus 1, the first leg 372 overlaps the left glass pane edge 22 of the first glass pane 20 and the first leg 372 abuts the pane face 21 of the first glass pane 20 and the fourth leg 382 overlaps the left glass pane edge 22 of the first glass pane 20 and the fourth leg 382 abuts, opposite the first leg 372 with respect to the pane face 21 of the first glass pane 20, against the pane face 21 of the first glass pane 20 so that the weather strip 170 at least substantially seals a gap between the left glass pane edge 22 of the first glass pane 20 and the right glass pane edge 122 of the second glass pane 120. The aforementioned legs can be elastic so that the first leg 372 and the fourth leg 382 are biased against the pane face 21 of the first glass pane 20 and/or so that the second leg 378 and the third leg 380 are biased against the pane face 321 of the second glass pane 320.

In the following, a first and second alternative of the second example embodiment are described. In a glass door apparatus according to the present invention, either the first or the second alternative of the second embodiment can be provided. However, both alternatives of the second embodiment can also be provided simultaneously (i.e., in combination) in a glass door apparatus according to the present invention.

The first alternative of the second example embodiment will be described with reference to FIGS. 16 to 23.

Figure 16:
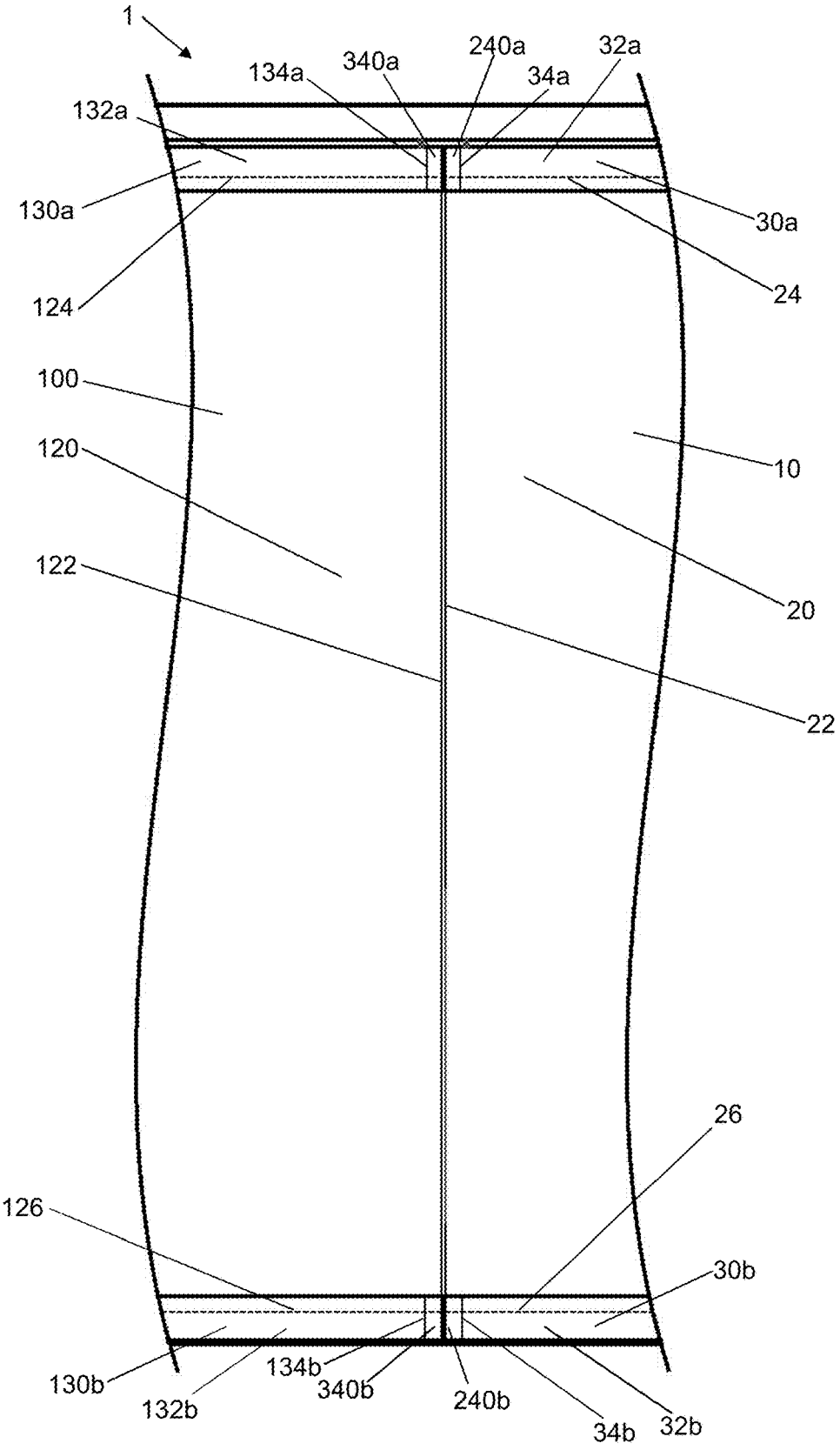
FIG. 16 is a view from an outer area of a glass door apparatus according to a second example embodiment of the present invention in a closed state of the glass door apparatus.
Figure 18:
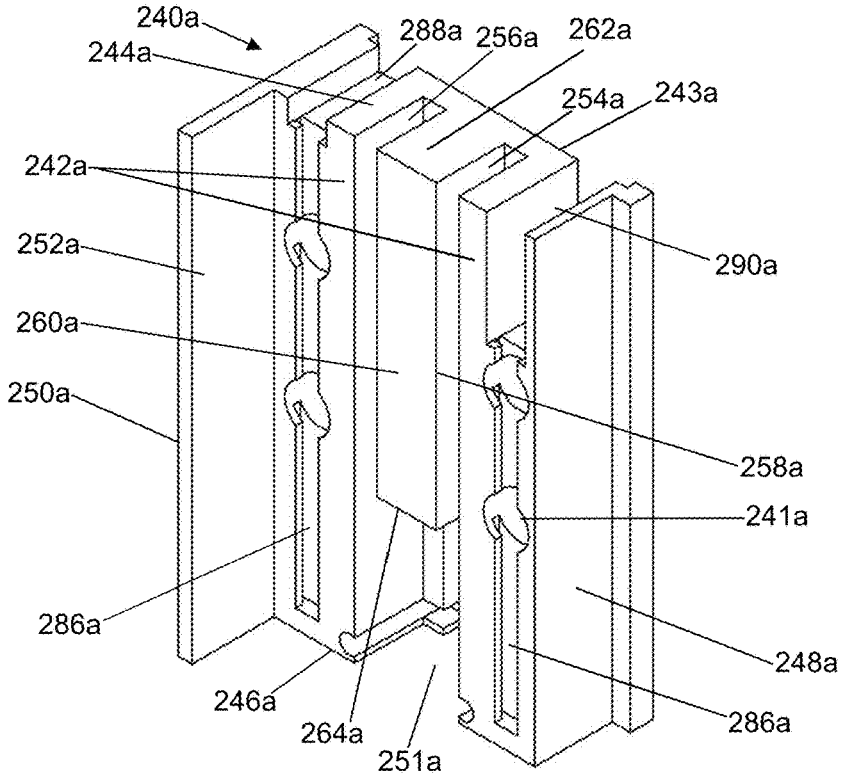
FIGS. 18 to 20 are respectively a perspective view, a front side view and a plan view of a upper first functional end cap according to the first alternative of the second example embodiment of the present invention.
Figure 19:
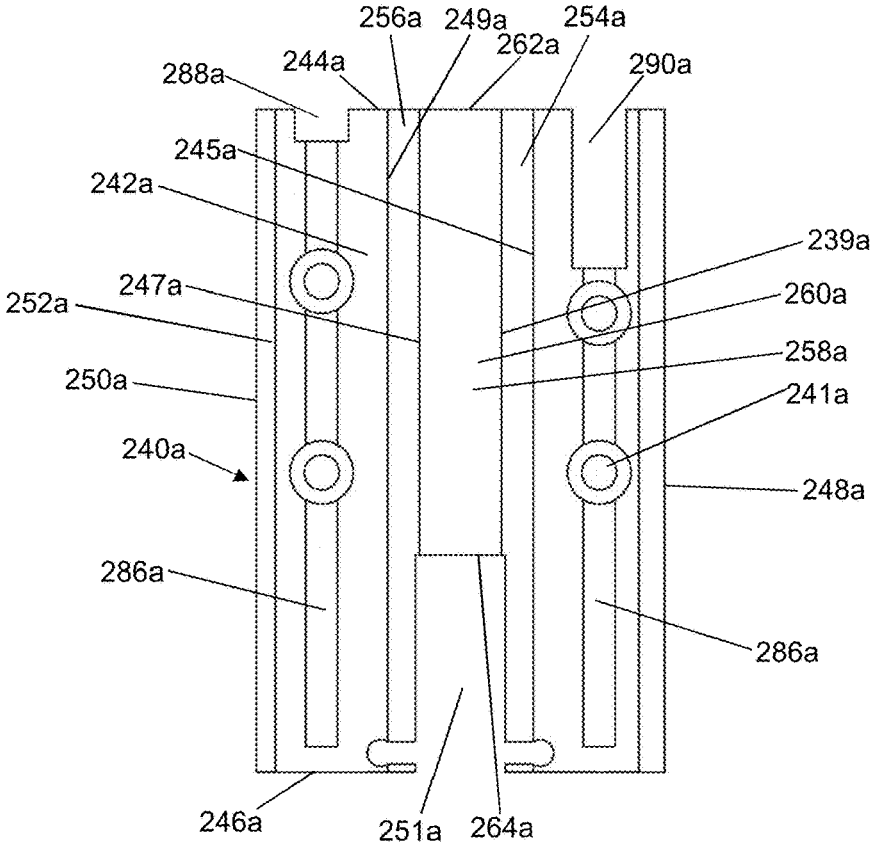
Figure 20:
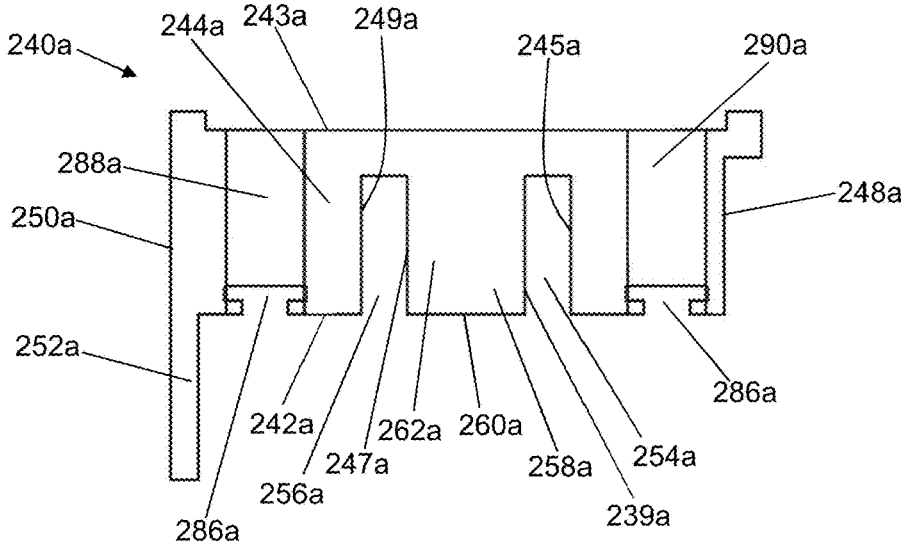

As shown in FIGS. 16 and 17, the upper first glass leaf frame part 30*a* according to the first alternative of the second example embodiment has a upper first functional end cap 240*a* (shown in more detail in FIGS. 18 to 20) by which the left frame body longitudinal end 34*a* of the upper first frame body 32*a* is covered and which is arranged horizontally at the level of the left glass pane edge 22 of the first glass pane 20. The upper first functional end cap 240*a* is connected to the upper first frame body 32*a*, for example by means of a screwed connection, the upper first functional end cap 240*a* being, for example, at least one through hole 241*a* (as an example, four through-holes are shown in FIGS. 18 to 20) for receiving a threaded pin by which the upper first functional end cap 240*a* is connected to the upper first frame body 32*a*. However, the upper first functional end cap 240*a* may also be otherwise connected to the upper first frame body 32*a*, for example by means of a clamping connection or a locking or latching connection (e.g., snap connection).

The upper first functional end cap 240*a* also has a central glass pane receiving groove 251*a*, which protrudes, with respect to the lower face 246*a* of the upper first functional end cap 240*a*, inwards in a manner at least substantially parallel to the left glass pane edge 22 of the first glass pane 20 and at least substantially vertical in a direction toward the upper face 244*a* of the upper first functional end cap 240*a* and which, in the opposite direction, opens downwards and into which the first glass pane 20 is introduced, wherein, for example, buffer elements (of an elastic material, for example) are arranged between the first glass pane 20 and the upper first functional end cap 240*a* in the glass pane receiving groove 251*a*.

The upper first functional end cap 240*a* also has a first protrusion 252*a*, which, with respect to the lateral front face 242*a* of the upper first functional end cap 240*a*, protrudes laterally outwardly in a manner at least substantially parallel to the pane face 21 of the first glass pane 20 and in the direction away from the first glass pane 20, wherein, in the closed state of the glass door apparatus 1, the first protrusion 252*a* of the upper first functional end cap 240*a* is overlapped with a complementary counterpiece of the left glass door leaf 100 associated with the first protrusion 252*a* of the upper first functional end cap 240*a*. The first protrusion 252*a* may extend at least substantially in a vertical direction over a portion of the vertical extension or at least substantially over the entire vertical extension of the upper first functional end cap 240*a* between the upper face 244*a* and the lower face 246*a* of the upper first functional end cap 40*a*. Further, the first protrusion 252*a* of the upper first functional end cap 240*a* can at least partially form the second functional end cap side face 250*a* of the upper first functional end cap 240*a*. Further, the first functional end cap side face 248*a* of the upper first functional end cap 240*a* is disposed opposite to the first protrusion 252*a* of the upper first functional cap 240*a* with respect to the pane face 21 of the first glass pane 20.

Furthermore, the upper first functional end cap 240*a* has a first cavity 254*a*, which, with respect to the lateral front face 242*a* of the upper first functional end cap 240*a*, protrudes laterally inwards in a manner at least substantially parallel to the pane face 21 of the first glass pane 20 and in the direction toward the first glass pane 20 and which, in the opposite direction, opens laterally outwardly. In the first alternative of the second embodiment, the first cavity 254*a* is arranged in the direction of the pane face 21 of the first glass pane 20 at a distance from the first functional end cap side face 248*a*. The first cavity 254*a* of the upper first functional end cap 240*a* comprises for example an at least substantially U-shaped cross-section. The first cavity 254*a* is at least partially limited by a first inner wall 239*a*, which extends at least substantially parallel to the pane face 21 of the first glass pane 20, preferably also in alignment with the first pane face 21 of the first glass pane 20, as well as in the direction towards the the first glass pane 20, and by a second inner wall 245*a* of the upper first functional end cap 240*a*, said second inner wall 245*a* being disposed at a distance from the first inner wall 239*a* of the upper first functional end cap 240*a* in the direction transverse to the pane face 21 of the first glass pane 20 and opposite to the first inner wall 239*a* and extending at least substantially parallel to the pane face 21 of the first glass pane 20, preferably also in alignment with the first pane face 21 of the first glass pane 20. The first cavity 254*a* of the upper first functional end cap 240*a* may extend at least substantially in a vertical direction over a portion of the vertical extension or at least substantially over the entire vertical extension of the upper first functional end cap 240*a* between the upper face 244*a* and the lower face 246*a* of the upper first end cap 240*a*. In the closed state of the glass door apparatus 1, the first cavity 254*a* of the upper first functional end cap 240*a* is overlapped with a complementary counterpiece of the left glass door leaf 100, which is associated with the first cavity 254*a* of the upper first functional end cap 240*a*. In the example second embodiment, the complementary counterpiece of the left glass door leaf 100, which is associated with the first cavity 254*a* of the upper first functional end cap 40*a*, is formed by the first leg 372 of the weather strip 370. As shown in FIG. 17, the first leg 372 of the weather strip 370 overlaps the left glass pane edge 22 of the first glass pane 20 in the closed state of the glass door apparatus 1 and engages the first cavity 254*a* of the upper first functional end cap 240*a* to form the corresponding complementary counterpiece of the left glass door leaf 100, the first leg 372 overlapping and abutting the first inner wall 239*a* of the upper first functional end cap 240*a*, whereby the sealing can be improved. The first leg 378 can also optionally be curved such that it additionally abuts the second inner wall 245*a* of the upper first functional end cap 240*a*. The first leg 372 of the weather strip 370, for example, extends at least substantially vertically (for example upwards) beyond the upper glass pane edge 24 of the first glass pane 20, and optionally extends at least substantially up to the upper face 244*a* of the upper first functional end cap 240*a*.

The upper first functional end cap 240*a* also has a second cavity 256*a*, which, with respect to the lateral front face 242*a* of the upper first functional end cap 240*a*, protrudes laterally inwards in a manner at least substantially parallel to the pane face 21 of the first glass pane 20 as well as in the direction towards the first glass pane 20 and which, in the opposite direction, opens laterally outwardly and which is disposed, with respect to face 21 of first glass pane 20, opposite to the first cavity 254*a* of the upper first functional end cap 240*a* so that a first functional block 258*a* is formed between the first cavity 254*a* and the second cavity 256*a* of the upper first functional end cap 240*a*. The second cavity 256*a* of the upper first functional end cap 240*a* includes, for example, an at least substantially U-shaped cross-section. The second cavity 254*a* is at least partially limited by a third inner wall 247*a* of the upper first functional end cap 240*a*, which third inner wall 247*a* extends at least substantially parallel to the pane face 21 of the first glass pane 20, preferably also in alignment with the first pane face 21 of the first glass pane 20, and in the direction towards the first glass pane 20 and is spaced apart from the first inner wall 239*a* of the upper first functional end cap 240*a* (for instance with respect to the pane face 21 of the first glass pane 20), and by a fourth inner wall 249*a* of the upper first functional end cap 240*a*, which fourth inner wall 249*a* is spaced apart from the third inner wall 247*a* of the first upper functional end cap 240*a* in a direction transverse to the pane face 21 of the first glass pane 20 and is opposite to the third inner wall 247*a* and which extends at least substantially parallel to the pane face 21 of the first glass pane 20, preferably also in alignment with the first pane face 21 of the first glass pane 20, as well as in the direction towards the first glass pane 20. The second cavity 256*a* of the upper first functional end cap 240*a* may extend in the vertical direction over a portion of the vertical extension or at least substantially over the entire vertical extension of the upper first functional end cap 240*a* between the upper face 244*a* and the lower face 246*a* of the upper first functional end cap 240*a* respectively. In FIG. 17, the fourth leg 382 of the weather strip 370 overlaps the left glass pane edge 22 of the first glass pane 20 in the closed state of the glass door apparatus 1 and engages with the formation of a complementary counterpiece of the second cavity 254*a* of the upper first functional end cap 240*a* of left glass door leaf 100 into the second cavity 256*a* of the upper first functional cap 240*a* with the fourth leg 382 overlapping and engaging the third inner wall 247*a* of the upper first functional end cap 240*a*, whereby the sealing can be improved. The fourth leg 382 may also optionally be curved such that it additionally abuts the fourth inner wall 249*a* of the upper first functional end cap 240*a*. The fourth leg 382 of the weather strip 370 extends, for example, over the upper glass pane edge 24 of the first glass pane 20 at least substantially vertically (for example, upwards) and optionally extends at least substantially up to the upper face 244*a* of the upper first functional end cap 240*a*.

The first functional block 258*a* of the upper first functional end cap 240*a* has, for example, a lateral outwardly exposed functional block front face 260*a* which can be aligned with a lateral front face 23 of the left glass pane edge 22 of the first glass pane 20 and which can form an extension of the lateral front face 23 of the left glass pane edge 22. The functional block front face 260*a* of the first functional block 258*a* of the upper first functional end cap 40*a* may form the extension of the lateral front face 23 of the left glass pane edge 22, while having a gap or a distance to the lateral front face 23 of the left glass pane edge 22, or may form the extension of the lateral front face 23 of the left glass pane edge 22, while being flush with the lateral front face 23 of the left glass pane edge 22. Further, the functional block front face 260*a* is aligned with the lateral front face 242*a* of the upper first functional end cap 240*a*. A lower functional block front face 64*a* of the first functional block 258*a* of the upper first functional end cap 40*a* can also form the vertical termination of the glass pane receiving groove 251*a* and at least substantially extend parallel to the upper glass pane edge 24 of the first glass pane 20 and transversely to the functional block front face 260*a* of the first functional block 258*a*. As shown in FIGS. 18 and 19, the first functional block 258*a* and also the functional block front face 260*a* of the first functional block 258*a* can also extend vertically from the lower functional block face 264*a* of the first functional block 258*a* to an upper functional block face 262*a* of the first functional block 258*a*, which upper functional block face 262*a* extends at least substantially parallel to the lower functional block face 264*a* of the first functional block 258*a* and is aligned with the upper face 244*a* of the upper first functional end cap 240*a*, and can thus form an extension of the lateral front face 23 of the left glass pane edge 22 to the level of the upper face 244*a* of the upper first functional end cap 240*a*.

Further, a first wall of the first functional block 258*a* extending transversely to the functional block front face 260*a* of the first functional block 258*a* and transversely to the lower functional block face 264*a* (or at least substantially parallel to the pane face 21 of the first glass pane 20) forms the first inner wall 239*a* of the upper first functional end cap 240*a*, which first inner wall 239*a*, in the closed state of the glass door apparatus 1, is overlapped by the first leg 372 of the weather strip 370 and against which the first leg 372 of the weather strip 370 abuts. A second wall of the first functional block 258*a*, which extends transversely to the functional block front face 260*a* of the first functional block 258*a* and transversely to the lower functional block face 264*a* (or at least substantially parallel to the pane face 21 of the first glass pane 20) and which, with respect to pane face 21 of first glass pane 20, is opposite said first wall of the first functional block 258*a*, further forms the third inner wall 247*a* of the upper first functional end cap 240*a*, which third inner wall 247*a*, in the closed state of the glass door apparatus 1, is overlapped by the fourth leg 382 of the weather strip 370 and against which the fourth leg 382 of the weather strip 370 abuts. When the first glass pane 20 is inserted into the glass pane receiving groove 251*a* of the upper first functional end cap 240*a*, the pane face 21 of the first glass pane 20 is aligned with the first inner wall 239*a* and the third inner wall 247*a* of the upper first functional end cap 240*a*, and forms a portion of the delimiting contour t lest substantially parallel to the face 21 of first glass pane 20 of the first cavity 254*a* of the upper first functional end cap 240*a*.

Further, the upper second glass door leaf frame part 130*a* has a upper second functional end cap 340*a* (shown in more detail in FIGS. 21 to 23) by which the right frame body longitudinal end 134*a* of the upper second frame body 132*a* is covered and which is horizontally at level with the right glass pane edge 122 of second glass pane 20. The connection between the upper second functional end cap 340*a* and the upper second frame body 132*a* is analogous to the connection between the upper first functional end cap 240*a* and the upper first frame body 32*a* (for example, through the through holes 341*a* of the upper second functional end cap 340*a*).

The upper second functional end cap 340*a* also has a central glass pane receiving groove 351*a*, which, with respect to the lower face 346*a* of the upper second functional end cap 340*a*, protrudes inwards in a manner at least substantially parallel to the right glass pane edge 122 of the second glass pane 120 and at least substantially vertical in a direction toward the upper face 344*a* of the upper second functional end cap 340*a* and which, in the opposite direction, opens downwards and into which the second glass pane 120 is inserted, wherein, for example buffer elements (for example, of an elastic material) are positioned between the second glass pane 120 and the upper second functional end cap 340*a* in the glass pane receiving groove 351*a*.

The complementary counterpiece of the left glass door leaf 100 associated with the first protrusion 252*a* of the upper first functional end cap 240*a* is formed here by the first functional end cap side face 348*a* of the upper second functional end cap 340*a*. As shown in FIG. 17, in the closed state of the glass door apparatus 1, the first protrusion 252*a* of the upper first functional end cap 240*a* is overlapped with the functional end cap side face 348*a* of the upper second functional end cap 340*a*, whereby the sealing can be improved. However, it is also possible that the face of the upper second functional end cap 340*a* which forms the complementary counterpiece of the left glass door leaf 100 associated with the first protrusion 252*a* of the upper first functional end cap 240*a* is not exposed to the outside but forms an inner wall of a further cavity of upper second functional end cap 340*a*, which further cavity protrudes, with respect to the lateral front face 342*a* of the upper second functional end cap 340*a*, laterally inwards in a manner at least substantially parallel to the pane face 121 of the second glass pane 120 and in the direction of the second glass pane 120 laterally inwards and which, in the opposite direction opens laterally outwards.

The upper second functional end cap 340*a* also has a second protrusion 352*a*, which is disposed, with respect to the pane face 121 of the second glass pane 120, opposite to the first functional end cap side face 348*a* of the upper second functional end cap 340*a* and which, with respect to the lateral front face 342*a* of the upper second functional end cap 340*a*, protrudes laterally outwards in a manner at least substantially parallel to the pane face 121 of the second glass pane 120 and in a direction away from the second glass pane 120. As shown in FIG. 17, the second protrusion 352*a* of the upper second functional end cap 340*a* is overlapped with the first functional end cap side face 248*a* of the upper first functional end cap 240*a*, whereby the seal can be improved.

The second protrusion 352*a* of the upper second functional end cap 340*a* may extend at least substantially in a vertical direction over a portion of the vertical extension or at least substantially over the entire vertical extension of the upper second functional end cap 340*a* between the upper face 344*a* and the lower face 346*a* of the upper second functional end cap 340*a*. Further, the second protrusion 352*a* of the upper second functional end cap 340*a* can at least partially form the second functional end cap side face 350*a* of the upper second functional end cap 340*a*.

The upper second functional end cap 340*a* includes, for example, a first cavity 354*a*, which, with respect to the lateral front face 342*a* of the upper second functional end cap 340*a*, protrudes laterally inwards in a manner at least substantially parallel to the pane face 121 of the second glass pane 122 as well as in the direction of the second glass pane 122 and which, in the opposite direction, opens laterally and outwards. Further, the upper second functional end cap 340*a* includes, for example, a second cavity 356*a*, which, with respect to the lateral front face 342*a* of the upper second functional end cap 340*a*, protrudes laterally inwards in a manner at least substantially parallel to the pane face 121 of the second glass pane 122 as well as in the direction of the second glass pane 122 and which, in the opposite direction, opens laterally and outwards and which is positioned, with respect to face 121 of second glass pane 122, opposite the first cavity 354*a* of the upper second functional end cap 340*a* such that a second functional block 358*a* is formed between the first cavity 354*a* and the second cavity 356*a* of the upper second functional end cap 340*a*. The first cavity 354*a* and the second cavity 356*a* of the upper second functional end cap 340*a* comprise, for example, an at least substantially U-shaped cross-section, respectively. Furthermore, the first cavity 354*a* of the upper second functional end cap 340*a* can extend at least substantially in the vertical direction over a part of the vertical extension or at least substantially over the entire vertical extension of the upper second functional end cap 340 between the upper face 344*a* and the lower face 346*a* of the upper second functional end cap 340*a*. The second cavity 356*a* of the upper second functional end cap 340*a* may extend at least substantially in vertical direction over a portion of the vertical extension or at least substantially over the entire vertical extension of the upper second functional end cap 340 between the upper face 344*a* and the lower face 346*a* of the upper second functional end cap 340*a*.

The second leg 378 of the weather strip 370 engages the first cavity 354*a* of the upper second functional end cap 340*a* and the third leg 380 of the weather strip 370 engages the second cavity 356*a* of the upper second functional end cap 340*a* so that the second leg 378 and the third leg 380 of the weather strip 370 surround (e.g., engage in a gripping manner) the pane face 121 of the second glass pane 120 and the second functional block 358*a*. As a result, the weather strip 370, for example, may be connected to the pane face 121 of the second glass pane 120 and to the second functional block 358*a* by means of a clamping of the second leg 378 and the third leg 380 of the weather strip 370 against the pane face 121 of the second glass pane 120 and against the second functional block 358*a*.

Figure 21:
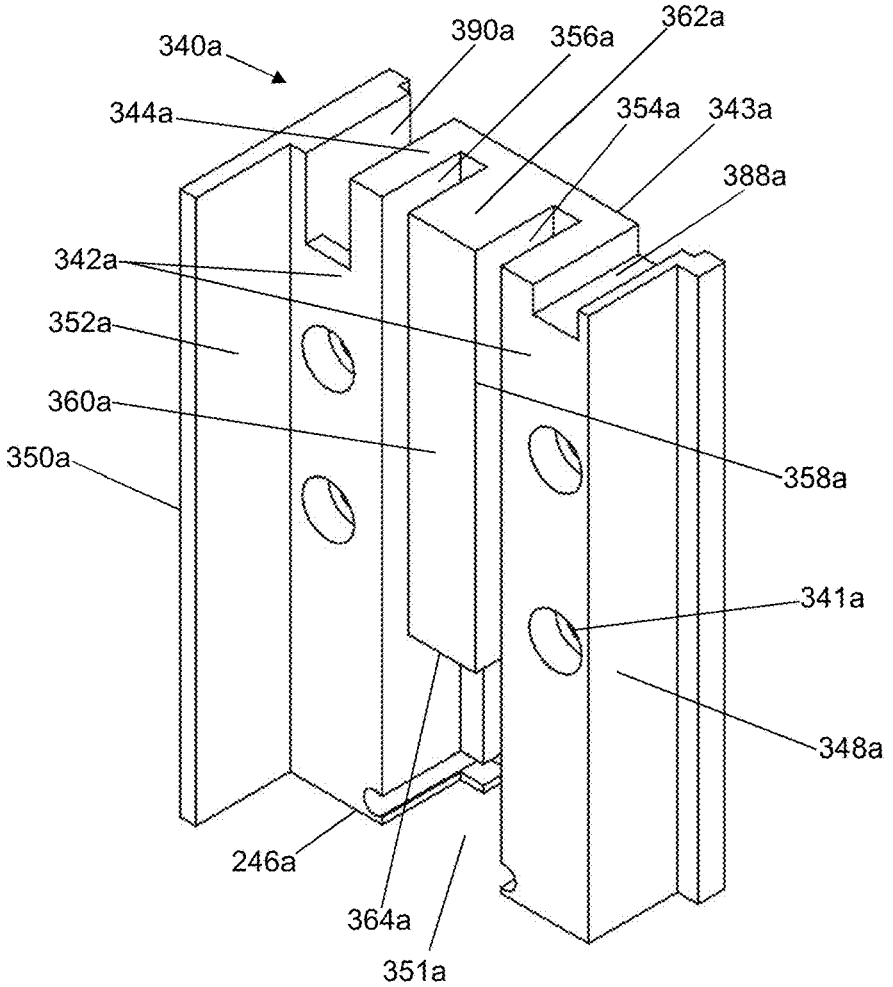
FIGS. 21 to 23 are respectively a perspective view, a front side view and a plan view of an upper second functional end cap according to the first alternative of the second example embodiment of the present invention.
Figure 22:
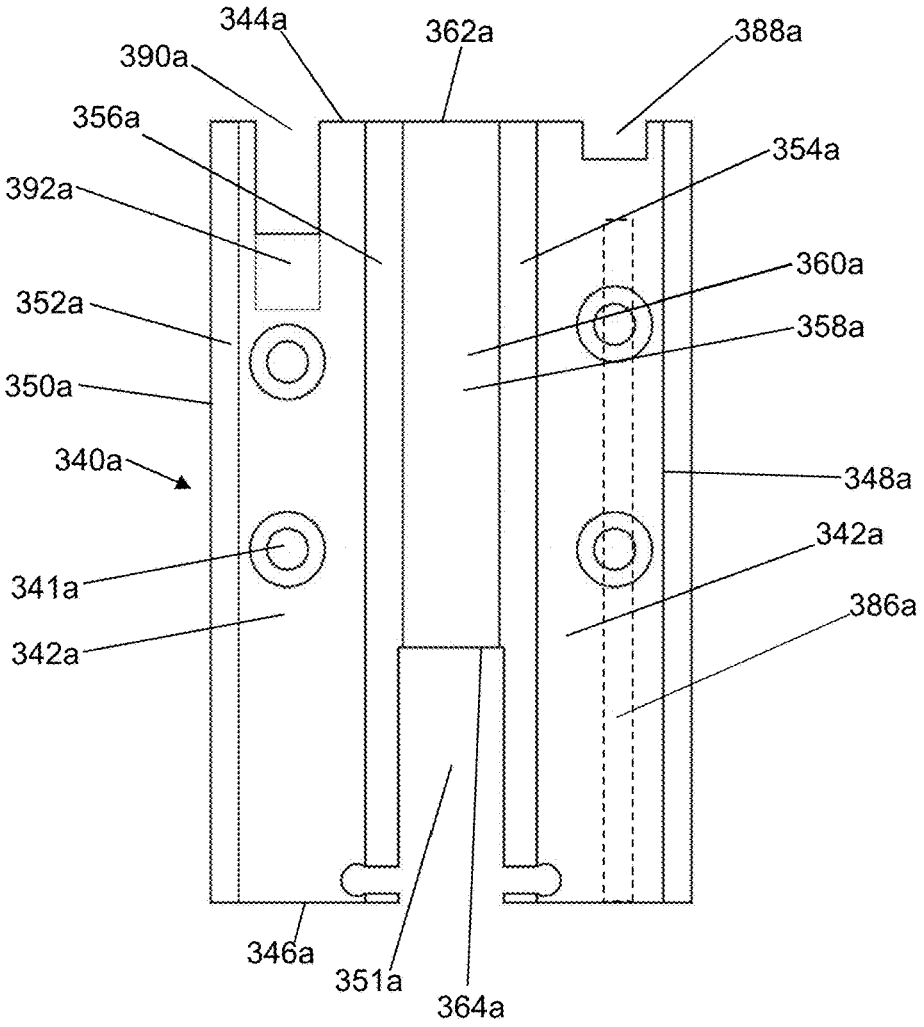
Figure 23:
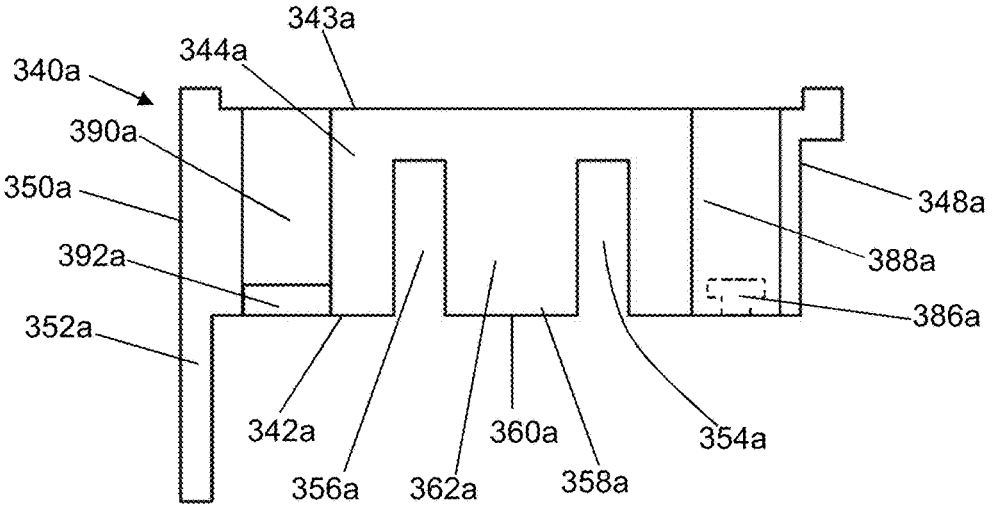

The second functional block 358*a* has, for example, a lateral outwardly exposed functional block front face 360*a* which can be aligned with a lateral front face 123 of the right glass pane edge 122 of the second glass pane 120 and which can form an extension of the lateral front face 123 of the right glass pane edge 122. The functional block front face 360*a* of the second functional block 358*a* may form the extension of the lateral front face 123 of the right glass pane edge 122, while having a gap or distance from the lateral front face 123 of the right glass pane edge 122, or may form the extension of the lateral front face 123 of the right glass pane edge 122, while being flush with the lateral front face 123 of the right glass pane edge 122. Furthermore, the functional block front face 360*a* of the second functional block 358*a* is aligned with the lateral front face 342*a* of the upper second functional end cap 240*a*. A lower functional block face 364*a* of the second functional block 358*a* of the upper second functional end cap 140*a* can also form the vertical termination of the glass pane receiving groove 151*a* and extend at least substantially parallel to the upper glass pane edge 124 of the second glass pane 120 as well as transversely to the functional block front face 360*a* of the second functional block 358*a*. As shown in FIGS. 21-23, the second functional block 358*a* and also the functional block front face 360*a* of the second functional block 358*a* may also extend at least substantially in a vertical direction from the lower functional block face 364*a* of the second functional block 358*a* to an upper functional block face 362*a*, which is at least substantially parallel to the lower functional block face 364*a* of second functional block 358*a* and which is aligned with the upper face 344*a* of the upper second functional end cap 340*a*, and may thus form an extension of the lateral front face 123 of the right glass pane edge 122 to the level of the upper face 344*a* of the upper second functional end cap 340*a*.

Next, the second alternative of the second example embodiment will be described with reference to FIGS. 16 and 24 to 30.

Figure 12:
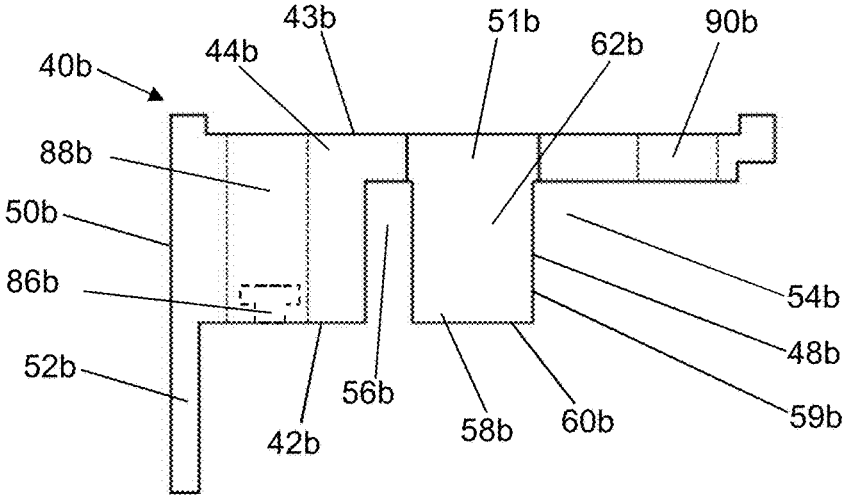

The lower first glass leaf frame part 30*b* according to the second alternative has a lower first functional end cap 240*b* (shown in more detail in FIGS. 25 to 27), by which the left frame body longitudinal end 34*b* of the lower first frame body 32*b* is covered, and which is horizontally positioned at level of left glass pane edge 22 of the first glass pane 20. The lower first functional end cap 240*b* is connected to the lower first frame body 32*b*, for example by means of a screwed connection, the lower first functional end cap 240*b* being, for example, at least one through hole 241*b* (for example, four through-holes are shown in FIGS. 10-12) for receiving a threaded pin or bolt through which the lower first functional end cap 240*b* is connected to the lower first frame body 32*b*. However, the lower first functional end cap 240*b* may also be otherwise connected to the lower first frame body 32*a*, for example by means of a clamping connection or by means of a locking or latching connection (e.g., snap connection).

The lower first functional end cap 240*b* also has a central glass pane receiving groove 251*b*, which, with respect to the upper face 244*b* of the lower first functional end cap 240*b*, protrudes inwards in a manner at least substantially parallel to the left glass pane edge 22 of the first glass pane 20 as well as at least substantially vertical in a direction toward the lower face 246*b* of the lower first functional end cap 240*b* and which, in opposite direction, opens upwards and into which the first glass pane 20 is inserted, wherein for example buffer elements (for example, of an elastic material) are arranged between the first glass pane 20 and the lower first functional end cap 240*b* in the glass pane receiving groove 251*b*.

Furthermore, the lower first functional end cap 240*b* has a central cavity 253*b* (indicated in FIG. 26) which, with respect to the lower face 246*b* of the lower first functional end cap 240*b*, protrudes inwards in a manner at least substantially parallel to the left glass pane edge 22 of the first glass pane 20 as well as at least substantially vertical toward the upper face 244*b* of the lower first functional end cap 240*b* and which, in the opposite direction, opens outwardly towards the bottom. The central cavity 253*b* may be used, for example for receiving and/or as a passage for functional parts (for example, a wedge) of an automatic locking device for the glass door apparatus.

The lower first functional end cap 240*b* also has a first protrusion 252*b*, which, with respect to the lateral front face 242*b* of the lower first functional end cap 240*b*, protrudes laterally outwards in a manner at least substantially parallel to the pane face 21 of the first glass pane 20 and in the direction away from the first glass pane 20, wherein in the closed state of the glass door apparatus 1, the first protrusion 252*b* of the lower first functional end cap 240*b* is overlapped with a complementary counterpiece of the left glass door leaf 100, which is associated with the first protrusion 252*b* of the lower first functional end cap 240*b*. The first protrusion 252*b* may extend at least substantially in a vertical direction over a portion of the vertical extension or at least substantially over the entire vertical extension of the lower first functional end cap 240*b* between the upper face 244*b* and the lower face 246*b* of the lower first functional end cap 240*b*. The first protrusion 252*b* of the lower first functional end cap 240*b* can at least partially form the second functional end cap side face 250*b* of the lower first functional end cap 240*b*. The first functional end cap side face 248*b* of the lower first functional end cap 240*b* also is disposed opposite to the first protrusion 252*b* of the lower first functional cap 240*b* with regard to the pane face 21 of the first glass pane 20.

The lower first functional end cap 240*b* also has a first cavity 254*b*, which, with respect to the lateral front face 242*b* of the lower first functional end cap 240*b*, protrudes laterally inward in a manner at least substantially parallel to the pane face 21 of the first glass pane 20 as well as in the direction towards the first glass pane 20 and which opens, in the opposite direction, laterally outwards. In the second alternative of the second embodiment, the first cavity 254*b* is arranged in the direction of the pane face 21 of the first glass pane 20 at a distance from the first functional end cap side face 248*b*. The first cavity 254*b* of the lower first functional end cap 240*b* includes, for example, an at least substantially U-shaped profile cross-section. The first cavity 254*b* of the lower first functional end cap 240*b* is at least partially delimited by a first inner wall 239*b* of the lower first functional end cap 240*b*, said first inner wall 239*b* extending at least substantially parallel to the pane face 21 of the first glass pane 20 and at least substantially parallel with the first pane face 21 of the first glass pane 20, preferably also in alignment with the first pane face 21 of the first glass pane 20, and in the direction toward the first glass pane 20, and by a second inner wall 245*b* of the lower first functional end cap 240*b*, which second inner wall 245*b* is spaced apart from the first inner wall 239*b* of the lower first functional end cap 240*b* in the direction transverse to the pane face 21 of the pane and is opposite to the first inner wall 239*b* and extends at least substantially parallel to the pane face 21 of the first glass pane 20, preferably also in alignment with the first pane face 21 of the first glass pane 20, and in the direction of the first glass pane 20. The first cavity 254*b* of the lower first functional end cap 240*b* can extend at least substantially in vertical direction over a portion of the vertical extension or in the vertical direction at least substantially from the upper face 244*b* of the lower first functional end cap 240*b* to the vertically upper end of the central cavity 253*b* of the lower first end cap 240*b*. In the closed state of the glass door apparatus 1, the first cavity 254*b* of the lower first functional end cap 240*b* is overlapped with a complementary counterpiece of the left glass door leaf 100, which is associated with the first cavity 254*b* of the lower first functional end cap 240*b*. In the second example embodiment, the complementary counterpiece of left glass door leaf 100 associated with first cavity 254*b* of the lower first functional end cap 40*b* is formed by the first leg 372 of the weather strip 370. As shown in FIG. 24, the first leg 372 of the weather strip 370 overlaps the left glass pane edge 22 of the first glass pane 20 in the closed state of the glass door apparatus 1 and engages the first cavity 254*b* of the lower first functional end cap 240*b* to form the corresponding complementary counterpiece of the left glass door leaf 100, wherein the first leg 372 overlaps and abuts the first inner wall 239*b* of the lower first functional end cap 240*b*, whereby the sealing can be improved. The first leg 378 can also optionally be curved such that it additionally abuts against the second inner wall 245*b* of the lower first functional end cap 240*b*. The first leg 372 of the weather strip 370 extends, for example, beyond the lower glass pane edge 26 of the first glass pane 20 at least substantially vertically (for instance downwards) and optionally extends up to the vertical upper end of the central cavity 253*b* of the lower first functional end cap 240*b*, or at least substantially up to the lower face 246*b* of the lower first functional end cap 240*b*.

The lower first functional end cap 240*b* also has a second cavity 256*b* which, with respect to the lateral front face 242*b* of the first lower functional end cap 240*b*, protrudes laterally inwards in a manner at least substantially parallel to the pane face 21 of the first glass pane 20 as well as in the direction towards the first glass pane 20 and which, in the opposite direction, opens laterally outwards and which is disposed, with respect to the pane face 21 of the first glass pane 20, opposite to the first cavity 254*b* of the lower first functional end cap 240*b* so that a first functional block 258*b* is formed between the first cavity 254*b* and the second cavity 256*b* of the lower first functional end cap 240*b*. The second cavity 256*b* of the lower first functional end cap 240*b* includes, for example, an at least substantially U-shaped profile cross-section, respectively. The second cavity 256*b* of the lower first functional end cap 240*b* is at least partially limited by a third inner wall 247*b* of the lower first functional end cap 240*b*, which third inner wall 247*b* extends at least substantially parallel to the pane face 21 of the first glass pane 20, preferably also in alignment with the first pane face 21 of the first glass pane 20, as well as in the direction of the first glass pane 20 and is positioned (for instance with respect to pane face 21 of the first glass pane 20) at a distance from the first inner wall 239*b* of the lower first functional end cap 240*b*, and by a fourth inner wall 249*b* of the lower first functional end cap 240*b*, which fourth inner wall 249*b* is spaced apart from the third inner wall 247*b* of the lower first functional end cap 240*b* in a direction transverse to the pane face 21 of the first glass pane 20 and is opposite to the third inner wall 247*b* and extends at least substantially parallel to the pane face 21 of the first glass pane 20, preferably flush with first pane face 21 of the first glass pane 20, as well as in the direction towards the first glass pane 20. The second cavity 256*b* of the lower first functional end cap 240*b* may extend at least substantially in a vertical direction over a portion of the vertical extension or in the vertical direction at least substantially from the upper face 244*b* of the lower first functional end cap 240*b* to the vertical upper end of the central cavity 253*b* of the lower first functional end cap 240*b*. As shown in FIG. 24, the fourth leg 382 of the weather strip 370 overlaps the left glass pane edge 22 of the first glass pane 20 in the closed state of the glass door apparatus 1 and engages with the formation of a further complementary counterpiece of the second cavity 254*b* of the lower first functional end cap 240*b* the left glass door leaf 100 into the second cavity 256*b* of the lower first functional end cap 240*b* with the fourth leg 382 overlapping and abutting the third inner wall 247*b* of the lower first functional end cap 240*b* whereby the sealing can be improved. The fourth leg 382 may also optionally be curved such that it additionally abuts against the fourth inner wall 249*b* of the lower first functional end cap 240*b*. The fourth leg 382 of the weather strip 370 extends, for example, over the lower glass pane edge 26 of the first glass pane 20 at least substantially vertically (for instance downwards) and optionally extends up to the vertically upper end of the central cavity 253*b* of the lower first functional end cap 240*b* or at least substantially up to the lower face 246*b* of the lower first functional end cap 240*b*.

Figure 25:
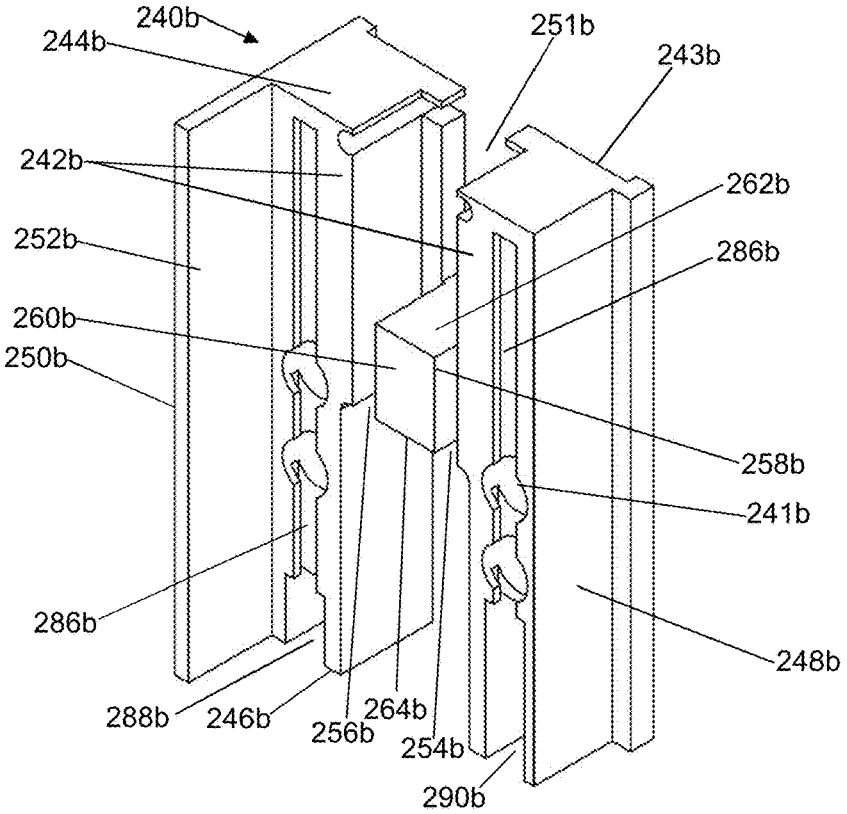
FIGS. 25 to 27 are respectively a perspective view, a front side view and a plan view of a lower first functional end cap according to the second alternative of the second example embodiment of the present invention.
Figure 26:
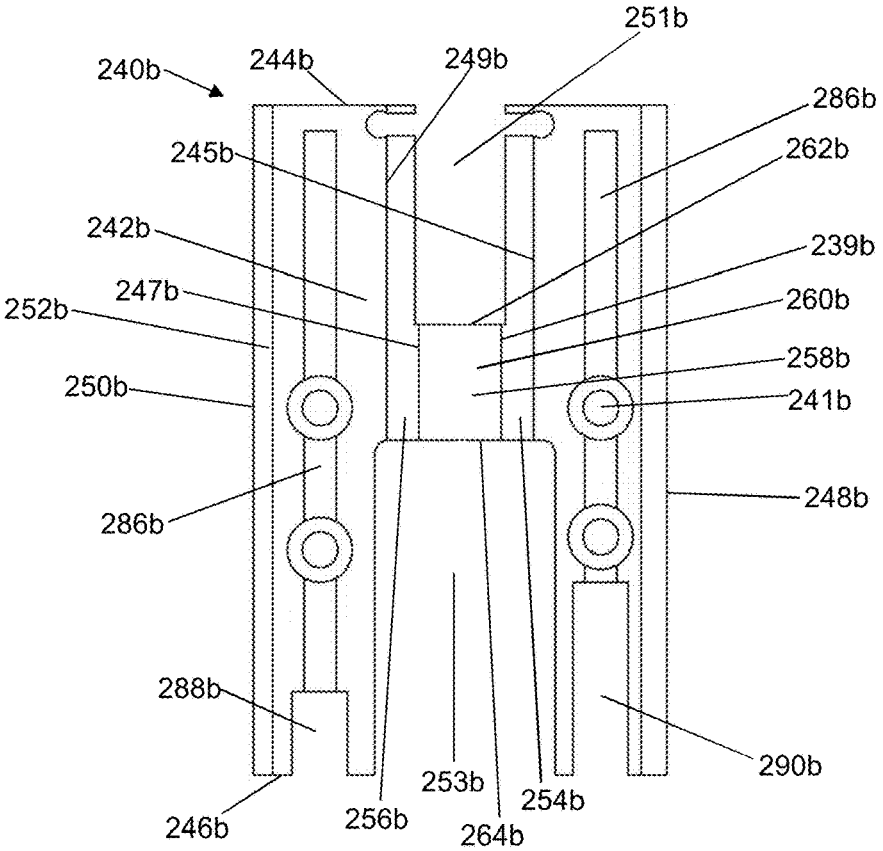
Figure 27:
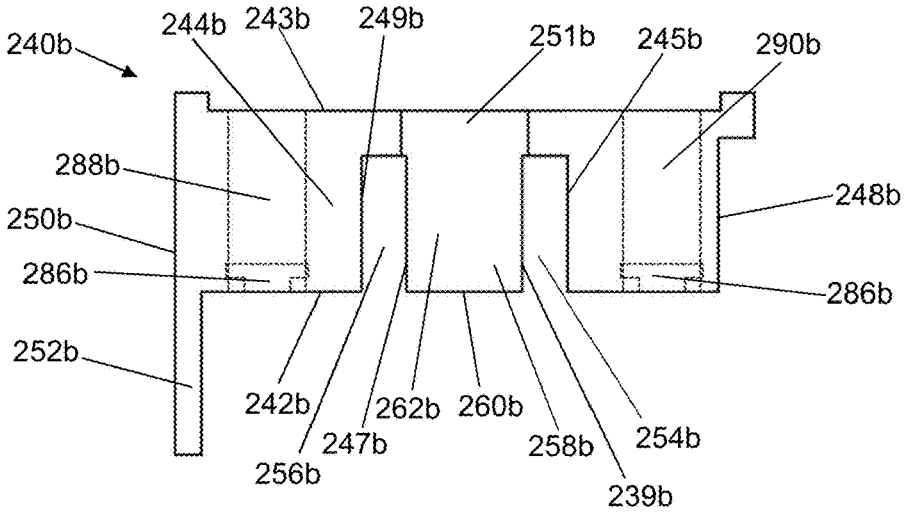

The first functional block 258*b* of the lower first functional end cap 240*b* has, for example, a lateral outwardly exposed functional block front face 260*b* which can be aligned with a lateral front face 23 of the left glass pane edge 22 of the first glass pane and which can form an extension of the lateral front face 23 of the left glass pane edge 22. The functional block front face 260*b* of the first functional block 258*b* may form the extension of the lateral front face 23 of the left glass leaf edge 22, while having a gap to the lateral front face 23 of the left glass leaf edge 22, or may form the extension of the lateral front face 23 of the left glass leaf edge 22, while being flush with the lateral front face 23 of the left glass pane edge 22. Further, the functional block front face 260*b* is aligned with the lateral front face 242*b* of the lower first functional end cap 240*b*. An upper functional block face 262*b* of the first functional block 258*b* of the lower first functional end cap 240*b* can also form the vertical termination of the glass pane receiving groove 251*b* and extends at least substantially parallel to the lower glass pane edge 26 of the first glass pane 20 and transversely to the functional block front face 260*b* of the first functional block 258*b*. As shown in FIGS. 25 and 26, the first functional block 258*b*, and hence the functional block front face 260*b* of the first functional block 258*b*, can also extend at least substantially vertically from the upper functional block face 262*b* of the first functional block 262*b* to a lower functional block face 264*b* of the first functional block 262*b*, which lower functional block face 264*b* extends at least substantially parallel to the upper functional block face 262*b* of first functional block 258*b* and forms the vertical termination of the central cavity 253*b*, and can thus form an extension of the lateral front face 23 of the left glass pane edge 22 to the level of the lower functional block face 264*b*.

Further, a first wall of the first functional block 258*b* extending transversely to the functional block front face 260*b* of the first functional block 258*b* (or at least substantially parallel to the pane face 21 of the first glass pane 20) forms the first inner wall 239*b* of the lower first functional end cap 240*b* which in the closed state of the glass door apparatus 1 is overlapped by the first leg 372 of the weather strip 370 and on which the first leg 372 of the weather strip 370 rests. A second wall of the first functional block 58*b*, which extends transversely to the functional block front face 260*b* of the first functional block 258*b* and transversely to the lower functional block face 264*b* (or at least substantially parallel to the pane face 21 of the first glass pane 20) and which, with respect to the pane face 21 of the first glass pane 20, is disposed opposite to the first wall of the first functional block 258*b*, forms the third inner wall 247*b* of the lower first functional end cap 240*b*, which in the closed state of the glass door apparatus 1 is overlapped by the fourth leg 382 of the weather strip 370 and against which the fourth leg 382 of the weather strip 370 rests. When the first glass pane 20 is inserted into the glass pane receiving groove 251*b* of the lower first functional end cap 240*a*, the pane face 21 of the first glass pane 20 is aligned with the first inner wall 239*b* and the third inner wall 247*b* of the lower first functional end cap 240*b* and forms a portion of the delimiting contour of first cavity 254*b* of lower first functional end cap 240*b* at least substantially parallel to pane face 21 of first glass pane 20.

The lower second glass door leaf frame part 130*b* also has a lower second functional end cap 340*b* (shown in more detail in FIGS. 28 to 30) by which the right frame body longitudinal end 134*b* of the lower second frame body 132*b* is covered and which is positioned horizontally at the level of the right glass pane edge 122 of the second glass pane 20. The connection between lower second functional end cap 340*b* and lower second frame body 132*b* is possible in a way similar to the connection between the lower first functional end cap 240*b* and the lower first frame body 32*b* (for example, by means of the through holes 341*b* of the lower second functional end cap 340*b*).

The lower second functional end cap 340*b* also has a central glass pane receiving groove 351*b*, which, with respect to the upper face 344*b* of the lower second functional end cap 340*b*, protrudes inwards in a manner at least substantially parallel to the right glass pane edge 122 of the second glass pane 120 and at least substantially vertical in the direction toward the lower face 346*b* of the lower second functional end cap 340*b* and which, in the opposite direction, opens upwards and into which the second glass pane 120 is introduced, wherein, for example, buffer elements (of an elastic material) are positioned between the second glass pane 120 and the lower second functional end cap 340*b* in the glass pane receiving groove 351*b*.

Further, the lower second functional end cap 340*b* has a central cavity 353*b* (indicated in FIG. 29), which, with respect to the lower face 346*b* of the lower second functional end cap 340*b*, protrudes inwards in a manner at least substantially parallel to the right glass pane edge 122 of the second glass pane 120 and at least substantially vertical in a direction toward the upper face 344*b* of the lower second functional end cap 340*b* and which, in the opposite direction, opens outwardly downwards. The central cavity 353*b* may for example be used for receiving and/or as a passage for functional parts (for example, a wedge) of an automatic locking device for the glass door apparatus.

The complementary counterpiece of the left glass leaves 100 associated with the first protrusion 252*b* of the lower first functional end cap 240*b* is formed here by the first functional end cap side face 348*b* of the lower second functional end cap 340*b*. As shown in FIG. 24, in the closed state of the glass door apparatus 1, the first protrusion 252*b* of the lower first functional end cap 240*b* is overlapped with the functional end cap side face 348*b* of the lower second functional end cap 340*b*, whereby the sealing can be improved. However, it is also possible that the face of the lower second functional end cap 340*b*, which forms the complementary counterpiece of the left glass door leaf 100 associated with the first protrusion 252*b* of the lower first functional end cap 240*b*, is not exposed to the outside, but forms an inner wall of a further cavity which, with respect to the lateral front face 342*b* of the lower second functional end cap 340*b*, is at least substantially parallel to the pane face 121 of the second glass pane 120, as well as protrudes laterally outwards in the direction of the second glass pane 120, of lower second functional end cap 340*b*.

The lower second functional end cap 340*b* also has a second protrusion 352*b* which, with respect to face 121 of second glass pane 120, is disposed opposite to the first functional end cap side face 348*b* of the lower second functional end cap 340*b* and which, with respect to lateral front face 342*b* of lower second functional end cap 340*b*, protrudes laterally outwards in a manner at least substantially parallel to the pane face 121 of the second glass pane 120 and away from the second glass pane 120. As shown in FIG. 24, in the closed state of the glass door apparatus 1, the second protrusion 352*b* of the lower second functional end cap 340*b* is overlapped with the first functional end cap side face 248*b* of the lower first functional cap 240*b* and also with the left glass pane edge 22 of the first glass pane 20, so that the sealing can be improved.

The second protrusion 352*b* of the lower second functional end cap 340*b* may extend at least substantially in a vertical direction over a portion of the vertical extension or at least substantially over the entire vertical extension of the lower second functional end cap 340*b* between the upper face 344*b* and the lower face 346*b* of the lower second end cap 340*b*. Furthermore, the second protrusion 352*b* of the lower second functional end cap 340*b* can at least partially form the second functional end cap side face 350*b* of the lower second functional end cap 340*b*.

The lower second functional end cap 340*b* has, for example a first cavity 354*b*, which, with respect to the front face 342*b* of the lower second functional end cap 140*b*, protrudes laterally inwards in a manner at least substantially parallel to the pane face 121 of the second glass pane 122 as well as in the direction of the second glass pane 122 and which, in the opposite direction, opens laterally outwardly. Further, the lower second functional end cap 340*b* includes, for example, a second cavity 356*b*, which, with respect to the front face 342*b* of the lower second functional end cap 340*b*, protrudes laterally inwardly in a manner at least substantially parallel to the pane face 121 of the second glass pane 122 as well as in the direction of the second glass pane 122 and which, in the opposite direction, opens laterally outwardly and which, with respect to pane face 121 of the second glass pane 122, is arranged opposite the first cavity 354*b* of the lower second functional end cap 340*b* so that a second functional block 358*b* is formed between the first cavity 354*b* and the second cavity 356*b* of the lower second functional end cap 340*b*. The first cavity 354*b* and the second cavity 356*b* of the lower second functional end cap 340*b* have, for example, an at least substantially U-shaped cross-section, respectively. Furthermore, the first cavity 354*b* of the lower second functional end cap 340*b* can extend at least substantially in vertical direction over a part of the vertical extension or can extend in the vertical direction, from the upper face 344*b* of the lower second functional end cap 340*b* to the vertically upper end of the central cavity 353*b* of the lower second functional end cap 340*b*. The second cavity 356*b* of the lower second functional end cap 340*b* can extend at least substantially in vertical direction over a portion of the vertical extension or in the vertical direction at least substantially from the upper face 344*b* of the lower second functional end cap 340*b* to the vertically upper end of the central cavity 353*b* of the lower second functional end cap 340*b*.

The second leg 378 of the weather strip 370 engages in the first cavity 354*b* of the lower second functional end cap 340*b* and the third leg 380 of the weather strip 370 engages in the second cavity 356*b* of the lower second functional end cap 340*b* so that the second leg 378 and the third leg 380 of the weather strip 370 enclose (e.g., engage in a gripping manner) the pane face 121 of the second glass pane 120 and the second functional block 358*b*. The weather strip 370 can be connected to the pane face 121 of the second glass pane 120 and to the second functional block 358*b* by means of a clamping of the second leg 378 and the third leg 180 of the weather strip 370 against the pane face 121 of the second glass pane 120 and against the second functional block 358*b*.

The second functional block 358*b* has, for example, a lateral, outwardly exposed functional block front face 360*b* which can be aligned with a lateral front face 123 of the right glass pane edge 122 of the second glass pane 120 and which can form an extension of the lateral front face 123 of the right glass pane edge 122. The functional block front face 360*b* of the second functional block 358*b* may form the extension of the lateral front face 123 of the right glass pane edge 122, while forming a gap or distance to the lateral front face 123 of the right glass pane edge 122, or may form the extension of the lateral front face 123 of the right glass pane edge 122, while being flush with lateral front face 123 of the right glass pane edge 122. Further, the functional block front face 360*b* is aligned with the lateral front face 342*b* of the lower second functional end cap 340*b*. An upper functional block face 362*b* of the second functional block 358*b* of the lower second functional end cap 340*b* can also form the vertical termination of the glass pane receiving groove 351*b* and extend at least substantially parallel to the lower glass pane edge 126 of the second glass pane 120 as well as transversely to the functional block front face 360*b* of the second functional block 358*b*.

Figure 28:
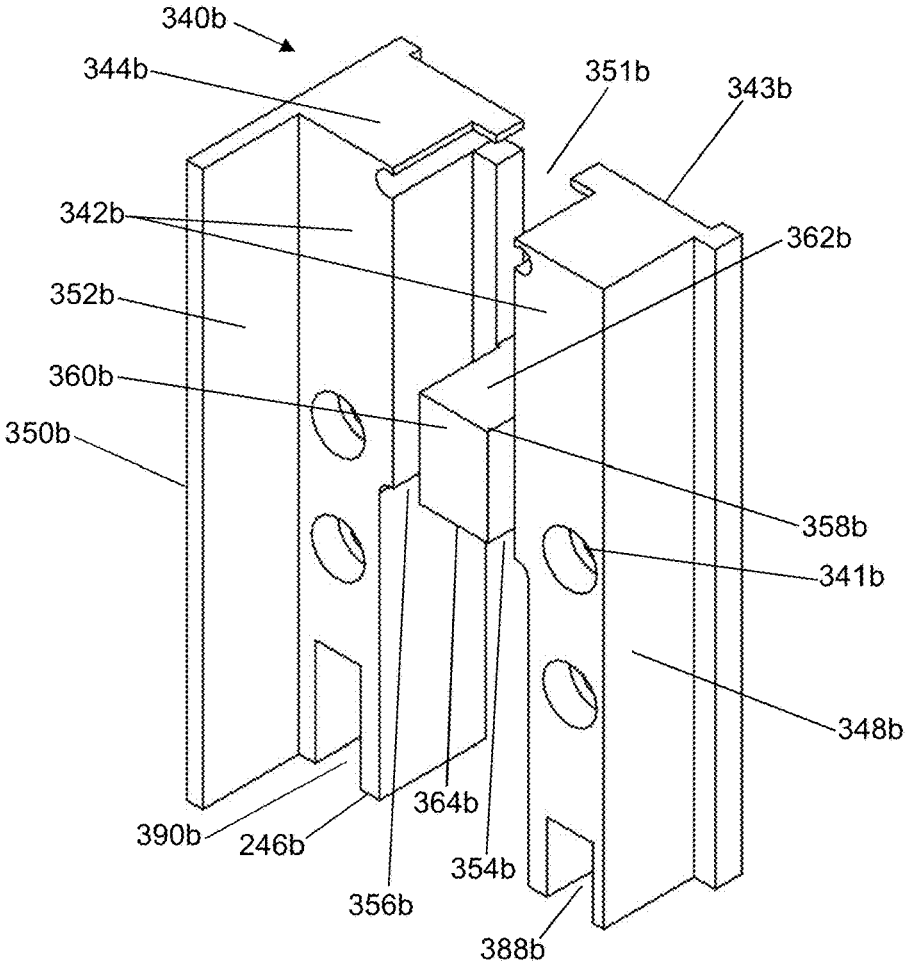
FIGS. 28 to 30 are respectively a perspective view, an end view and a plan view of a lower second functional end cap according to the second alternative of the second example embodiment of the present invention.
Figure 29:
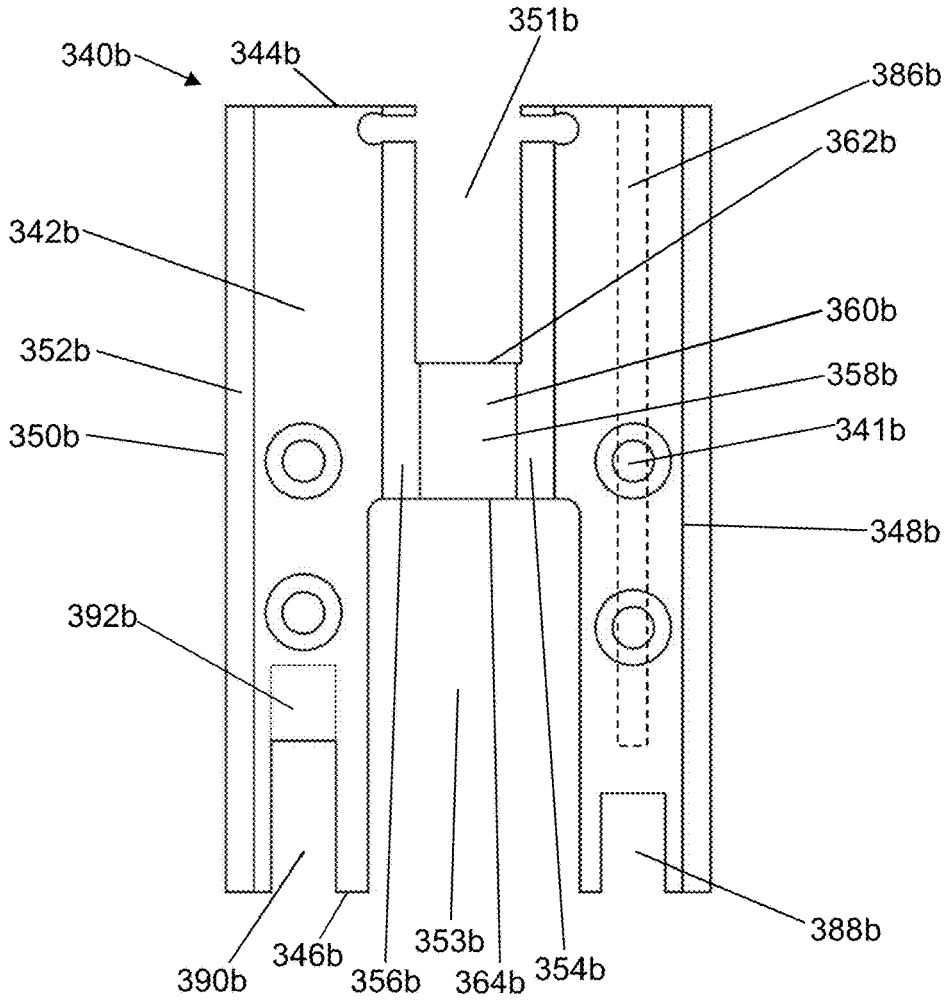

As shown in FIGS. 28 and 29, the second functional block 358*b* and consequently the functional block front face 360*b* of the second functional block 358*b* can also extend at least substantially vertically from the upper functional block face 362*b* of the second functional block 362*b* to a lower functional block face 364*b*, which extends at least substantially parallel to the upper functional block face 362*b* of the second functional block 358*b* and which forms the vertical termination of the central cavity 353*b* of the lower second functional end cap 340*b*, and can thus forms an extension of the lateral front face 123 of the right glass pane edge 122 to the level of the lower functional block face 364*b*.

Above described second embodiment is suitable for example for use of a right glass door leaf 10 which can be displaced in the direction towards the left glass door leaf 100, since two legs of the weather strip engage on both sides of the pane face 21 of the glass pane 20 of the right glass door leaf 10 in two cavities of the respective first functional cap and on the glass pane 20 as well as on the inner walls of the respective first functional cap. By means of the above-described second embodiment of the present invention, sound/noise, moisture and wind can be effectively prevented from penetrating through the glass door apparatus 1. Thus, the noise protection, moisture protection and wind protection properties of the glass door apparatus 1 can be improved.

In each of the previously described embodiments, a gap between the respective first protrusion and the respective complementary counterpiece of the left glass door leaf in a direction transverse to the pane faces of the first and second glass panes can be less than or equal to one fifth of an overlapping length of the respective first protrusion with the respectively corresponding complementary counterpiece of left glass door leaf, and/or a gap between the first cavity of first functional end cap and the corresponding complementary counterpiece of left glass door leaf in a transverse direction with respect to pane faces of first and second glass panes may be less than or equal to one fifth of the overlapping length of the first cavity of the respective first functional end cap with the respective complementary counterpiece of the left glass door leaf.

Furthermore, in the closed state of the glass door apparatus, a gap between the second cavity of the respective first functional end cap and the further associated, complementary counterpiece of the left glass door leaf in a direction transverse to the pane faces of the first and second glass panes can be less than or equal to one fifth of the overlapping length of the second cavity of the respective first functional end cap with the further associated, complementary counterpiece of the left glass door leaf.

In the upper and/or lower first functional end cap 40*a*, 40*b*, 240*a*, 240*b* according to the previously described embodiments, additionally or alternatively a (for example, at least one) sealing element receiving vertical groove (e.g., a first sealing element receiving vertical groove and a second sealing element receiving vertical groove) 86*a*, 86*b*, 286*a*, 286*b*, which extends at least substantially parallel to the left glass pane edge 22 of the first glass pane 20, protrudes, at the front face (for example, on the lateral front face), laterally inwardly in a manner at least substantially parallel to the pane face 21 of the first glass pane 20 as well as in the direction towards the first glass pane 20 and which opens in the opposite direction laterally outwards and in which a (vertical) sealing element (for example, a sealing lip, a brush, etc.) is received, which sealing element protrudes laterally outwards from the sealing element receiving vertical groove 86*a*, 86*b*, 286*a*, 286*b* in a manner at least substantially parallel to the pane face 21 of the first glass pane 20 as well as in the direction away from the first glass pane 20 and which sealing element, in the closed state of the glass door apparatus 1, interacts with the left glass door leaf 100 in an abutting way. For example, in the closed state of the glass door apparatus 1, the sealing element can cooperate with the second functional end cap opposite the respective first functional end cap (for example, with a front face thereof) in an adjoining way.

In the upper and/or lower second functional end cap 140*a*, 140*b*, 340*a*, 340*b* in accordance with the above-described embodiments, additionally or alternatively, a (e.g., at least one) sealing element receiving vertical groove (a first sealing element receiving vertical groove and a second sealing element receiving vertical groove) 186*a*, 186*b*, 386*a*, 386*b* may be formed, which extends at least substantially parallel to the right glass pane edge 122 of the second glass pane 120, protrudes, at the front face (for example, at the lateral front face), laterally inwards in a manner at least substantially parallel to the pane face 121 of the second glass pane 120 and in the direction towards the second glass pane 120 and which opens in the opposite direction laterally outwards and in which a (vertical) sealing element (a sealing lip, a brush, etc.) is received, which sealing element protrudes laterally outwards from the sealing element receiving vertical groove 186*a*, 186*b*, 386*a*, 386*b* in a manner at least substantially parallel to the pane face 121 of the second glass pane 120 as well as in the direction away from the second glass pane 120 and which sealing element, in a closed state of the glass door apparatus 1, interacts with the first functional end cap opposite the respective second functional end cap in an abutting way (for instance against a front face of the respectively opposing first functional end cap).

In each of the above-described functional end caps, there may also be formed a sealing element receiving horizontal groove 88*a*, 88*b*, 188*a*, 188*b*, 288*a*, 288*b*, 388*a*, 388*b*, which extends at least substantially parallel to the pane face of the associated glass pane from the lateral front face to the rear face through the respective functional end cap, opens vertically outwards (for instance the sealing element receiving horizontal groove 88*a*, 188*a*, 288*a*, 388*a* of upper functional end caps opens vertically upwards, and the sealing element receiving horizontal groove 88*b*, 188*b*, 288*b*, 388*b* of the lower second end caps 140*b* opens vertically downwardly) and opens laterally outwards in the direction away from the lateral front face and in the direction away from the rear face of the respective functional end cap and in which a sealing element (for example, a sealing lip, a brush, etc.) is received, which sealing element protrudes vertically outwards out of the sealing element receiving horizontal groove in a manner at least substantially parallel to the pane face of the associated glass pane and in the direction away from the associated glass pane (for instance the sealing element of the sealing element receiving horizontal groove 88*a*, 188*a*, 288*a*, 388*a* of the upper functional end cap protrudes vertically upwardly and the sealing element of the sealing element receiving horizontal groove 88*b*, 188*b*, 288*b*, 388*b* of the lower functional end caps 140*b* protrudes vertically downward).

In the closed state of the glass door apparatus 1, the sealing element receiving horizontal grooves of the upper first functional end cap and the upper second functional end cap adjacent to each other and the sealing elements received therein can be aligned with one another and can receive the sealing element receiving horizontal grooves of the lower first and lower second functional end caps, which are adjacent, and the sealing elements received therein are aligned with each other.

In each of the above-described functional end caps, a sealing receiving groove 90*a*, 90*b*, 190*a*, 190*b*, 290*a*, 290*b*, 390*a*, 390*b* can also be formed, which is disposed opposite to the respective sealing element receiving horizontal groove with respect to the pane face of the associated glass pane, extends at least substantially parallel to the pane face of the associated glass pane from the front face to the rear face through the respective functional end cap, opens vertically outwards (for example, the sealing receiving grooves 90*a*, 190*a*, 290*a*, 390*a* of the upper functional end caps open vertically upwards, and the sealing receiving groove 90*b*, 190*b*, 290*b*, 390*b* of the lower first functional end caps open vertically downwards) and opens laterally outwards in the direction away from the front face and in the direction away from the rear face of the respective functional end cap and in which a sealing (for example, a sealing as described in connection with FIGS. 33 to 36) is received, which sealing can include a sealing profile (for instance an extractable (or extendible) sealing lip) which can be extracted (e.g., moved out) from a sealing housing, wherein the glass door apparatus is configured in such a way that the extractable sealing profile can be moved vertically out of the sealing receiving groove in the direction away from the associated glass pane by an extraction (or extension) mechanism (for example, the sealing profile of the sealing in the sealing receiving groove of upper functional end caps can be moved vertically upwards and the sealing profile of sealing in the groove of lower functional end cap can be moved vertically downwards).

The sealing receiving groove 390*a*, 390*b* of the respective second functional end cap 340*a*, 340*b* of the second embodiment may be different from the sealing receiving groove 190*a*, 190*b* of the respective second functional end cap 140*a*, 140*b* of the first embodiment for instance because the respective second functional end cap 340*a*, 340*b* of second embodiment may have a wall portion 392*a*, 392*b*, which at least substantially vertically protrudes into the sealing receiving groove 390*a*, 390*b* and which, in its function and effect, corresponds to a stop portion according to the later aspect of the present invention (see FIGS. 33 to 36 and description thereof).

In the closed state of the glass door apparatus 1, the sealing receiving grooves of the upper first and the upper second functional end cap, which are adjacent to each other, may be aligned with one another, and the extraction mechanism of the associated seals can be actuated such that the extendible sealing profiles of the associated seals are moved out at least substantially vertically upwards; and the sealing receiving grooves of the lower first and lower second functional end caps which are adjacent to each other may be aligned with one another and the extension mechanism of the associated seals can be actuated so that the extractable sealing profiles of the associated seals are moved out at least substantially vertically downwardly.

Figure 31:
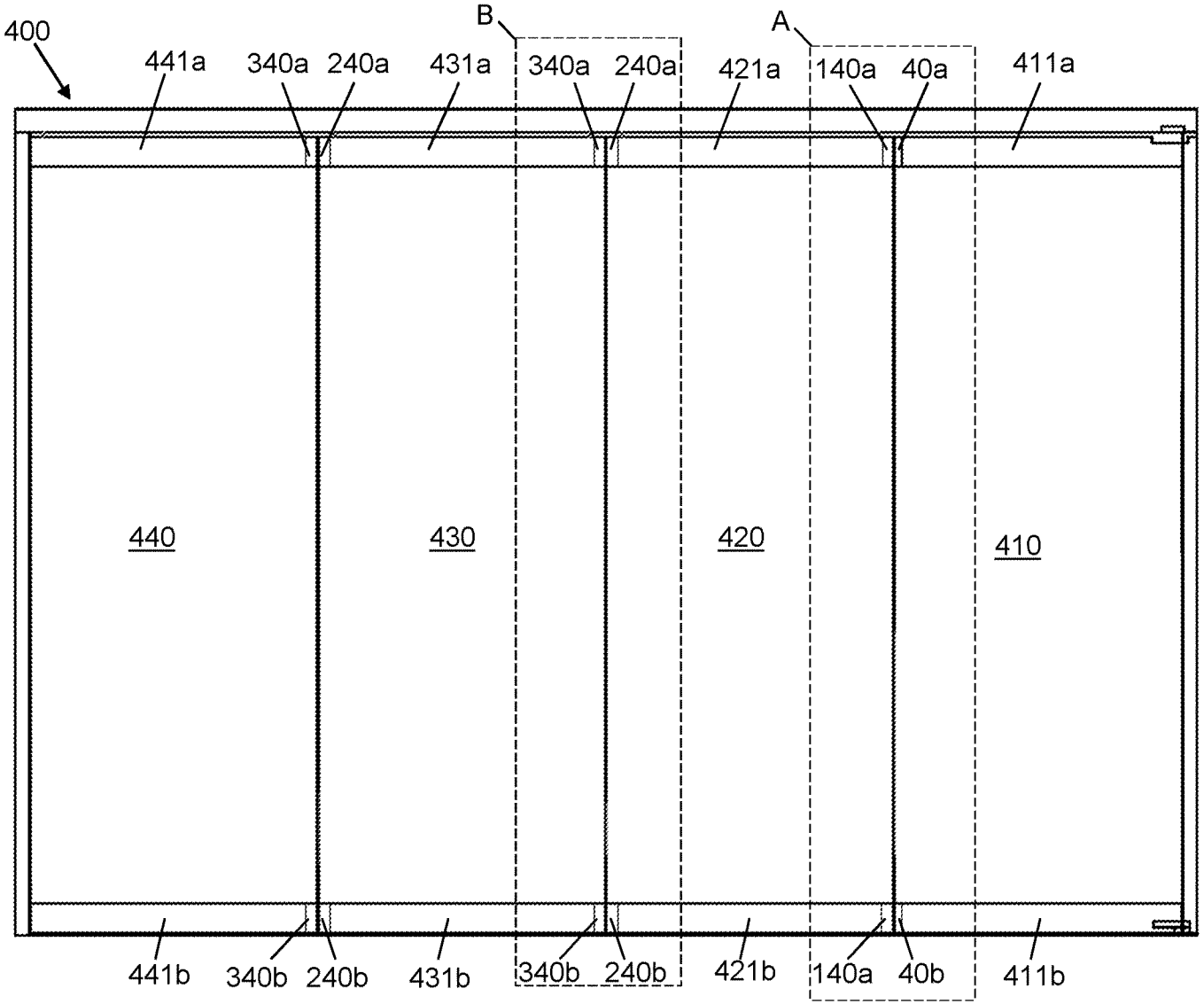
FIG. 31 is a schematic view from an outer area of a glass door apparatus having four glass door leaves in a closed state of the glass door in which a first and second example embodiment of the present invention are provided.
Figure 32:
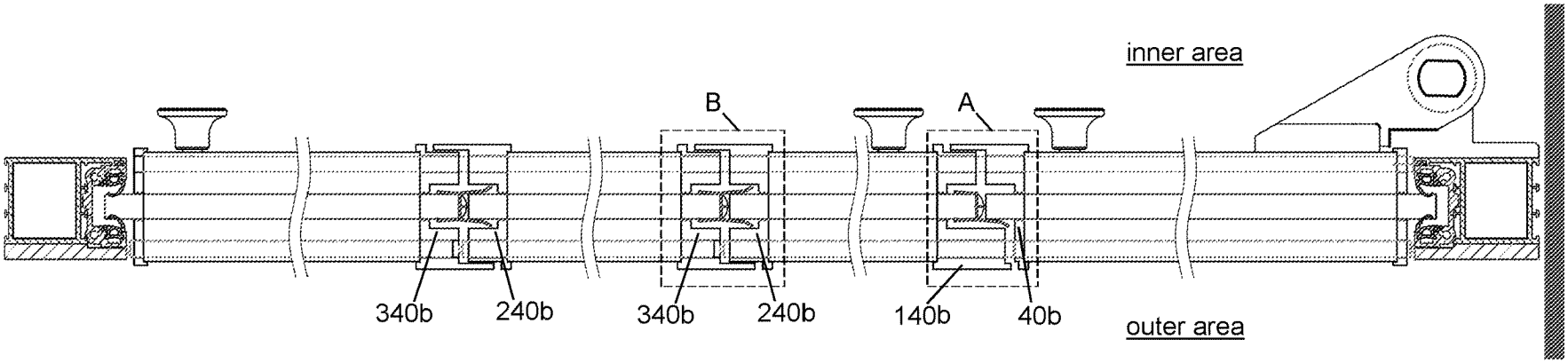
FIG. 32 is a plan view of the glass door with four glass door leaves of FIG. 31.

The elements of the glass door apparatus according to the first and second embodiments (and according to their alternatives) of the present invention can also be provided combined in a glass door apparatus according to the present invention. Such an example glass door apparatus 400 is shown in FIG. 31 and FIG. 32. This apparatus has four glass leaves 410, 420, 430, 440, which delimit an inner region from an outer region and each of which has a glass pane. Further, the glass leaves 410, 420, 430 and 440 each have an upper glass leaf frame part 411*a*, 421*a*, 431*a* and 441*a*, and a lower glass leaf frame part 411*b*, 421*b*, 431*b* and 441*b* which engage, as previously described, the respective glass pane.

In the glass door apparatus 400, the glass door 410 is designed as a rotary leaf which pivots towards the interior, and the glass door leaves 420, 430 and 440 are designed as sliding leaves. In a region A shown in FIGS. 31 and 32, the first embodiment is implemented in its two alternatives. In the region A, the glass door 410 corresponds to a right glass door leaf described with reference to the first embodiment, and the glass door 420 corresponds to a left glass door leaf described with reference to the first embodiment, wherein the glass door 410 includes an upper first functional cap 40*a* and a lower first functional cap 40*b* and the glass door 420 includes an upper second functional cap 140*a* and a lower second functional cap 140*b* according to the first embodiment of the present invention. Further, in a region B shown in FIGS. 31 and 32, the second embodiment is implemented in its two alternatives. In the region B, the glass door 420 corresponds to a right glass door leaf described with reference to the second embodiment, and the glass door leaf 430 corresponds to a left glass door leaf described with reference to the second embodiment, which door leaves comprise a upper first functional cap 240*a* and a upper second functional cap 340*a* as well as a lower first functional cap 240*b* and lower second functional cap 340*b* according to the second embodiment of the present invention. The second embodiment of the present invention is also implemented correspondingly between the glass panes 430 and 440 in the case of the glass door apparatus 400.

It is also possible for a glass door apparatus according to the present invention to have more than four or less than four glass leaves. For example, it is conceivable for the glass door apparatus to have only two or three glass door leaves, but also five, six, seven, eight, etc. glass door leaves. In the embodiment shown by way of example in FIGS. 31 and 32, the glass door leaves 420, 430, 440 are respectively designed as sliding leaves, and the glass door 410 is designed as a rotating leaf. However, the glass door leaves can be designed as a fixed leaf, a sliding leaf, a rotating leaf or a sliding-and-rotating leaf, in accordance with their function as prescribed for the glass door apparatus. For example, the glass leaves 420, 430, 440 can also be sliding-rotating leaves or fixed leaves, and the glass door leaf 410 can also be designed as a rotating leaf. In principle, a plurality of possible embodiments with different combinations of leaf types are conceivable and the invention is not limited to the possibilities described herein.

A different aspect according to the present invention will now be described with reference to FIGS. 33-36, which may be implemented in a glass door apparatus according to the present invention in addition or alternatively to the aspects of the present invention previously described with respect to FIGS. 1 to 32.

When later referring to a respective first and second functional end cap, these functional end caps can at least be substantially similar to the functional end caps shown above in FIGS. 1 to 32. Further, the "top" and "bottom" indications are the same as those shown in FIGS. 1 to 32 according to the present invention.

As shown in FIGS. 33 to 36, a glass door apparatus 500 has a right glass door leaf 510 and a left glass door leaf 600.

The right glass door leaf 510 includes a first glass pane 520 defining a pane face 521 and having a left glass pane edge 522 extending at least substantially vertically, an upper glass pane edge 524 extending at least substantially horizontally and a lower glass pane edge 526, which extends at least substantially horizontally.

The right glass leaf 510 has a upper first glass leaf frame part 530*a* which is engaged with the upper glass pane edge 524 of the first glass pane 520 and a lower first glass leaf frame part 530*b* which is engaged with the lower glass pane edge 526 of the first glass pane 520.

The left glass door leaf 600 has a second glass pane 620 defining a pane face 621 and having a right glass pane edge 622 extending at least substantially vertically and adjacent to the left glass pane edge 522 of the first glass pane 520 in a closed state of the glass door, an upper glass pane edge 624 extending at least substantially horizontally, and a lower glass pane edge 626 extending at least substantially horizontally.

The left glass leaves 600 has a upper second glass leaf frame part 630*a* which is engaged with the upper glass pane edge 624 of the second glass pane 620 and a lower second glass leaves frame part 630*b* which is engaged with the lower glass pane edge 626 of the second glass pane 620.

A first and a second alternative according to the other aspect of the present invention shown in FIGS. 33 to 36 will be described in the following. In a glass door apparatus according to the present invention, either the first or the second alternative of the other aspect of the present invention may be provided. However, both alternatives of the other aspect of the present invention may also be simultaneously provided (i.e., in combination) in a glass door apparatus according to the present invention. In addition, the two alternatives of the other aspect of the present invention can also be provided in combination with the features of the embodiments and configurations described above with reference to FIGS. 1 to 32 in a glass door apparatus according to the present invention.

Figure 33:
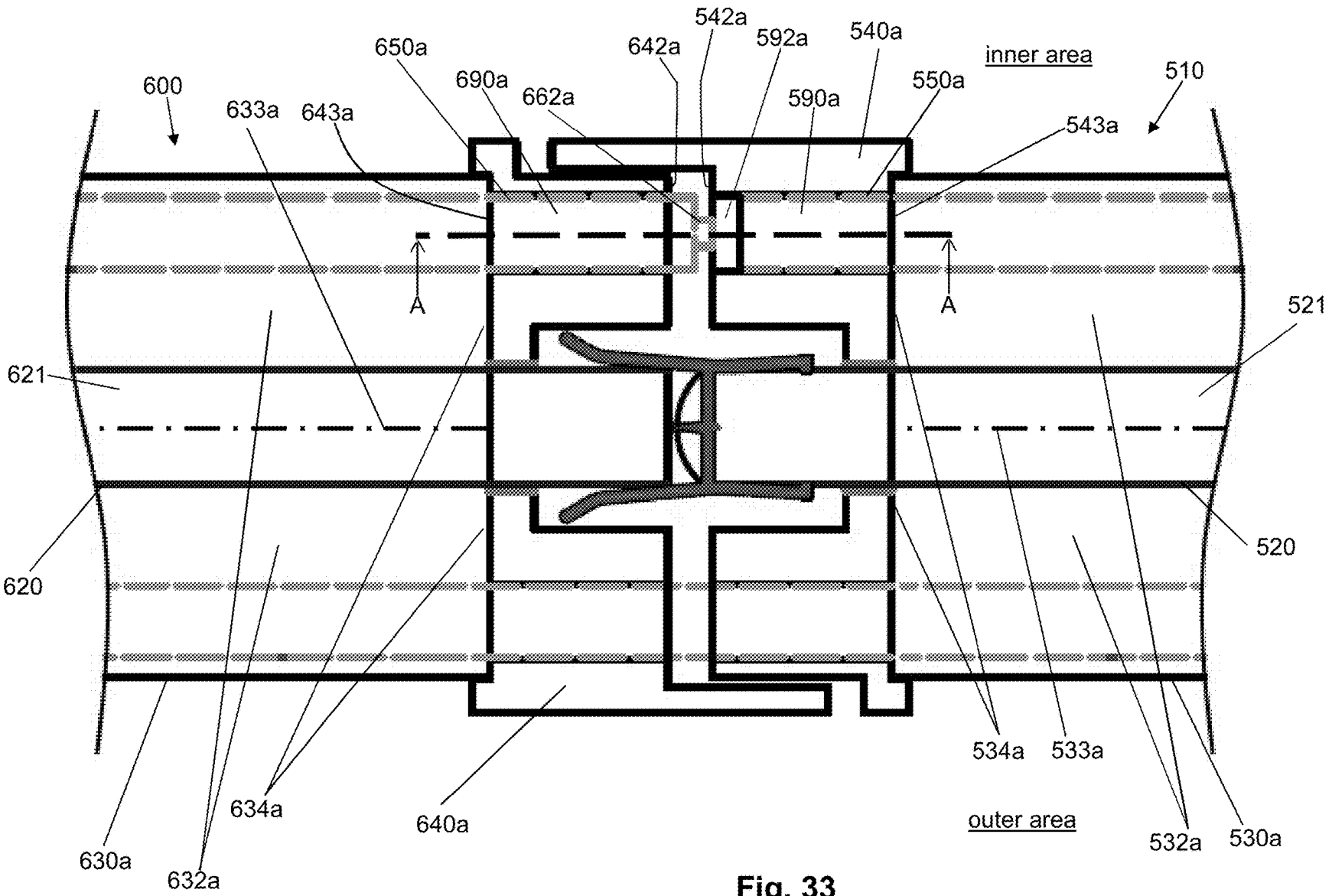
FIG. 33 is a plan view of a glass door apparatus according to a first alternative according to another aspect of the present invention in a closed state of the glass door apparatus.
Figure 34:
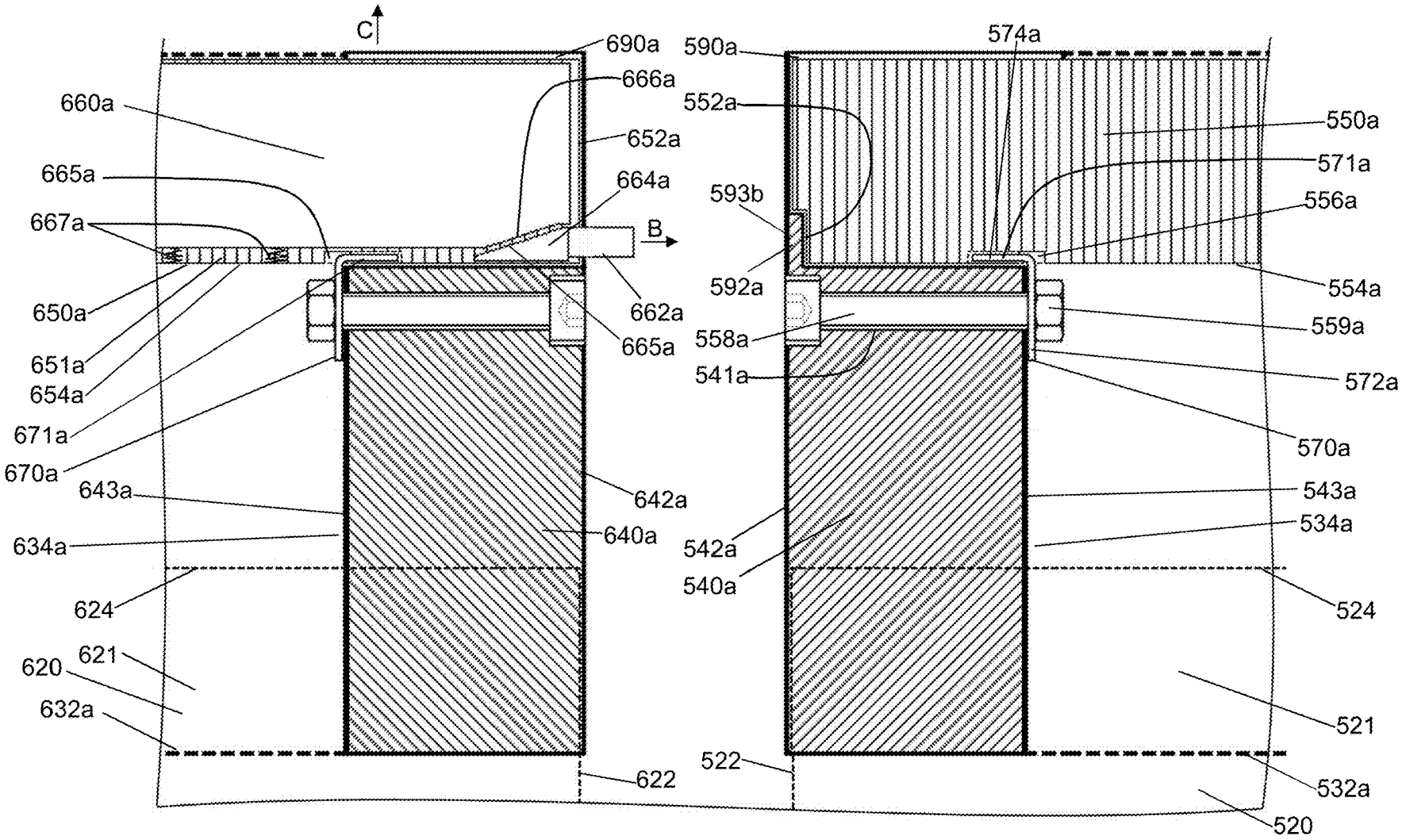
FIG. 34 is a partial sectional view taken along the line A-A in FIG. 33 in an open state of the glass door apparatus.

The first alternative according to the other aspect of the present invention will be described with reference to FIGS. 33 and 34, wherein FIG. 33 is a plan view of a right and a left glass leaf in the closed state of the glass door apparatus, and FIG. 34 is a partial section along the line A-A shown in FIG. 33 in a (partial) open state of the glass door apparatus from an outer area.

The upper first glass leaf frame part 530*a* has an elongated upper first frame body 532*a* defining a longitudinal axis extending with its longitudinal axis along the upper glass pane edge 524 of the first glass pane 520 and having a left frame body longitudinal end 534*a* which is at least substantially similar to the upper first frame body 632*a* previously described for FIGS. 1 to 32.

Further, the upper first glass door frame part 530*a* has a upper first functional end cap 540*a* (which is at least substantially similar to the upper second functional end cap shown in FIGS. 21 to 23) by which the left frame body longitudinal end 534*a* of the upper first frame body 532*a* is covered and which is arranged horizontally at the level of the left glass pane edge 522 of the first glass pane 520.

The upper first functional end cap 540*a* defines a lateral outwardly exposed front face 542*a* and a lateral rear face 543*a* which is spaced apart from the lateral front face 542*a* in the direction toward the left frame body longitudinal end 534*a* of the upper first frame body 532*a* and which is adjacent to the left frame body longitudinal end 534*a* of the upper first frame body 532*a* (wherein, for example, the rear face 543*a* forms the cover of the left frame body end 534*a*).

Furthermore, the upper first functional end cap 540*a* has a sealing receiving groove 590*a* which extends at least substantially parallel to the pane face 521 of the first glass pane 520 from the lateral front face 542*a* to the rear face 543*a* and which opens vertically upwards and which opens laterally outwards in a direction away from the front face and laterally outwards in a direction away from the rear face of the upper first functional end cap 540*a*.

The upper first glass leaf frame part 530*a* further includes an upper first hook element 570*a*, which is attached to the rear face 543*a* of the upper first functional end cap 540 and has a hooking element 571*a*, and an upper first sealing 550*a*, which is at least partly contained in the upper first frame body 532*a* and is at least partially received in the sealing receiving groove 590*a* of the upper first functional end cap 540*a* and which comprises an upper first sealing housing

551*a*, for example of a metal material (for example, aluminum material). The upper first sealing housing 551*a* has a housing front face 552*a* (which is disposed, for example, horizontally at the level of the left glass pane edge 522 of the first glass pane 520 and extends at least substantially parallel to the left glass pane edge 522 of the first glass pane 520) and a lower housing longitudinal wall 554*a*, which extends from the housing front face 552*a* in the direction toward the first glass pane 520 at least substantially parallel to the upper glass pane edge 524 of the first glass pane 520 and extends substantially transversely to the pane face 521 of the first glass pane 520.

Furthermore, the lower housing longitudinal wall 554*a* of the upper first sealing housing 551*a* is recessed (for example, by means of milling) at a position that is spaced apart from the housing front face 552*a* of the upper first sealing housing 551*a* so that the hooking element 571*a* of the upper first hook element 570*a* engages (e.g., reaches or grips under) the lower housing longitudinal wall 554*a* of the upper first sealing housing 551*a* from below and thereby holds the upper first sealing 550*a* on the upper first functional end cap 540*a* (particularly in the at least substantially vertical direction). To this purpose, the lower housing longitudinal wall 554*a* has a hooking element receiving cavity (for example, a milled groove) 556*a*, which is provided therein at a distance from the housing front face 552*a* and into which the hooking element 571*a* of the first hook element 570*a* can engage or engages by reaching or gripping under the housing longitudinal wall 554*a* of the upper first sealing housing 551*a* to thereby hold upper first sealing 550*a* on the upper first functional end cap 540*a*. For example, the hooking element receiving cavity 556*a* is dimensioned in such a way that the hooking element 571*a* can be inserted therein and is at least substantially slidable therein substantially in parallel to the lower housing longitudinal wall 554*a* so that the hooking element 571*a* can reach under and engage the lower housing longitudinal wall 554*a*. The hooking element 571*a* can be attached to the rear face of the rear face 543*a* of the upper first functional end cap 540. For example, the hooking element 571*a* of the upper first hook element 570*a* may be inserted into the hooking element receiving cavity 556*a* so as to extend toward the upper first functional end cap 540*a* and run, for example, in the sealing receiving groove 590*a* of the upper first functional end cap 540*a* (for example, also engages the first functional end cap 540*a* from below). However, it can also be inserted in such a way that it extends from the upper first functional end cap 540*a*. In the state in which the hooking element 571*a* reaches under and engages the lower housing longitudinal wall 554*a*, the upper first hook element 570*a* can also be attached to the rear face 543*a* of the upper first functional end cap 540*a*.

For example, the upper first hook element 570*a*, as shown in FIG. 34, has a (rounded) L shape having a first hook element portion 572*a*, which extends at least substantially vertically to the housing longitudinal wall 554*a* of the upper first sealing housing 551*a* of the upper first sealing 550*a* along the rear face 543*a* of the upper first functional end cap 540*a* and which is connected to the rear face 543*a* of the respective functional end cap 540*a*, and having a second hook element portion 574*a* extending in a transversal direction of the first hook element portion 572*a* from an end of the first hook element portion 574*a*, wherein the hook element 571*a* is formed by the second hook element portion 574*a*.

The first hook element portion 572*a* may be connected, for example, to the rear face 543*a* of the upper first functional end cap 540*a* by means of a screw connection. As shown in FIG. 34, at least one threaded pin or screw bolt 558*a* can extend through a through hole 541*a* (which, for example, corresponds to one of the through-holes 41*a*, 241 of the upper first functional end caps 40*a*, 240*a* previously described in connection with FIGS. 1 to 32) in the upper first functional end cap 540*a*, and the first hook element portion 572*a* may have a screw connection counterpiece 559*a*, preferably a threaded nut 559*a* welded to the first hook element portion 572*a*, for engaging the first hook element portion 572*a* by engagement between the threads of the thread pin 558*a* and the nut 559*a* at the rear face 543*a* of the upper first functional end cap 540*a*. However, it may also be provided that the first hook element section 572*a* has holes which each have an internal thread which is complementary to the thread of the threaded pin 558*a* to be inserted therein, so that no nuts are required.

However, the upper first hook element 570*a* may also have other shapes and may also be connected in other ways to the rear face 543*a* of the upper first functional end cap 540*a*, for example by welding, gluing, etc. The upper first hook element 570*a* may be made of any material, for example a plastic material, or a metal material (for example, steel, iron, aluminum, or alloys thereof).

The upper first functional end cap 540*a* also has a stop portion 592*a* protruding into the sealing receiving groove 590*a* (for example, integrally formed therefrom), against which an actuating pin, still to be described, of an extractable (or extendible) sealing of the left glass door leaf 600 abuts. For example, as shown in FIG. 34, the stop portion 592*a* is formed by a wall portion of the upper first functional end cap 540*a*, which wall portion has a laterally outwardly exposed stop face 593*a* which is part of the lateral front face 542*a* of the upper first functional end cap 540*a*. The housing front face 552*a* of the upper first sealing housing 551*a* is at least partially overlapped by the abutment portion 592*a* of the upper first functional end cap 540*a*. As shown in FIG. 34, the abutment portion 592*a* extends as a wall portion of the upper first functional end cap 540*a* at least over a portion of the housing front face 552*a* of the upper first sealing housing 551*a*, which portion of the housing front face 552*a* is offset in a manner at least substantially parallel to the pane face 521 of the first glass pane 520 as well as in a direction toward the first glass pane 520. For example, by the offset portion of the housing front face 552*a*, a (for example, right angled) shoulder is formed on the housing front face 552*a*. The upper first sealing housing 551*a* may for example abut with the shoulder against the stop portion 592*a*.

Furthermore, the upper second glass door leaf frame part 630*a* has an elongated upper second frame body 632*a* defining a longitudinal axis 633*a* extending with its longitudinal axis 633*a* along the upper glass pane edge 624 of the second glass pane 620 and having a right frame body longitudinal end 634*a*.

The upper second glass door leaf frame part 630*a* also has a upper second sealing 650*a* designed as an extractable seal, which is received at least partially in the upper second frame body 632*a*. The upper second sealing 650*a* has an upper second sealing housing 651*a* which has a housing front face 652*a* (for example, at least substantially parallel to the right glass pane edge 622 of the second glass pane 620) and has an upper housing longitudinal wall 654*a* which extends from the housing front face 652*a* in the direction to the second glass pane 620 at least substantially parallel to the upper glass pane edge 624 of the second glass pane 620 and which extends at least substantially transversely to the pane face 621 of the second glass pane 620. The upper second sealing

650*a* also has an extractable sealing profile 660*a* (for example, an extractable sealing lip) which, in a non-extracted state, is housed in the upper second sealing housing 651*a* and is at least substantially vertically extended from the upper second sealing housing 651*a* (in the arrow direction C shown in FIG. 34) against a resilient reaction force applied by resetting means 667*a*.

The upper second sealing 650*a* also has an actuating pin 662*a* which protrudes outwards (in the direction of the first glass pane of the right glass door) with respect to the housing front face 652*a* of the upper second sealing housing 651*a* and which is movably configured (e.g., through the housing front face 652*a* of the upper second sealing housing 651*a* into the upper second sealing housing 651*a*) in such a way as to effect, in the course of its displacement, an at least substantially vertical extraction of the extractable sealing profile 660*a* of the upper second sealing 650*a* upwards against the elastic restoring force. In the case of a closing operation of the glass door apparatus, the two glass door leaves 510 and 600 move relative to one another (for example, the left glass door leaf moves towards the right glass door leaf, as indicated by the arrow direction B in FIG. 34 or the right glass door leaf moves towards the left glass door panel), and before the closing operation is completed, the actuating pin 662*a* of the upper second sealing 650*a* abuts against the abutment portion 592*a* formed by the upper first functional cap. When the closing operation is finally completed, the actuating pin 662*a* is pressed against the stop portion 592*a* against the arrow direction B into the upper second sealing housing 651*a*, which causes the extractable sealing profile 660*a* of the upper second sealing 650*a* to be extended upwards.

FIG. 34 schematically shows an example extraction mechanism through which the actuating pin 662*a* can effect an extraction of the sealing profile 660*a* upwards, the present invention not being limited to this example. In FIG. 34, a wedge element 664*a* having an inclination is received in the upper second sealing housing 651*a*, is fixedly connected to the actuating pin 662*a*, and is displaceable in the upper second sealing housing 651*a* in a manner at least substantially parallel to the housing longitudinal wall 654*a* of the upper second sealing housing 651*a*. If the actuating pin 662*a* is pushed into the upper second sealing housing 651*a* in a direction opposite to the arrow direction B shown in FIG. 34, the wedge element 664*a* moves together with the actuating pin 662*a*, and the inclination 665*a* of the wedge element 664*a* comes into abutment against an associated bevel 666*a* of the sealing profile 660*a* and pushes, by the interaction of the inclination 665*a* and the bevel 666*a* and against the restoring force of the restoring means 667*a* (as resetting springs shown in FIG. 34), the sealing profile 660*a* upwards so that the sealing profile 660*a* is extended upwards from the upper second sealing housing 651*a*. When the left and right glass doors are moved away from one another again, and the glass door opens in the open state shown in FIG. 34, the restoring means 667*a* cause the upwardly extended sealing profile 660*a* to be at least substantially vertically moved into the upper second sealing housing, so that, by interaction of both the inclination 665*a* and the bevel 666*a*, the actuating pin 662 is moved in the direction B again out of the upper second sealing housing 651*a* and the extraction mechanism is ready for a new actuation.

As also shown in FIG. 34, the upper second glass leaf frame element 630*a* may have an upper second functional end cap 640*a* covered by the right frame body longitudinal end 634*a* of the upper second frame body 632*a* and horizontally aligned with the right glass pane edge 622 of the second glass pane 620. The upper second functional end cap 640*a* defines a lateral, externally exposed front face 642*a*, which, in a closed state of the glass door apparatus, becomes the front face 542*a* of the opposing upper first functional end cap 542*a*, and a side rear face 643*a* which is spaced apart from the lateral front face 642*a* in a direction toward the right frame body longitudinal end 634*a* of the upper second frame body 632*a* and which is adjacent to the right frame body longitudinal end 634*a* of the upper second frame body 632*a* (wherein, for example, the rear face 643*a* forms the cover of the right frame body longitudinal end 634*a*).

Further, the upper second functional end cap 640*a* has a sealing receiving groove 690*a*, which extends at least substantially parallel to the pane face 621 of the second glass pane 620 from the lateral front face 642*a* of the upper second functional end cap 640*a* to the rear face 643*a* of the upper second functional end cap 640*a* and which opens vertically upwards and opens laterally outwardly in a direction away from the lateral front face 642*a* of the upper second functional end cap 640*a*, and a direction away from the rear face 643*a* of the upper second functional end cap 640*a*, wherein the upper second sealing 650*a* is partially received in the sealing receiving groove 690*a*. The upper second sealing 560*a* can be at least partially received in the upper second frame body 632*a* and at least partially received in the sealing receiving groove 690*a* of the upper second functional end cap 640*a*. For example, the sealing front face 652*a* of the upper second sealing 650*a* is received in its entirety in the sealing receiving groove 690*a* of the upper second functional end cap 640*a*.

The upper second glass door leaf element 630*a* may further include a upper second hook element 670*a* which is mounted on the rear face 643*a* of the upper second functional end cap 640*a* and has a hooking element 671*a*, wherein the housing longitudinal wall 654*a* of the upper second sealing housing 651*a* includes a hooking element receiving cavity 656*a* which is provided therein spaced apart from the housing front face 652*a* and into which the second hooking element 670*a* can engage or engages by reaching or gripping under the housing longitudinal wall 654*a* to thereby hold the upper second sealing 650*a* on the upper second functional end cap 640*a*. The interaction of the upper second hook element 670*a* with the upper second sealing 650*a*, as well as the shape and operation of the upper second hook element 670*a* and the hooking element receiving cavity 656*a* are at least substantially the same as those of the upper first hook element 570*a* and the hooking element receiving cavity 556*a*, so that a detailed description thereof is omitted.

Figure 35:
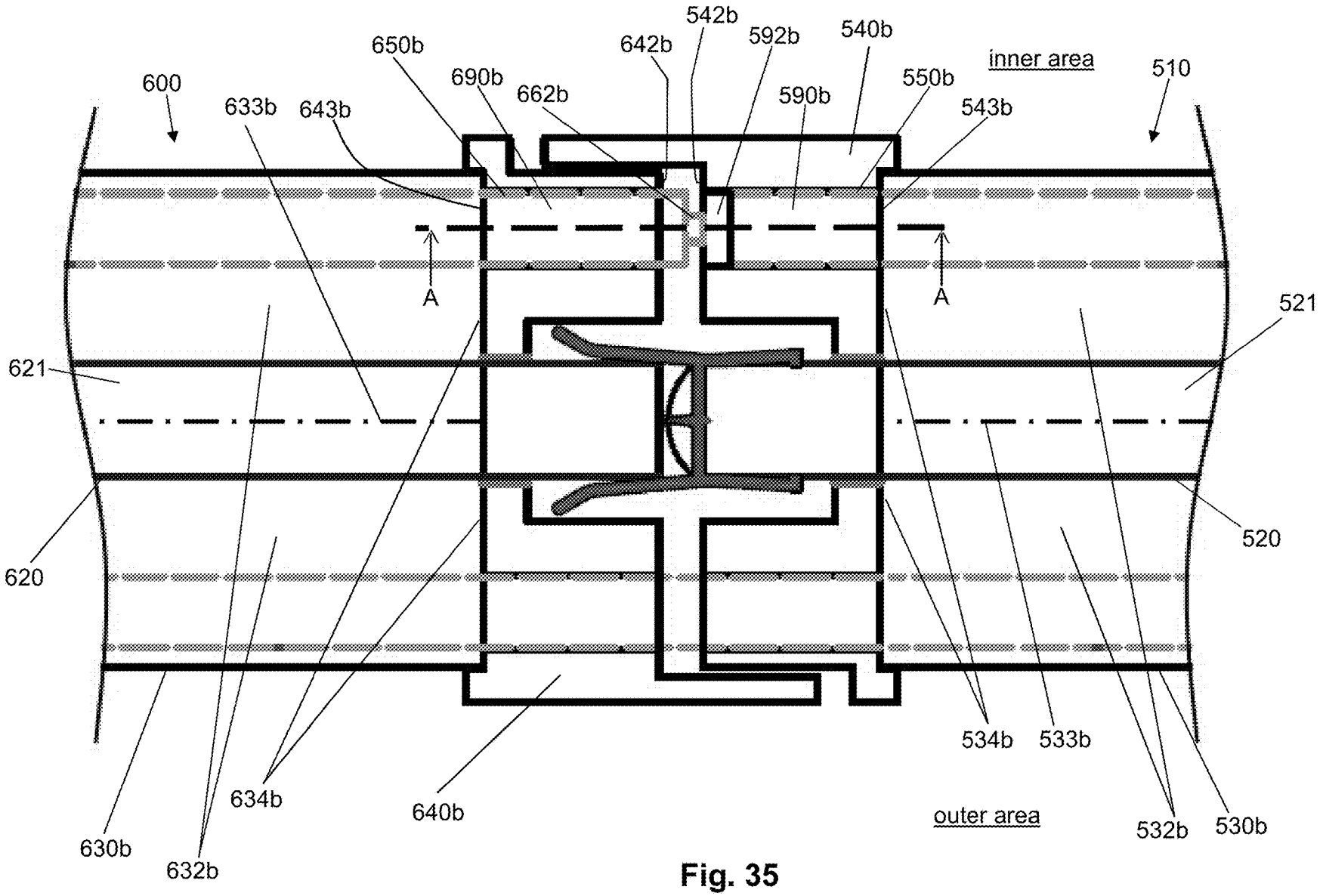
FIG. 35 is a plan view of a glass door apparatus according to a second alternative according to another aspect of the present invention in a closed state of the glass door apparatus.
Figure 36:
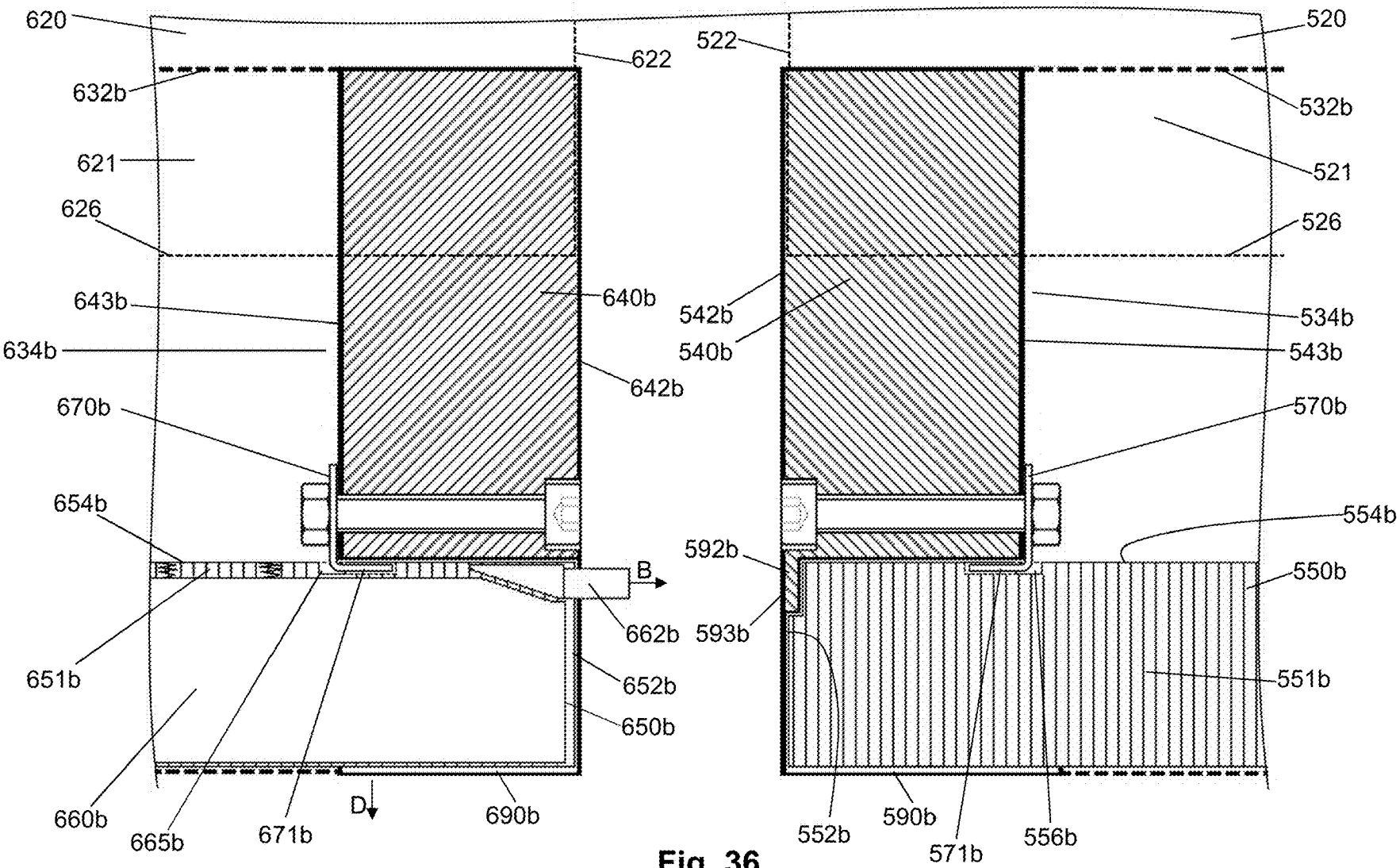
FIG. 36 is a partial sectional view taken along line A-A in FIG. 35 in an open state of the glass door apparatus.

In the following, the second alternative according to the other aspect of the present invention will be described with reference to FIGS. 35 and 36, wherein FIG. 35 is a plan view of right and left glass door leaves in the closed state of the glass door, and wherein FIG. 36 is a partial sectional view along the line A-A shown in FIG. 35, in a (partial) open state of the glass door apparatus from an outer area.

The lower first glass leaf frame part 530*b* has an elongate lower first frame body 532*b* defining a longitudinal axis extending along its lower glass pane edge 526 of the first glass pane 520 along its lower glass pane edge 526 and having a left frame body longitudinal end 534*b* which is at least substantially similar to the lower first frame body 632*b* previously described in FIGS. 1 to 32.

Figure 30:
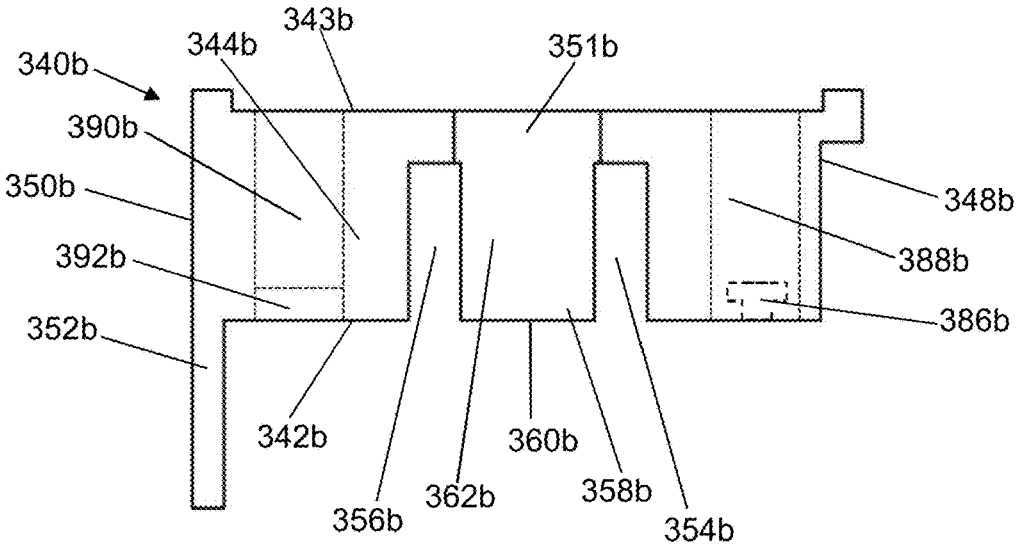

Furthermore, the lower first glass door frame part 530*b* has a lower first functional end cap 540*b* (which is formed, for example, at least substantially as the lower second functional end cap shown in FIGS. 28 to 30) by which the left frame body longitudinal end 534*b* of the lower first frame body 532*b* is covered and which is arranged horizontally at the level of the left glass pane edge 522 of the first glass pane 520.

The lower first functional end cap 540*b* defines a lateral outwardly exposed front face 542*b* and a lateral rear face 543*b* which is spaced from the lateral front face 542*b* toward the left frame body longitudinal end 534*b* of the lower first frame body 532*b* and which is adjacent to the left frame body longitudinal end 534*b* of the lower first frame body 532*b* (wherein for instance the rear face 543*b* forms the cover of the left frame body longitudinal end 534*b*).

Furthermore, the lower first functional end cap 540*b* has a sealing receiving groove 590*b*, extending at least substantially parallel to the pane face 521 of the first glass pane 520 from the lateral front face 542*b* to the rear face 543*b* and opening vertically downwards as well as opening in the direction away from the lateral front face and away from the rear face of the lower first functional end cap 540*b*.

The lower first glass door frame part 530*b* also has a lower first hook element 570*b*, which is fixed to the rear face 543*b* of the lower first functional end cap 540 and has a hooking element 571*b*, and has a lower first sealing 550*b* which is at least partially housed in the lower first frame body 532*b* and is at least partially received in the sealing receiving groove 590*b* of the lower first functional end cap 540*b* and which has a lower first sealing housing 551*b*, for example of a metal material (for example, of aluminum material). The lower first sealing housing 551*b* has a housing front face 552*b* horizontally disposed at the level of the left glass pane edge 522 of the first glass pane 520 and extending at least substantially parallel to the left glass pane edge 522 of the first glass pane 520, and has an upper housing longitudinal wall 554*b* extending from the housing front face 552*b* in the direction toward the first glass pane 520 at least substantially parallel to the lower glass pane edge 526 of the first glass pane 520.

The upper housing longitudinal wall 554*b* of the lower first sealing housing 551*b* is recessed at a position that is spaced apart from the housing front face 552*b* of the lower first sealing housing 551*b* so that the hooking element 571*b* of the lower first hook element 570*b* engages (e.g., by reaching under) the upper housing longitudinal wall 554*b* of the lower first sealing housing 551*b* from below and thereby the lower first sealing 550*b* is held on the lower first functional end cap 540*b* (in particular in the vertical direction). For this purpose, the upper housing longitudinal wall 554*b* has a hooking element receiving cavity (for instance a milled groove) 556*b*, which is provided therein at a distance from in the housing lateral face 552*b* and into which the hooking element 571*b* of the first hook element 570*b* can engage or engages by reaching or gripping under the housing longitudinal wall 554*b* of the lower first sealing housing 551*b* to thereby hold the lower first sealing 550*b* on the lower first functional end cap 540*a*. The hooking element receiving cavity 556*b* may be dimensioned in the same manner as the hooking element receiving cavity 556*a*. Further, the hooking element 571*b* of the lower first hook element 570*b* can be inserted into the hooking element receiving cavity 556*b* in the same different manner as the hooking element 571*a* of the upper first hook element 570*a*. The lower first hook element 570*b* may further be formed in an analogous manner to the upper first hook element 570*a*, and similarly to the upper first hook element 570*a* may be connected to the rear face 543*a* of the upper first functional end cap 540*a*, so that a detailed description thereof will be omitted.

The lower first functional end cap 540*b* also has a stop portion 592*b* protruding into the sealing receiving groove 590*b*, against which an actuating pin, which is still to be described, of an extractable seal of the left glass door leaf 600 abuts. In FIG. 36, the stop portion 592*b* is formed by a wall portion of the lower first functional end cap 540*b* having a lateral outwardly exposed abutment face 593*b* which is part of the lateral front face 542*b* of the lower first functional end cap 540*b*. The housing front face 552*b* of the lower first sealing housing 551*b* is at least partially overlapped by the stop portion 592*b* of the lower first functional end cap 540*b*. As shown in FIG. 36, the stop portion 592*b* extends as a wall portion of the lower first functional end cap 540*b* at least over a portion of the lower first sealing housing 552*b* of lower first sealing housing 551*b*, which portion is offset in a manner at least substantially parallel to the pane face 521 of the first glass pane 520 as well as in a direction toward the first glass pane 520. By the offset portion of the housing front face 552*b*, a (for example, right angled) shoulder is formed on the housing front face 552*b*. The lower first sealing housing 551*b* may abut, for example, with the shoulder against the stop portion 592*b*.

Further, the lower second glass door leaf frame part 630*b* has an elongated lower second frame body 632*b* defining a longitudinal axis 633*b* extending with its longitudinal axis 633*b* along the lower glass pane edge 626 of the second glass pane 620 and having a right frame body longitudinal end 634*b*.

The lower second glass door leaf frame part 630*b* also has a lower second sealing 650*b* formed as an extractable seal, which sealing 650*b* is at least partially received in the lower second frame body 632*b*. The lower second sealing 650*b* has a lower second sealing housing 651*b*, which has a housing front face 652*b* (for example, at least substantially parallel to the right glass pane edge 622 of the second glass pane 620) and has an upper housing longitudinal wall 654*b* which extends from the housing front face 652*b* in the direction to the second glass pane 620 at least substantially parallel to the lower glass pane edge 626 of the second glass pane 620 and which extends substantially transversely to the pane face 621 of the second glass pane 620. The lower second sealing 650*b* also has an extractable sealing profile 660*b* (for example, an extractable sealing lip) which, in a non-extracted (or non-deployed) state, is received in the lower second sealing housing 651*b* and which can be moved at least substantially vertically upwards out of the lower second sealing housing 651*b* (in the direction of arrow D shown in FIG. 36) against an elastic restoring force.

The lower second sealing 650*b* also has an actuating pin 662*b* which protrudes outwards (for example in the direction of the first glass pane of the right glass door) with respect to the housing front face 652*b* of the lower second sealing housing 651*b* and which is movably configured (for example through the housing front face 652*b* of the lower second sealing housing 651*b* into the lower second sealing housing 651*b*) in such a way as to effect, in the course of its displacement, at least a substantially vertical extraction of the extractable sealing profile 660*b* of the lower second sealing 650*b* downwards against the elastic restoring force. The cooperation of the extractable sealing profile 660*b* and the actuating pin 662*b* of the lower second sealing 650*b* and the operation of the extraction mechanism are at least substantially analogous to the interaction of the extractable sealing profile 660*a* and the actuating pin 662*a* of the upper second sealing 650*a* and the functional of the extraction mechanism described (see FIG. 34), so that a detailed description thereof is omitted.

As shown in FIG. 36, the lower second glass leaves frame element 630*b* may have a lower second functional end cap 640*b* by which the right frame body longitudinal end 634*b* of the lower second frame body 632*b* is covered and which is horizontally positioned at the level of the right glass pane edge 622 of the second glass pane 620. The lower second functional end cap 640*b* defines a lateral outwardly exposed front face 642*b* which, in a closed state of the glass door apparatus, is adjacent to the lateral front face 542*b* of the opposing lower first functional end cap 542*b*, and defines a lateral rear face 643*b* which is spaced apart from the lateral front face 642*b* in the direction of the right frame body longitudinal end 634*b* of the lower second frame body 632*b* and is adjacent to the right frame body longitudinal end 634*b* of the lower second frame body 632*b* (wherein for example, the rear face 643*b* forms the cover of the right frame body longitudinal end 634*b*).

Further, the lower second functional end cap 640*b* has an sealing receiving groove 690*b* which extends at least substantially parallel to the pane face 621 of the second glass pane 620 from the lateral front face 642*b* of the lower second functional end cap 640*b* to the rear face 643*b* of the lower second functional end cap 640*b* and which opens vertically downwards and opens in the direction away from lateral front face 642*b* and the direction away from the rear face 643*b* of the lower second functional end cap 640*b*, wherein the lower second sealing 650*b* is partially received in the sealing receiving groove 690*b*. The lower second sealing 560*b* can be at least partially received in the lower second frame body 632*b* and can be at least partially received in the sealing receiving groove 690*b* of the lower second functional end cap 640*b*. For example, in particular, the sealing face 652*b* of the lower second sealing 650*b* is received in its entirety in the sealing receiving groove 690*b* of the lower second functional end cap 640*b*.

The lower second glass door frame element 630*b* may further include a lower second hook element 670*b* which is attached to the rear face 643*b* of the lower second functional end cap 640*b* and includes a hooking element 671*b*, wherein the housing longitudinal wall 654*b* of the lower second sealing housing 651*b* includes a hooking element receiving groove 656*b* which is provided therein spaced apart from the housing front face 652*b* of the lower second sealing housing 651*b*, so that the hook element 671*b* of the lower second hook element 670*b* engages (e.g., by reaching or gripping under) the housing longitudinal wall 654*b* of the lower second sealing housing 651*b*, and thereby the lower second sealing 650*b* is held on the lower second functional end cap 640*b*. The cooperation of the lower second hook element 670*b* with the lower second sealing 650*b* as well as the shape and operation of the lower second hook element 670*b* are at least substantially the same as those of the lower first hook element 570*a*, so that a detailed description thereof will be omitted.

The two alternatives of the other aspect of the present invention shown in FIGS. 33 to 36 can also be realized in a mirror image manner, in a similar manner, whereby the stop portion is formed on the left glass door, and the actuating pin of the extractable seal is provided on the right glass door leaf. Such a realization is for example shown in FIGS. 16 to 30, in which the upper and lower second functional end caps 340*a*, 340*b* of the left glass door leaf 100 have a wall portion 392*a*, 392*b*, which is constructed as shown in FIGS. 33 to 36.

Both in the first alternative as well as in the second alternative of the glass door apparatus according to the other aspect of the present invention, the respective first sealing 540*a*, 540*b* can be designed analogously to the respective second sealing as an extractable sealing. In the case of a glass door apparatus with more than two glass door leaves, for example with the exception of the outermost left and outermost right glass leaves, each glass door leaf is formed on its right side like the above-described left glass leaf 600, and on its left side like the right glass leaf 500 described above, wherein the outermost right glass leaf may be provided as the above said right leaf 600 only on its left side, and the outermost left glass door leaf can be formed only on its right side as the above-described left glass door leaf 600. It goes without saying that such a configuration is also possible in a correspondingly reversed manner (i.e., left to right, right to left).

According to the other aspect of the present invention, the durability and reliability of a glass door apparatus according to the other aspect of the present invention can be improved by forming an abutment portion so that an actuating pin of an extractable sealing of a second functional end cap does not abut against a front face of a first sealing opposite the actuating pin of first functional end cap, so that damage to the first sealing of the first functional end cap can be prevented. In particular, the use of the other aspect of the present invention is advantageous in the case of glass door leaves, of which at least one is designed as a sliding leaf or a rotary-sliding leaf, and their adjoining glass panes are moved toward each other by a sliding movement.

The functional end caps described throughout this application may be made, for example, of a plastic material and/or a metal material, such as an aluminum material. For example, the above-described functional end caps can be formed as a single piece (for example, from a single block of material). The functional end caps may be formed in various ways, for example by means of casting (for example, by injection molding) or extrusion, the manufacturing techniques not being limited to the foregoing. However, the functional end caps and/or individual elements thereof can also be produced by means of milling, drilling, etc. However, the functional end caps can also be composed of several parts, these parts being for example screwed together, welded, soldered and/or glued, etc. The frame bodies described throughout this application may be made, for example, of a plastic material and/or a metal material, such as an aluminum material (e.g., extruded aluminum).

According to the present invention a glass door apparatus is provided, wherein, according to one aspect, improved acoustic insulation, humidity and wind insulation characteristics are achieved, thereby providing a protection against noise, humidity (for instance pounding rain) and wind or currents, wherein according to another aspect, an improved durability and reliability of glass door apparatus are achieved.

The invention claimed is:

1. A glass door apparatus, comprising:

a right glass door leaf (10), which includes a first glass pane (20) having a pane face (21) and which has a left glass pane edge (22), which extends at least substantially vertically; an upper glass pane edge (24), which extends at least substantially horizontally; and a lower glass pane edge (26), which extends at least substantially horizontally;

an upper first glass door leaf frame part (30*a*), which engages the upper glass pane edge (24) of the first glass pane (20); and a lower first glass door leaf frame part (30*b*), which engages the lower glass pane edge (26) of the first glass pane (20), and a left glass door leaf (100), which includes a second glass pane (120) having a pane face (121) and which has a right glass pane edge (122), which extends at least substantially vertically and which, in a closed state of the glass door apparatus, is near the left glass pane edge (22) of the first glass pane (20), wherein the second glass pane further has an upper glass pane edge (124), which extends at least substantially horizontally, and a lower glass pane edge (126), which extends at least substantially horizontally;

wherein at least one of the upper first glass door leaf frame part (30*a*) and the lower first glass door leaf frame part (30*b*) has a first oblong frame body (32*a*, 32*b*), which defines a longitudinal axis (33*a*, 33*b*), extends with the longitudinal axis (33*a*, 33*b*) of the first oblong frame body (32*a*, 32*b*) along the glass pane edge belonging to the respective glass door leaf frame part of the upper and lower glass pane edges (24, 26) of the first glass pane (20) and has a left frame body longitudinal end (34*a*, 34*b*), and a first functional end cap (40*a*, 40*b*, 240*a*, 240*b*), by which the left frame body longitudinal end (34*a*, 34*b*) of the first frame body is covered and which is horizontally positioned at the level of the left glass pane edge (22) of the first glass pane (20), defines a lateral outwardly exposed front face (42*a*, 42*b*; 242*a*, 242*b*), and has at least one of (a) a first protrusion (52*a*, 52*b*; 252*a*, 252*b*), which, with respect to the lateral front face (42*a*, 42*b*; 242*a*, 242*b*) of the first functional end cap (40*a*, 40*b*; 240*a*, 240*b*), protrudes laterally outwards in a manner at least substantially parallel to the pane face (21) of the first glass pane (20) as well as in a direction away from the first glass pane (20), and (b) a first cavity (54*a*, 54*b*; 254*a*, 254*b*) which, with respect to the lateral front face (42*a*, 42*b*; 242*a*, 242*b*) of the first functional end cap (40*a*, 40*b*; 240*a*, 240*b*), protrudes laterally inwardly in a manner at least substantially parallel to the pane face (21) and in a direction towards the first glass pane (20) and which, in the opposite direction, opens laterally outwardly; and wherein, in the closed state of the glass door apparatus, the at least one of the first protrusion (52*a*, 52*b*; 252*a*, 252*b*) and the first cavity (54*a*, 54*b*; 254*a*, 254*b*) of the first functional end cap (40*a*, 40*b*; 240*a*, 240*b*) is overlapped with a respectively corresponding complementary counterpiece of the left glass door leaf (100), the left glass door leaf (100) has an oblong weather strip (170; 370), which defines a weather strip longitudinal axis and which is positioned on the right glass pane edge of the second glass pane and which extends with the weather strip longitudinal axis along the right glass pane edge (122) of the second glass pane (120) and which has a profile cross-section with a first leg (172; 372), which extends at least substantially from the right glass pane edge (122) of the second glass pane (120) in a manner at least substantially parallel to the pane face (121) of the second glass pane (120) and laterally away from the second glass pane (120) so that, in the closed state of the glass door apparatus, the first leg (172; 372) overlaps the left glass pane edge (22) of the first glass pane (20) and engages, while forming a corresponding complementary counterpiece of the left glass door leaf, the first cavity (54*a*, 54*b*; 254*a*, 254*b*) of the respective first functional end cap (40*a*, 40*b*; 240*a*, 240*b*), and the weather strip (170) has an h-profile cross-section comprising a central transverse web (174), which has a first transverse web end and a second transverse web end (175, 176), wherein the first leg (172) extends from the first transverse web end (175); a second leg (178), which extends from the first transverse web end (175) opposite to the first leg (172) and overlaps the right glass pane edge (122) of the second glass pane (120); and a third leg (180), which extends from the second transverse web end (176) in the same direction of the second leg (178) and overlaps the right glass pane edge (122) of the second glass pane (120).

2. The glass door apparatus of claim 1, wherein the upper first glass door leaf frame part (30*a*) has a first oblong upper frame body (32*a*), which defines a longitudinal axis (33*a*), extends with the longitudinal axis (33*a*) of the first oblong upper frame body (32*a*) along the upper glass pane edge (24) of first glass pane (20) and has a left frame body longitudinal end (34*a*), and an upper first functional end cap (40*a*; 240*a*), by which the left frame body longitudinal end (34*a*) of the upper first frame body (32*a*) is covered and which is horizontally positioned at the level of the left glass pane edge (22) of the first glass pane (20), defines a lateral outwardly exposed front face (42*a*, 242*a*), and has at least one of (a) a first protrusion (52*a*, 252*a*), which, with respect to the lateral front face (42*a*, 242*a*) of the upper first functional end cap (40*a*, 240*a*), protrudes laterally outwards in a manner at least substantially parallel to the pane face (21) of the first glass pane (20) as well as in a direction away from the first glass pane (20), and (b) a first cavity (54*a*, 254*a*) which, with respect to the lateral front face (42*a*, 242*a*) of the upper first functional end cap (40*a*, 240*a*), protrudes laterally inwardly in a manner at least substantially parallel to the pane face (21) and in a direction towards the first glass pane (20) and which, in the opposite direction, opens laterally outwardly, and the lower first glass door leaf frame part (30*b*) has a first oblong lower frame body (32*b*), which defines a longitudinal axis (33*b*), extends, with the longitudinal axis (33*b*) of the first oblong lower frame body (32*b*) along the lower glass pane edge (24) of the first glass pane (20) and has a left frame body longitudinal end (34*b*), and a lower first functional end cap (40*b*; 240*b*), by which the left frame body longitudinal end (34*b*) of the lower first frame body (32*b*) is covered and which is horizontally positioned at the level of the left glass pane edge (22) of the first glass pane (20), defines a lateral outwardly exposed front face (42*b*, 242*b*), and has at least one of (a) a first protrusion (52*b*, 252*b*), which, with respect to the lateral front (42*b*, 242*b*) of the lower first functional end cap (40*b*, 240*b*), protrudes laterally outwards in a manner at least substantially parallel to the pane face (21) of the first glass pane (20) as well as in a direction away from the first glass pane (20), and (b) a first cavity (54*b*, 254*b*) which, with respect to the lateral front (42*b*, 242*b*) of the lower first functional end cap (40*b*, 240*b*), protrudes laterally inwardly in a manner at least substantially parallel to the pane face (21) and in a direction towards the first glass pane (20) and which, in the opposite direction, opens laterally outwardly; and wherein, in the closed state of the glass door apparatus, the at least one of the first protrusion (52*a*, 52*b*; 252*a*, 252*b*) and the first cavity (54*a*, 54*b*; 254*a*, 254*b*) of the respective first functional end cap (40*a*, 40*b*; 240*a*, 240*b*) is/arc is overlapped with a respectively corresponding complementary counterpiece of the left glass door leaf (100).

3. The glass door apparatus of claim 2, wherein the left glass door leaf (100) further has an upper second glass door leaf frame part (130*a*), which engages the upper glass pane edge (124) of second glass pane (120), and wherein the upper second glass door leaf frame part (130*a*) has an oblong upper second frame body (132*a*), which defines a longitudinal axis (133*a*), extends with the longitudinal axis (133*a*) of the oblong upper second frame body (132*a*) along the upper glass pane edge (124) of the second glass pane (120) and has a right frame body longitudinal end (134*a*), and an upper second functional end cap (140*a*, 340*a*), by which the right frame body longitudinal end (134*a*) of the upper second frame body (132*a*) is covered and which is horizontally positioned at the level of the right glass pane edge (122) of the second glass pane (120), defines a lateral outwardly exposed front face (142*a*; 342*a*), which, in a closed state of glass door apparatus, is near the lateral front face (42*a*; 141*a*) of the upper first functional end cap (40*a*; 240*a*), and has a functional end cap side face (148*a*; 348*a*), which extends at least substantially parallel to the pane face (121) of the second glass pane (120); and wherein the complementary counterpiece of the left glass door leaf associated with the first protrusion (52*a*; 252*a*) of the upper first functional end cap (40*a*; 240*a*) is formed by the functional end cap side face (148*a*, 348*a*) of the upper second functional end cap (140*a*; 340*a*), and wherein, in the closed state of glass door apparatus, the first protrusion (52*a*; 252*a*) of the upper first functional end cap (40*a*; 240*a*) is overlapping with the functional end cap side face (148*a*; 348*a*) of the upper second functional end cap (140; 340*a*).

4. The glass door apparatus of claim 3, wherein the upper second functional end cap (140*a*; 340*a*) further has a second protrusion (152*a*; 352*a*), which with respect to the pane face (121) of the second glass pane (120), is opposite the functional end cap side face (148*a*; 348*a*) of the upper second functional end cap (140*a*; 340*a*) and which, with respect to the lateral front face (142*a*; 342*a*) of the upper second functional end cap (140*a*; 340*a*), protrudes laterally outwards in a manner at least substantially parallel to the pane face (121) of the second glass pane (120) and in a direction away from the second glass pane (120), wherein the upper first functional end cap (40*a*; 240*a*) has a functional end cap side face (48*a*; 248*a*), which, with respect to the pane face (21) of the first glass pane (20), is disposed opposite to the first protrusion (52*a*; 252*a*) of the upper first functional end cap (40*a*; 240*a*) and extends at least substantially parallel to the pane face (21) of the first glass pane (20), and wherein, in the closed state of the glass door apparatus, the second protrusion (152*a*; 352*a*) of the upper second functional end cap (140*a*; 340*a*) overlaps with the functional end cap side face of the upper first functional end cap.

5. The glass door apparatus of claim 4, wherein the complementary counterpiece or a further complementary counterpiece of the left glass door leaf (100) associated with the first cavity (54*a*; 254*a*) of the upper first functional end cap (40*a*; 240*a*) is further formed by the second protrusion (152*a*; 352*a*) of the upper second functional end cap (140*a*; 340*a*).

6. The glass door apparatus of claim 3, wherein the left glass door leaf (100) further includes an oblong weather strip (170; 370), which defines a weather strip longitudinal axis and which is positioned on the right glass pane edge of the second glass pane and which extends with the weather strip longitudinal axis along the right glass pane edge (122) of the second glass pane (120) and which has a profile cross-section with a first leg (172; 372), which extends at least substantially from the right glass pane edge (122) of the second glass pane (120) in a manner at least substantially parallel to the pane face (121) of the second glass pane (120) and laterally away from the second glass pane (120) so that, in the closed state of the glass door apparatus, the first leg (172; 372) overlaps the left glass pane edge (22) of the first glass pane (20) and engages, while forming a corresponding complementary counterpiece of the left glass door leaf, the first cavity (54*a*, 54*b*; 254*a*, 254*b*) of the respective first functional end cap (40*a*, 40*b*; 240*a*, 240*b*).

7. The glass door apparatus of claim 2, wherein the left glass door leaf (100) also has a lower second glass door leaf frame part (130*b*), which engages the lower glass pane edge (126) of second glass pane (120), and wherein the second lower glass door leaf frame part (130*b*) has an oblong lower second frame body (132*b*), which defines a longitudinal axis (133*b*), extends with the longitudinal axis (133*b*) along the lower glass pane edge (126) of the second glass pane (120) and has a right frame body longitudinal end (134*b*), and a lower second functional end cap (140*a*, 340*b*), by which the right frame body longitudinal end (134*b*) of the lower second frame body (132*b*) is covered and which is horizontally positioned at the level of the right glass pane edge (122) of the second glass pane (120), defines a lateral outwardly exposed front face (142*b*; 342*b*), which, in a closed state of glass door apparatus, is near the lateral front face (42*b*; 141*b*) of the lower first functional end cap (40*b*; 240*b*), and has a functional end cap side face (148*b*; 348*b*), which extends at least substantially parallel to the pane face (121) of the second glass pane (120); and wherein the complementary counterpiece of the left glass door leaf associated with the first protrusion (52*b*; 252*b*) of the lower first functional end cap (40*b*; 240*b*) is formed by the functional end cap side face (148*a*, 348*b*) of the lower second functional end cap (140*b*; 340*b*), and wherein, in the closed state of glass door apparatus, the first protrusion (52*b*; 252*b*) of the lower first functional end cap (40*b*; 240*b*) is overlapping with the functional end cap side face (148*b*; 348*b*) of the lower second functional end cap (140; 340*b*).

8. The glass door apparatus of claim 7, wherein the lower second functional end cap (140*b*; 340*b*) further has a second protrusion (152*b*; 352*b*), which, with respect to the pane face (121) of the second glass pane (120), is disposed opposite to the functional end cap side face (148*b*; 348*b*) of the lower second functional end cap (140*b*; 340*b*) and which, with respect to the lateral front face (142*b*; 342*b*) of the lower second functional end cap (140*b*; 340*b*), protrudes laterally outwards in a manner at least substantially parallel to the pane face (121) of the second glass pane (120) and in a direction away from the second glass pane (120), wherein the lower first functional end cap (40*b*; 240*b*) further has a functional end cap side face (48*b*; 248*b*), which, with respect to the pane face (21) of the first glass pane (20) is opposite the first protrusion (52*b*; 252*b*) of the lower first functional end cap (40*b*; 240*b*) and extends, at least substantially, parallel to the pane face (21) of the first glass pane (20), and wherein, in the closed state of glass door apparatus, the second protrusion (152*b*; 352*b*) of the lower second functional end cap (140*b*; 340*b*) overlaps with the functional end cap side face (48*b*; 248*b*) of the lower first functional end cap (40*b*; 240*b*).

9. The glass door apparatus of claim 8, wherein the complementary counterpiece or a further complementary counterpiece of left glass door leaf (100) associated with the respective first cavity (54*b*; 254*b*) of the lower first functional end cap (40*b*; 240*b*) is further formed by the second protrusion (152*b*; 352*b*) of the lower second functional end cap (140*b*; 340*b*).

10. The glass door apparatus of claim 1, wherein the respective first functional end cap (40*a*, 40*b*; 240*a*, 240*b*) further has a second cavity (56*a*, 56*b*; 256*a*, 256*b*) which, with respect to the lateral front face (42*a*, 42*b*; 242*a*, 242*b*) of the respective first functional end cap (40*a*, 40*b*; 240*a*, 240*b*), protrudes laterally inwardly in a manner at least substantially parallel to the pane face (21) of the first glass pane (20) and in a direction towards the first glass pane (20) and which opens, in the opposite direction, laterally outwardly, and which, with respect to the pane face (21) of the first glass pane (20), is disposed opposite the first cavity (54*a*, 54*b*; 254*a*, 254*b*) of the respective first functional end cap (40*a*, 40*b*; 240*a*, 240*b*), so that a first functional block (58*a*, 58*b*; 258*a*, 258*b*) is formed between the first cavity and the second cavity of the respective first functional end cap (40*a*, 40*b*; 240*a*, 240*b*), wherein the complementary counterpiece associated with the first cavity (54*a*, 54*b*; 254*a*, 254*b*) of the respective first functional end cap (40*a*, 40*b*; 240*a*, 240*b*) interacts with the first functional block (58*a*, 58*b*; 258*a*, 258*b*), in the closed state of glass door apparatus, in an overlapping and abutting way.

11. The glass door apparatus of claim 10, wherein the first functional block (58*a*, 58*b*; 258*a*, 258*b*) has a lateral outwardly exposed functional block front face (60*a*, 60*b*; 260*a*, 260*b*) which is flush with a lateral front face (23) of the left glass pane edge (22) of the first glass pane (20) and forms an extension of the front face (23) of the left glass pane edge (22).

12. The glass door apparatus of claim 10, wherein the weather strip (370) has an H-profile cross-section with a fourth leg (382), which extends from the second transverse web end (376) away from the third leg (380) and which, in the closed state of the glass door apparatus, overlaps the left glass pane edge (22) of the first glass pane (20), and engages the second cavity (56*a*, 56*b*; 256*a*, 256*b*) of the respective first functional end cap (40*a*, 40*b*; 240*a*, 240*b*), while forming a further corresponding complementary counterpiece of the left glass door leaf (100).

13. The glass door apparatus of claim 12, wherein, in the closed state of the glass door apparatus, a gap formed between the second cavity (56*a*, 56*b*; 256*a*, 256*b*) of the respective first functional end cap (40*a*, 40*b*; 240*a*, 240*b*) and the further respective complementary counterpiece of the left glass door leaf (100) in a transversal direction with respect to the pane faces (21, 121) of the first and second glass panes (20, 120) is less or equal to a fifth of an overlapping length of the second cavity (56*a*, 56*b*; 256*a*, 256*b*) of the respective first functional end cap (40*a*, 40*b*; 240*a*, 240*b*) with the further respective complementary counterpiece of the left glass door leaf (100).

14. The glass door apparatus of claim 1, wherein, in the closed state of the glass door apparatus, at least one of (a) a gap is formed between the respective first protrusion (52*a*, 52*b*; 252*a*, 252*b*) and the respective complementary counterpiece of the left glass door leaf (100) in a transversal direction with respect to the pane faces (21, 121) of the first and second glass panes (20, 120), wherein said gap is less or equal to a fifth of an overlapping length of the respective first protrusion (52*a*, 52*b*; 252*a*, 252*b*) with the corresponding complementary counterpiece of the left glass door leaf (100) and (b) a gap is formed between the first cavity (54*a*,54*b*; 254*a*,254*b*) of the respective first functional end cap (40*a*, 40*b*; 240*a*, 240*b*) and the respective complementary counterpiece of the left glass door leaf (100) in a transversal direction with respect to the pane faces (21, 121) of the first and second glass panes (20, 120), wherein said gap is less or equal to a fifth of an overlapping length of the first cavity (54*a*,54*b*; 254*a*,254*b*) of the respective first functional end cap (40*a*, 40*b*; 240*a*, 240*b*) and the respective complementary counterpiece of the left glass door leaf (100).

15. The glass door apparatus of claim 1, wherein, in the respective first functional end cap (40*a*, 40*b*; 240*a*, 240*b*) at least one sealing element receiving vertical groove (86*a*, 86*b*; 286*a*, 286*b*) is also formed, which extends at least substantially parallel to the left glass pane edge (22) of the first glass pane (20), protrudes laterally inwardly at the front face of the respective first functional end cap (40*a*, 40*b*; 240*a*, 240*b*) in a manner at least substantially parallel to the pane face (21) of the first glass pane (20) as well as in a direction towards the first glass pane (20) and which opens, in opposite direction, laterally outwardly and in which a sealing element is received, which sealing element protrudes laterally outwardly from the sealing element receiving groove (86*a*, 86*b*; 286*a*, 286*b*) of the respective first functional end cap (40*a*, 40*b*; 240*a*, 240*b*) in a manner at least substantially parallel to the pane face (21) of the first glass pane (120) and in a direction away from the first glass pane (20), and which, in a closed state of the glass door apparatus, interacts with the left glass door leaf (100) in an abutting way.

16. A glass door apparatus, comprising:

a right glass door leaf (10), which includes a first glass pane (20) having a pane face (21) and which has a left glass pane edge (22), which extends at least substantially vertically; an upper glass pane edge (24), which extends at least substantially horizontally; and a lower glass pane edge (26), which extends at least substantially horizontally;

an upper first glass door leaf frame part (30*a*), which engages the upper glass pane edge (24) of the first glass pane (20); and a lower first glass door leaf frame part (30*b*), which engages the lower glass pane edge (26) of the first glass pane (20), and a left glass door leaf (100), which includes a second glass pane (120) having a pane face (121) and which has a right glass pane edge (122), which extends at least substantially vertically and which, in a closed state of the glass door apparatus, is near the left glass pane edge (22) of the first glass pane (20), wherein the second glass pane further has an upper glass pane edge (124), which extends at least substantially horizontally, and a lower glass pane edge (126), which extends at least substantially horizontally; and wherein the upper first glass door leaf frame part (30*a*) has a first oblong upper frame body (32*a*), which defines a longitudinal axis (33*a*), extends with the longitudinal axis (33*a*) of the first oblong upper frame body (32*a*) along the glass pane edge (24) of the first glass pane (20) and has a left frame body longitudinal end (34*a*), and an upper first functional end cap (40*a*; 240*a*), by which the left frame body longitudinal end (34*a*) of the first frame body (32*a*) is covered and which is horizontally positioned at the level of the left glass pane edge (22) of the first glass pane (20), defines a lateral outwardly exposed front face (42*a*, 242*a*), and has at least one of (a) a first protrusion (52*a*; 252*a*), which, with respect to the lateral front face (42*a*; 242*a*) of the first upper functional end cap (40*a*; 240*a*), protrudes laterally outwards in a manner at least substantially parallel to the pane face (21) of the first glass pane (20) as well as in a direction away from the first glass pane (20), and (b) a first cavity (54*a*; 254*a*) which, with respect to the lateral front face (42*a*; 242*a*) of the first functional end cap (40*a*; 240*a*), protrudes laterally inwardly in a manner at least substantially parallel to the pane face (21) and in a direction towards the first glass pane (20) and which, in the opposite direction, opens laterally outwardly, wherein the lower first glass door leaf frame part (30*b*) has a first oblong lower frame body (32*b*), which defines a longitudinal axis (33*b*), extends, with the longitudinal axis (33*b*) of the first oblong lower frame body (32*b*) along the lower glass pane edge (24) of the first glass pane (20) and has a left frame body longitudinal end (34*b*), and a lower first functional end cap (40*b*; 240*b*), by which the left frame body longitudinal end (34*b*) of the lower first frame body (32*b*) is covered and which is horizontally positioned at the level of the left glass pane edge (22) of the first glass pane (20), defines a lateral outwardly exposed front face (42*b*, 242*b*), and has at least one of (a) a first protrusion (52*b*, 252*b*), which, with respect to the lateral front (42*b*, 242*b*) of the lower first functional end cap (40*b*, 240*b*), protrudes laterally outwards in a manner at least substantially parallel to the pane face (21) of the first glass pane (20) as well as in a direction away from the first glass pane (20), and (b) a first cavity (54*b*, 254*b*) which, with respect to the lateral front (42*b*, 242*b*) of the lower first functional end cap (40*b*, 240*b*), protrudes laterally inwardly in a manner at least substantially parallel to the pane face (21) and in a direction towards the first glass pane (20) and which, in the opposite direction, opens laterally outwardly, wherein, in the closed state of the glass door apparatus, the at least one of the first protrusion (52*a*, 52*b*; 252*a*, 252*b*) and the first cavity (54*a*, 54*b*; 254*a*, 254*b*) of the respective first functional end cap (40*a*, 40*b*; 240*a*, 240*b*) is overlapped with a respectively corresponding complementary counterpiece of the left glass door leaf (100), wherein the left glass door leaf (100) further includes an upper second glass door leaf frame part (130*a*), which engages the upper glass pane edge (124) of second glass pane (120), and wherein the upper second glass door leaf frame part (130*a*) has an oblong upper second frame body (132*a*), which defines a longitudinal axis (133*a*), extends with the longitudinal axis (133*a*) of the oblong upper second frame body (132*a*) along the upper glass pane edge (124) of the second glass pane (120) and has a right frame body longitudinal end (134*a*), and an upper second functional end cap (140*a*, 340*a*), by which the right frame body longitudinal end (134*a*) of the upper second frame body (132*a*) is covered and which is horizontally positioned at the level of the right glass pane edge (122) of the second glass pane (120), defines a lateral outwardly exposed front face (142*a*; 342*a*), which, in a closed state of glass door apparatus, is near the lateral front face (42*a*; 141*a*) of the upper first functional end cap (40*a*; 240*a*), and has a functional end cap side face (148*a*; 348*a*), which extends at least substantially parallel to the pane face (121) of the second glass pane (120), wherein the complementary counterpiece of the left glass door leaf associated with the first protrusion (52*a*; 252*a*) of the upper first functional end cap (40*a*; 240*a*) is formed by the functional end cap side face (148*a*, 348*a*) of the upper second functional end cap (140*a*; 340*a*), and wherein, in the closed state of glass door apparatus, the first protrusion (52*a*; 252*a*) of the upper first functional end cap (40*a*; 240*a*) is overlapping with the functional end cap side face (148*a*; 348*a*) of the upper second functional end cap (140; 340*a*), wherein the left glass door leaf (100) has an oblong weather strip (170; 370), which defines a weather strip longitudinal axis and which is positioned on the right glass pane edge of the second glass pane and which extends with the weather strip longitudinal axis along the right glass pane edge (122) of the second glass pane (120) and which has a profile cross-section with a first leg (172; 372), which extends at least substantially from the right glass pane edge (122) of the second glass pane (120) in a manner at least substantially parallel to the pane face (121) of the second glass pane (120) and laterally away from the second glass pane (120) so that, in the closed state of the glass door apparatus, the first leg (172; 372) overlaps the left glass pane edge (22) of the first glass pane (20) and engages, while forming a corresponding complementary counterpiece of the left glass door leaf, the first cavity (54*a*, 54*b*; 254*a*, 254*b*) of the respective first functional end cap (40*a*, 40*b*; 240*a*, 240*b*), and wherein the weather strip (170) has an h-profile cross-section with a central transverse web (174), which has a first transverse web end and second transverse web end (175, 176), wherein the first leg (172) extends from the first transverse web end (175); a second leg (178), which extends from the first transverse web end (175) opposite to the first leg (172) and overlaps the right glass pane edge (122) of the second glass pane (120); and a third leg (180), which extends from the second transverse web end (176) in the same direction of the second leg (178) and overlaps the right glass pane edge (122) of the second glass pane (120).

17. The glass door apparatus of claim 16, wherein the respective second functional end cap (140*a*, 140*b*; 340*a*, 340*b*) further has a first cavity (154*a*, 154*b*; 354*a*, 354*b*), which, with respect to the lateral front face (142*a*, 142*b*; 342*a*, 342*b*) of the respective second functional end cap (140*a*, 140*b*; 340*a*, 340*b*), protrudes laterally inwards in a manner at least substantially parallel to the pane face (121) of the second glass pane (120) and in a direction towards the second glass pane (120) and which opens, in the opposite direction, laterally outwards, and a second cavity (156*a*, 156*b*; 356*a*, 356*b*), which, with respect to the lateral front face (142*a*, 142*b*; 342*a*, 342*b*) of the respective second functional end cap (140*a*, 140*b*; 340*a*, 340*b*), protrudes laterally inwards in a manner at least substantially parallel to the pane face (121) of the second glass pane (120) and in a direction towards the second glass pane (120) and which opens, in the opposite direction, laterally outwards and which, with respect to the pane face (121) of the second glass pane (120), is disposed opposite the first cavity (154*a*, 154*b*; 354*a*, 354*b*) of the respective second functional end cap (140*a*, 140*b*; 340*a*, 340*b*), so that a second functional block (158*a*, 158*b*; 358*a*, 358*b*) is formed between the first cavity and the second cavity of the respective second functional end cap (140*a*, 140*b*; 340*a*, 340*b*), wherein the second leg (178; 378) of the weather strip (170; 370) engages the first cavity (154*a*, 154*b*; 354*a*, 354*b*) of the respective second functional end cap (140*a*, 140*b*; 340*a*, 340*b*), and the third leg (180; 380) of the weather strip (170; 370) engages the second cavity (156*a*, 156*b*; 356*a*, 356*b*) of the respective second functional end cap (140*a*, 140*b*; 340*a*, 340*b*), wherein the second functional block (158*a*, 158*b*; 358*a*, 358*b*) has a lateral outwardly exposed functional block front face (160*a*, 160*b*; 360*a*, 360*b*) which is flush with a lateral front face (123) of the right glass pane edge (122) of the second glass pane (120) and forms an extension of the front face (123) of the right glass pane edge (122).

18. A glass door apparatus, comprising:

a right glass door leaf (10), which includes a first glass pane (20) having a pane face (21) and which has a left glass pane edge (22), which extends at least substantially vertically; an upper glass pane edge (24), which extends at least substantially horizontally; and a lower glass pane edge (26), which extends at least substantially horizontally;

an upper first glass door leaf frame part (30*a*), which engages the upper glass pane edge (24) of the first glass pane (20); and a lower first glass door leaf frame part (30*b*), which engages the lower glass pane edge (26) of the first glass pane (20), and a left glass door leaf (100), which includes a second glass pane (120) having a pane face (121) and which has a right glass pane edge (122), which extends at least substantially vertically and which, in a closed state of the glass door apparatus, is near the left glass pane edge (22) of the first glass pane (20), wherein the second glass pane further has an upper glass pane edge (124), which extends at least substantially horizontally, and a lower glass pane edge (126), which extends at least substantially horizontally; and wherein the upper first glass door leaf frame part (30*a*) has a first oblong upper frame body (32*a*), which defines a longitudinal axis (33*a*), extends with the longitudinal axis (33*a*) of the first oblong upper frame body (32*a*) along the upper glass pane edge (24) of first glass pane (20) and has a left frame body longitudinal end (34*a*), and an upper first functional end cap (40*a*; 240*a*), by which the left frame body longitudinal end (34*a*) of the upper first frame body (32*a*) is covered and which is horizontally positioned at the level of the left glass pane edge (22) of the first glass pane (20), defines a lateral outwardly exposed front face (42*a*, 242*a*), and has at least one of (a) a first protrusion (52*a*, 252*a*), which, with respect to the lateral front face (42*a*, 242*a*) of the upper first functional end cap (40*a*, 240*a*), protrudes laterally outwards in a manner at least substantially parallel to the pane face (21) of the first glass pane (20) as well as in a direction away from the first glass pane (20), and (b) a first cavity (54*a*, 254*a*) which, with respect to the lateral front face (42*a*, 242*a*) of the upper first functional end cap (40*a*, 240*a*), protrudes laterally inwardly in a manner at least substantially parallel to the pane face (21) and in a direction towards the first glass pane (20) and which, in the opposite direction, opens laterally outwardly, wherein the lower first glass door leaf frame part (30*b*) has a first oblong lower frame body (32*b*), which defines a longitudinal axis (33*b*), extends, with the longitudinal axis (33*b*) of the first oblong lower frame body (32*b*) along the lower glass pane edge (24) of the first glass pane (20) and has a left frame body longitudinal end (34*b*), and a lower first functional end cap (40*b*; 240*b*), by which the left frame body longitudinal end (34*b*) of the lower first frame body (32*b*) is covered and which is horizontally positioned at the level of the left glass pane edge (22) of the first glass pane (20), defines a lateral outwardly exposed front face (42*b*, 242*b*), and has at least one of (a) a first protrusion (52*b*, 252*b*), which, with respect to the lateral front (42*b*, 242*b*) of the lower first functional end cap (40*b*, 240*b*), protrudes laterally outwards in a manner at least substantially parallel to the pane face (21) of the first glass pane (20) as well as in a direction away from the first glass pane (20), and (b) a first cavity (54*b*, 254*b*) which, with respect to the lateral front (42*b*, 242*b*) of the lower first functional end cap (40*b*, 240*b*), protrudes laterally inwardly in a manner at least substantially parallel to the pane face (21) and in a direction towards the first glass pane (20) and which, in the opposite direction, opens laterally outwardly, wherein, in the closed state of the glass door apparatus, the at least one of the first protrusion (52*a*, 52*b*; 252*a*, 252*b*) and the first cavity (54*a*, 54*b*; 254*a*, 254*b*) of the respective first functional end cap (40*a*, 40*b*; 240*a*, 240*b*) is overlapped with a respectively corresponding complementary counterpiece of the left glass door leaf (100), wherein the left glass door leaf (100) also has an upper second glass door leaf frame part (130*a*), which engages the upper glass pane edge (124) of second glass pane (120), wherein the upper second glass door leaf frame part (130*a*) has an oblong upper second frame body (132*a*), which defines a longitudinal axis (133*a*), extends with the longitudinal axis (133*a*) of the oblong upper second frame body (132*a*) along the upper glass pane edge (124) of the second glass pane (120) and has a right frame body longitudinal end (134*a*), and an upper second functional end cap (140*a*, 340*a*), by which the right frame body longitudinal end (134*a*) of the upper second frame body (132*a*) is covered and which is horizontally positioned at the level of the right glass pane edge (122) of the second glass pane (120), defines a lateral outwardly exposed front face (142*a*; 342*a*), which, in a closed state of glass door apparatus, is near the lateral front face (42*a*; 141*a*) of the upper first functional end cap (40*a*; 240*a*), and has a functional end cap side face (148*a*; 348*a*), which extends at least substantially parallel to the pane face (121) of the second glass pane (120), wherein the complementary counterpiece of the left glass door leaf associated with the first protrusion (52*a*; 252*a*) of the upper first functional end cap (40*a*; 240*a*) is formed by the functional end cap side face (148*a*, 348*a*) of the upper second functional end cap (140*a*; 340*a*), and wherein, in the closed state of glass door apparatus, the first protrusion (52*a*; 252*a*) of the upper first functional end cap (40*a*; 240*a*) is overlapping with the functional end cap side face (148*a*; 348*a*) of the upper second functional end cap (140; 340*a*), and wherein, in the respective second functional end cap (140*a*, 140*b*; 340*a*, 340*b*), at least one sealing element receiving vertical groove (186*a*, 186*b*; 386*a*, 386*b*) is formed, which extends at least substantially parallel to the right glass pane edge (122) of the second glass pane (120), protrudes laterally inwardly at the front face of the respective second functional end cap (140*a*, 140*b*; 340*a*, 340*b*) in a manner at least substantially parallel to the pane face (121) of second glass pane (120) as well as in a direction towards the second glass pane (120) and which opens, in the opposite direction, laterally outwardly and in which a sealing element is received, which sealing element protrudes laterally outwardly from the sealing element receiving groove (186*a*, 186*b*; 386*a*, 386*b*) of the respective second functional end cap (140*a*, 140*b*; 340*a*, 340*b*) in a manner at least substantially parallel to the pane face (121) of the second glass pane (120) and in a direction away from the second glass pane (120), and which sealing element, in a closed state of the glass door apparatus, interacts with the first functional end cap (40*a*, 40*b*; 240*a*, 240*b*), which is opposite the respective second functional end cap (140*a*, 140*b*; 340*a*, 340*b*).

* * * * *